US011619061B1

(12) United States Patent
Wendichansky et al.

(10) Patent No.: US 11,619,061 B1
(45) Date of Patent: Apr. 4, 2023

(54) SYSTEM FOR CONTROLLING STRUCTURAL VIBRATIONS OF A MULTI-STORY VERTICAL STRUCTURE

(71) Applicants: Daniel A. Wendichansky, Mayaguez, PR (US); Luis E. Suarez, Mayaguez, PR (US); Jairo A. Agudelo, Mayaguez, PR (US)

(72) Inventors: Daniel A. Wendichansky, Mayaguez, PR (US); Luis E. Suarez, Mayaguez, PR (US); Jairo A. Agudelo, Mayaguez, PR (US)

(73) Assignee: UNIVERSITY OF PUERTO RICO, San Juan, PR (US)

( * ) Notice: Subject to any disclaimer, the term of this patent is extended or adjusted under 35 U.S.C. 154(b) by 0 days.

(21) Appl. No.: 15/255,094

(22) Filed: Sep. 1, 2016

Related U.S. Application Data

(60) Provisional application No. 62/212,646, filed on Sep. 1, 2015.

(51) Int. Cl.
*E04H 9/02* (2006.01)
*E04B 1/98* (2006.01)

(52) U.S. Cl.
CPC ..... *E04H 9/021* (2013.01); *E04B 1/98* (2013.01); *E04H 9/022* (2013.01); *E04H 9/0235* (2020.05); *E04H 9/0237* (2020.05)

(58) Field of Classification Search
CPC ..... E04H 9/02; E04H 9/021; E04H 9/0235; E04H 9/0237; E04H 9/0215; E04H 9/022; E04H 9/24; E04H 9/027
See application file for complete search history.

(56) References Cited

U.S. PATENT DOCUMENTS 4,766,708 A * 8/1988 Sing ..... E04B 1/98 52/167.8
5,111,543 A * 5/1992 Epshetsky ..... A47C 21/00 5/1

(Continued)

FOREIGN PATENT DOCUMENTS

CA 2820820 A1 * 7/2012 ..... F16F 7/003
JP 2016125335 A * 7/2016 ..... E04H 9/021
WO WO-2017056265 A1 * 4/2017 ..... F16F 15/04

*Primary Examiner* — Phi D A
(74) *Attorney, Agent, or Firm* — Hoglund & Pamias, PSC; Roberto J. Rios

(57) ABSTRACT

A new passive control building arrangement is provided for improving the seismic response of structures. The proposed control arrangement was incorporated to a 1/20 scale model of a steel structure. The SAP2000 software program was used to develop an analytical model of the constructed scale model. After using a series of experimental data to calibrate the analytical model, valuable information of the dynamic properties of the arrangement was obtained. Different configurations with distinct parameters of the control arrangement were analyzed in the program to evaluate the variables that affect the dynamic properties of the model. It was determined that the geometric configuration of the arrangement and the spring stiffness value of a spring used in the arrangement affect considerably the dynamic properties. Simulated earthquake tests were performed in two proposed alternatives of the control arrangement to evaluate their effectiveness in improving the seismic response of the scale model. It was observed that the control arrangement can effectively reduce the accelerations and base reactions of the model.

8 Claims, 37 Drawing Sheets

(56) References Cited

U.S. PATENT DOCUMENTS

| | | | | |
|---|---|---|---|---|
| 5,382,008 | A * | 1/1995 | Tyutinman | E04H 9/021 248/584 |
| 6,125,596 | A * | 10/2000 | Goto | E04H 9/02 52/167.4 |
| 2004/0074723 | A1* | 4/2004 | Tsai | E04H 9/02 188/371 |
| 2013/0118098 | A1* | 5/2013 | Constantinou | F16F 1/128 52/167.1 |
| 2015/0000217 | A1* | 1/2015 | Sarlis | E04H 9/021 52/167.2 |
| 2015/0033641 | A1* | 2/2015 | Satoh | E04H 9/02 52/167.1 |
| 2015/0191928 | A1* | 7/2015 | Germain | E04H 9/021 52/167.7 |
| 2016/0298352 | A1* | 10/2016 | Agha Beigi | E04H 9/027 |
| 2016/0319499 | A1* | 11/2016 | Annan | E01D 19/00 |
| 2017/0058514 | A1* | 3/2017 | Wu | E04H 9/021 |
| 2018/0216359 | A1* | 8/2018 | Nakakubo | F16F 15/04 |
| 2018/0266135 | A1* | 9/2018 | Agha Beigi | E04B 1/98 |

* cited by examiner a) Defined dimensions b) Elements representation diagram

FIG. 34
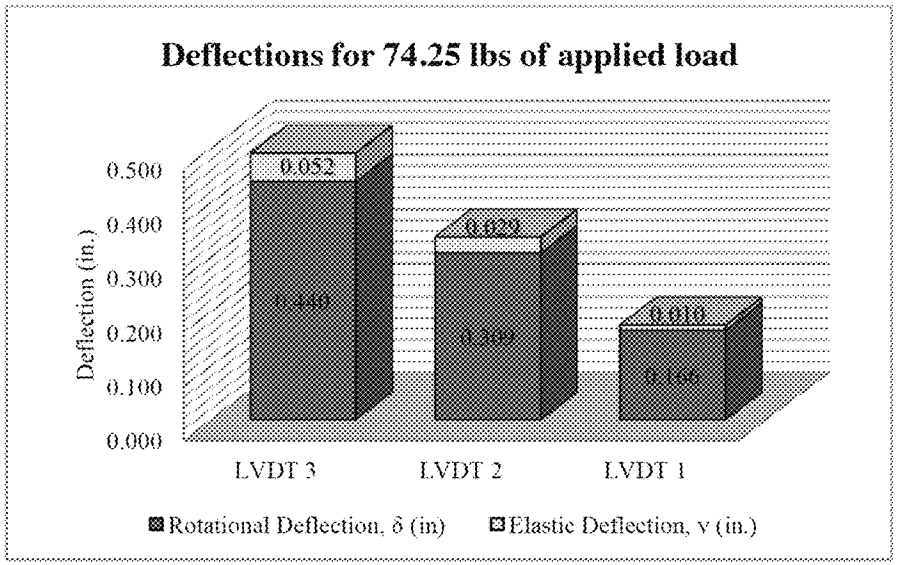
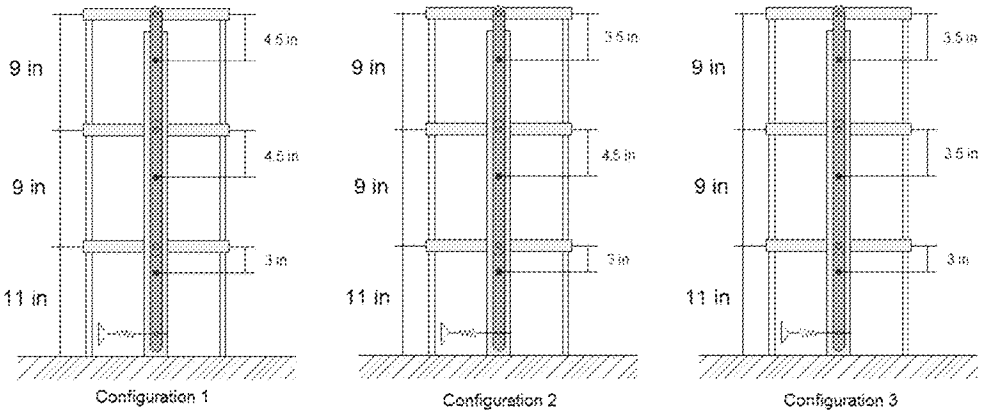
FIG. 37

| Alternative | y1 (in) | y2 (in) | y3 (in) | K spring (lbs/in) |
|---|---|---|---|---|
| Conventional | n/a | n/a | n/a | n/a |
| PROP 1 | 3.25 | 2 | 6 | 7.56 |
| PROP 2 | 4 | 2.5 | 6.5 | 49.2 |

| Alternative | y1 (in) | y2 (in) | y3 (in) | K spring (lbs/in) | Effective Damping (lbs-sec/in) |
|---|---|---|---|---|---|
| Conventional | n/a | n/a | n/a | n/a | n/a |
| PROP 1 | 3.25 | 2 | 6 | 7.56 | n/a |
| PROP 2 | 4 | 2.5 | 6.5 | 49.2 | n/a |
| DAMP 1 | 3.25 | 2 | 6 | 25 | 2 |
| DAMP 2 | 4 | 2.5 | 6.5 | 49.2 | 3 |

SYSTEM FOR CONTROLLING STRUCTURAL VIBRATIONS OF A MULTI-STORY VERTICAL STRUCTURE

BACKGROUND OF THE INVENTION

Earthquakes are natural events that can cause injuries, loss of life, general property damage and collapse or destabilization of buildings. Such catastrophic capabilities have converted earthquakes into one of the main concerns in civil engineering. The challenge of designing structures that ensure the public safety while being economically feasible is further complicated by the threat of earthquakes in seismic regions.

Traditionally, the intent of building code seismic provisions is to provide structures with the ability to withstand intense ground shaking without collapse, but potentially with some significant structural damage (FEMA, 2000). This design philosophy is referred to as a seismic-resistance-based design approach, in which the strength of the system and its ductility are increased to resist the earthquake loads. In this approach, structures are expected to behave in a ductile manner, experiencing deformations beyond their elastic limit. A more modern approach for seismic design is the response control design approach. In this approach, structures are designed with a system of control devices that reduce the structure response to the ground shaking. These control systems can be classified in three classes: passive control systems, active control systems and semi-active control systems. Passive control systems are systems that do not require any external power source to function since they utilize the motion of the structure to develop the control forces. An active control system may be defined as a system which requires a large external power source to operate controlling actuators which supply control forces to the structure. A semi-active control system is a combination of active and passive systems that uses a small external power source for operation.

In the conventional strength seismic-resistance-based-design approach, the strength and ductility of a structure are increased to resist the lateral forces experienced in an earthquake. The main disadvantage of this conventional approach is that the structure is susceptible to damage under the action of major earthquakes. The inflicted damage may be repairable or may even be so serious that the structure must be demolished. This has proven to be quite expensive, leading to the study of another approach, the seismic response control design approach. In this approach, a considerable part of the seismic energy transferred to the structure is dissipated without necessarily suffering from inelastic deformations, improving the behavior of the structure when subjected to ground shaking. This newer concept of structural control has been growing in acceptance and may preclude the necessity for allowing inelastic deformations in the structural system.

An active control system requires an external power source to power electrohydraulic or electromechanical actuators that supply control forces to the structure. Control forces are developed based on feedback from sensors that measure the excitation and/or response of the structure. However, the complicated control systems and the large power requirements during strong earthquakes hamper their implementation in practice. A semi-active control system requires less power that an active control system for operation (e.g. a battery) because it utilizes the motion of the structure to develop control forces, the magnitude of which can be adjusted by the external power source. Similarly, to active systems, they have the main disadvantage that they require a power source, and hence they are not that attractive in seismic response control. It is common that severe earthquakes cause power failures, thus leaving active and semi-active systems without the necessary power for operation. To compensate for this risk, there is redundancy built into the control systems, which further complicates the control system itself. Hence there is always a requirement to reduce the number of active systems and semi-active systems, and it is usually recommended to opt for passive devices and the fail-safe design approach.

The passive control systems that have been most studied can be classified into three groups: energy dissipators, tuned mass dampers and base isolators. Energy dissipators work by increasing the energy dissipation capability of the structure to which they are attached. They do so by converting mechanical energy into heat energy. Examples from this type of control system are viscoelastic dampers, yielding dampers, viscous dampers and friction dampers. Tuned mass dampers function as a dynamic vibration absorber consisting of an auxiliary mass on the order of 1% of the mass of the structure, tuned to the frequency of the structure. Their principle is to transfer energy from the structure to the damper when vibrating at a resonant frequency. Base isolators consist of a flexible isolation system introduced between the foundation and superstructure so as to increase the natural period of the system. The increase in flexibility results in the deflection of a major portion of the earthquake energy; reducing accelerations in the superstructure while increasing the displacement across the isolation level. Some of the available base isolators are laminated rubber bearings, laminated rubber bearing with lead core and friction pendulum systems.

The effectiveness of a passive control system can be experimentally studied by using scale models in shaking table tests. Model analysis can be used to obtain quantitative information on the seismic behavior of complex structures. To properly simulate the behavior of an actual structure with a model, similitude laws for ground motion, material, and force simulation must be taken into consideration.

Energy Dissipators

The aim of including energy dissipation devices in a structure is to concentrate the dissipation of hysteretic energy in specially designed and detailed regions of the structure and to avoid inelastic behavior in members of the lateral force resisting system.

A review of the evolution of energy dissipation shows that a number of devices with high energy-dissipation capacity have been developed over the last two decades. In general, hysteretic devices developed to date may be classified as either yielding or friction devices. These devices are fabricated from traditional materials and if properly designed require little maintenance and offer an economic and reliable alternative for energy dissipation in passive control systems. The ability of hysteretic devices to dissipate large amounts of energy has been shown by experimental programs. Also, analytical models to reproduce device behavior have been proposed and successfully validated.

A theory of toggle-brace damper systems was presented as a novel alternative of energy dissipation systems. The theory is based on the principle of magnification of small damper forces in shallow trusses and delivery of the magnified forces to the structural frame. These systems are intended for applications in systems with small structural drift, as may be the case in stiff structures and applications for wind response reduction. Experimental results on a shaking table demonstrated the utility and effectiveness of the system.

A study was conducted a study to define a procedure for determining the optimum size and location of viscoelastic dampers using the eigenvalue assignment technique. Natural frequencies and modal damping ratios of a structure required to satisfy a given target response are first determined. Then those desired structural parameters are realized by optimally distributing the damping and stiffness coefficient of viscoelastic dampers using non-linear programming based on the gradient of eigenvalues. This results in information of the optimal location as well as the magnitude of the damper parameters to achieve a desired target. Numerical analysis of a 10-story shear building, and a plan-wise asymmetric structure was made as part of the investigation. It was found that using the proposed method the damper parameters were mostly allocated to the inter-story with large drift or to the flexible edge. This implies that the proposed method can provide a reasonable distribution of the viscoelastic dampers in structures with a symmetric or an asymmetric plan to meet a given target displacement.

A passive hybrid system consisting of passive viscous dampers and variable friction dampers was also investigated. The addition of variable friction dampers to a viscous damped structure is aimed at providing extra energy dissipation at low velocities in order to obtain further improvement of the structural response. A method was proposed for the selection of the variable friction dampers parameters based on equivalent energy dissipation at peak displacements. The effectiveness of the proposed method was verified by numerical analysis of a seven-story steel plane frame. The results showed that using the hybrid damping system reduced peak displacements and inter-story drifts in the structure compared to when a system of viscous dampers only was used. Peak values of base shear forces in the structure with the different damping systems were practically the same, but as using the hybrid damping system reduced the peak displacements and inter-story drifts, the amount of energy that should be dissipated by the structural elements was reduced. This solution seems appealing for practical implementations in buildings designed for areas with high seismic activity.

Tuned Mass Dampers

Tuned dampers use an auxiliary mass on the order of 1% of the mass of the structure tuned to the frequency of the structure. There are two types of tuned dampers; tuned mass dampers and liquid tuned dampers. Tuned mass dampers use a solid mass connected through a passive spring, while liquid tuned dampers use a liquid mass contained in a rigid tank. Usually, both types of dampers have the auxiliary mass located at the top of the building.

The tuned mass damper (TMD) initial application was to control the displacement response of structures subjected to wind-induced vibrations. It was later that it was concluded that dampers are not effective in reducing the maximum response of tall buildings subjected to seismic loading. This is because earthquake ground motions include a wide spectrum of frequency components and often induce significant vibration in the fundamental and higher modes of a tall building. This causes TMD's to substantially reduce the first mode response of the structure, but marginally reducing the higher mode responses. Hence, multiple tuned mass dampers (MTMD's) were introduced. MTMD's are tuned to different modes and placed at various locations to enhance the seismic performance of the dampers. MTMD's with the optimal frequency range were proven to be more effective than single TMD's.

A bidirectional and homogeneous tuned mass damper has been proposed. By being bidirectional, the proposed device has the advantage of allowing control of vibrations in both principal directions on the structure and has the capacity to tune the device in each principal direction independently. The proposed TMD has a pendulum mass attached to a friction damper. As seen in FIG. 1, the pendulum mass is hanged from a Y-shape cable system to obtain different oscillation periods in the two principal directions. When the mass moves in the x-direction, the system behaves as a pendulum of length Lx. On the other hand, when the mass moves in the y-direction, the system behaves as a pendulum of length Ly. Two different structural models were evaluated using the proposed damper system. The response of the two models subjected to different unidirectional and bidirectional ground excitations showed that the level of response reduction that can be achieved by the system is similar to that of an ideal linear viscous tuned mass damper.

Similarly, a bidirectional tuned mass damper for seismic response control has also been proposed. The system is focused on the seismic response control of asymmetric-plan buildings subjected to bi-directional ground motions. Using a single translation-only TMD is not a very effective approach for the modal control of asymmetric-plan buildings because the vibration modes of asymmetric buildings are translation-rotation coupled. The typical approach to control the coupled vibration is by using MTMD's, complicating the design with additional parameters. In order to simplify these complications, a single coupled TMD was developed that vibrates simultaneously in both translation and rotation, consistent with the targeted coupled vibration mode of a one-way asymmetric plan building. After gathering roof translational and rotational response histories for three example model buildings subjected to two seismic excitations and observing reductions of edge peak translations, it was confirmed that the coupled TMD's was effective in reducing the seismic response. Motivated by the performance of the coupled TMD, the research was expanded to bi-directional coupled TMD, as an approach for the modal control of two-way asymmetric-plan buildings subjected to bi-directional ground motions. It was shown that the proposed bi-directional coupled TMD was effective in reducing the seismic damage of elastic and inelastic asymmetric-plan buildings.

Tuned liquid dampers (TLD's) are devices that absorb energy and control the dynamic response of structures using the sloshing resonance of liquid in a shallow tank. Tuning the fundamental sloshing frequency of the TLD to the structure's natural frequency causes a large amount of sloshing at the resonant frequencies of the combined TLD-structure system, thus absorbing a significant amount of energy. Tuned liquid column dampers (TLCD) use a column container instead of a shallow tank to suppress the structural vibration by the motion of liquid. Similar to multiple tuned mass dampers, multiple tuned liquid column dampers whose natural frequencies are distributed over a certain range around the fundamental frequency of the structure have been investigated. A parametric study was conducted through a numerical procedure involving the effects of frequency range, coefficient of head loss, number of TLCD's and central frequency on the performance of multiple tuned liquid column dampers.

A modified liquid column damper, denominated tuned liquid column ball damper, has been also investigated. This modified version is equipped with a coated steel ball, immersed inside the horizontal section of the damper. The purpose of the ball is to act as a moving orifice and disturb the flow in a manner as to improve the absorber attenuation performance. The response of a structure with attached tuned liquid column ball damper was compared with one attached with a tuned liquid column damper. It was shown that the performance of the proposed absorber can achieve up to 67% vibration reduction, within the resonance region of the primary structure, as opposed to the traditional TLCD.

An alternate configuration for tuned liquid dampers has also been proposed. The alternate configuration has the damper rigidly attached to a secondary mass that is attached to the primary structure through a properly designed spring system. This increases the TLD's base acceleration, which increases the sloshing of water. TLD's dissipate more energy when water sloshing is greater, hence the reason for the proposed TLD configuration. This configuration is denoted as a hybrid mass liquid damper, since there is both a secondary mass and liquid damper. The effectiveness of this configuration is dependent of the relative stiffness of the secondary spring system compared to the stiffness of the primary system. When the secondary spring stiffness is optimal, the hybrid mass liquid damper configuration is very effective as a structural control device.

A hybrid system between a TLCD and a pendulum type TMD has also been investigated. The configuration of the device is essentially a TLCD which is attached to a structure as a compound pendulum instead of keeping it fixed. Therefore, the configuration has been denominated a pendulum type liquid column damper. The purpose of the configuration is to excite more the liquid compared to a conventional TLCD. Further, since the natural frequency of such a system will be related to the mass moment of inertia of the pendulum, more flexibility can be provided to tune the system with the structure's targeted natural frequency compared to a conventional pendulum type TMD.

Base Isolation

Base isolation devices reduce the horizontal earthquake base acceleration transmitted to the superstructure by modifying the free vibration characteristics of the structure and bringing it to a lower frequency. Base isolation systems support the weight of the structure on a flexible interface that provides little resistance to lateral loading by virtue of their low friction. Base isolation shifts the fundamental period of the structure out of the range of the dominant earthquake energy and also increases the energy-absorbing capability of the structure. Some of the base isolators are laminated rubber bearings, laminated rubber bearings with lead core and friction pendulum systems.

The efficacy of seismic isolation in structures subjected to strong ground excitation, including near-fault effects, is potentially compromised by situations that induce uplift (or tension) in the isolation bearings. This led to the introduction of an innovative uplift-restraining Friction Pendulum system. As shown in FIG. 2, the new isolation device consists of two orthogonal opposing concave beams interconnected through a sliding mechanism that permits tension to develop in the bearing, thereby preventing uplift. Under the constraint to remain mutually perpendicular, the two opposing beams can move independently relative to each other to form a bi-directional (XY) motion mechanism. The isolator has the capability of providing distinct stiffness and energy dissipation along the principal horizontal directions of the bearing. A comprehensive analytical and experimental study was conducted on the isolation system. The experimental program involved a slender, five-story, scale-model frame seismically isolated with four isolators subjected to horizontal and vertical ground motions. The experimental response demonstrated the validity of the concept and its effectiveness in preventing uplift. An analytical model was developed to predict the dynamic response of the seismic-isolated model structure.

An experimental investigation was carried out on the influence of lateral displacement on the vertical stiffness of elastomeric and lead-rubber seismic isolation bearings. Isolation bearings are vertically stiff but horizontally flexible enough to lengthen a structure's period of vibration. The low horizontal stiffness required in the isolator causes it to experience large lateral displacements. According to the results of the investigation, these large lateral displacements lead to reductions in the load-carrying capacity and vertical stiffness of the elastomeric or lead-rubber bearing. The results of the investigation were also used to evaluate different formulations used to predict the reduction in vertical stiffness. According to the experimental results and one of the formulations used, the vertical stiffness of the bearing at a lateral displacement equal to the bonded rubber diameter is approximately 20% of the initial vertical stiffness.

A friction pendulum system that has a variable friction coefficient has been also investigated. This variable friction pendulum system has a coefficient of friction that depends on the isolator displacement. The variation of the friction is in such manner that up to a certain value of the isolator displacement the frictional force increases and then it decreases with further increases of displacement. This type of variation gives the isolator initial softness for smaller inputs, then provides stiffness for moderate inputs, and finally for large inputs it becomes again soft. Achieving the desired variation of friction in practice is not simple. This has prevented the system from being experimentally evaluated. The response of a flexible multi-story structure isolated with the system subjected to bi-directional near-fault ground motion was investigated using a mathematical idealization for the variation of the coefficient of friction. It was found that the system proposed was very effective in controlling the response of the structure. The performance of the variable friction pendulum system was more robust and superior when compared with a traditional friction pendulum system.

Investigations have also focused in friction pendulum isolators that exhibit different hysteretic properties at various levels of displacement demand, termed multi-stage friction pendulum isolators. The purpose of the investigation is to solve the problem that when isolation systems are designed to withstand severe motions, bearings often become so large and stiff that they provide little isolation during moderate seismic events. The system of particular interest in the investigation is a triple pendulum bearing. Two minor concave surfaces that have a low friction interface form a pendulum mechanism that defines the behavior of the isolation system under wind and low levels of seismic excitation. Another surface with a different friction coefficient forms a second pendulum mechanism that defines the primary behavior of the isolation system under moderate levels of excitation. Another sliding surface forms a third pendulum mechanism. The friction coefficient of this third sliding interface can be made sufficiently large to prevent sliding until an extreme level of excitation occurs. This triple pendulum system has the advantage that the stiffness and damping can be selected based on multiple levels of seismic hazard.

Adaptive Negative Stiffness Systems

A new passive control system that is being developed is based on adaptive negative stiffness. This system shifts the yielding away from the main structural system by adding an adaptive negative stiffness device (ANSD). This negative stiffness device can be combined with a viscous damper to create an adaptive negative stiffness system (ANSS). The viscous damper is added to contain the additional deformations caused by the reduced stiffness of the system.

A negative stiffness device (NSD) was developed with the intention of using it to simulate yielding, leading to the concept of apparent weakening, an alternative approach to designing structures with damping systems. The concept of true negative stiffness implies that a force assists motion, not opposes it. The developed device uses a passive mechanical system with various components to generate the negative stiffness. The first component described is a highly compressed machined spring that develops the force in the direction of the motion. The magnitude of the force reduces with increasing displacement to ensure stability of the system at large displacements. A self-containing system is used to resist the preload in the compressed spring. The system contains a negative stiffness magnification mechanism that substantially reduces the requirement for preload to enable that a practical system is achieved. A spring assembly is used to provide positive stiffness up to a predefined displacement. This spring assembly is essential to simulate a bilinear elastic behavior with an apparent-yield displacement which is smaller than the actual yield displacement of the structure. Finally, the last component of the system is viscous damping devices in parallel with the negative stiffness device to reduce displacement demands to within acceptable limits. The NSD is shown schematically in FIG. 3.

Different analytical models of different complexity were developed to predict the behavior of the system. The different factors that were evaluated with the development of the analytical models were the inertia force effects and the rotation of the top lever that is connected to the pre-loaded spring. It was determined that the inertia force effects are of some significance but not important for most practical applications. Similarly, modeling the system without considering the rotation of the top lever is sufficiently accurate for most practical purposes. A model developed with the commercial analysis software SAP2000 was developed using two multilinear elastic elements in parallel, one to represent the negative stiffness assembly and one to represent the spring assembly with bilinear elastic behavior. Results of the SAP2000 model were identical with the results obtained from the analytical models, validating the use of commercial analysis software to represent the developed system.

Shaking Table Tests

The development of shake tables and high-speed data acquisition systems provided a powerful tool for experimental analysis in earthquake engineering. Carrying out shaking table tests on full-scale structures is impractical, resulting in the use of scale models. Scale models should be governed by similitude requirements to properly simulate the behavior of an actual structure.

A testing program that would develop confidence in the ability of small-scale models to replicate structural response to earthquakes was proposed. In order to do this, a well-defined prototype with documented dynamic properties for correlation of model response was necessary. Thus, a three-story, single bay steel frame structure previously tested on the shake table at the University of California, Berkeley was used as a prototype for a 1:6 scale model study. The artificial mass simulation was selected as the modeling method used to simulate all aspects of the prototype structural system which may contribute to the earthquake response characteristics. The artificial mass simulation method involves the addition of structurally uncoupled mass to augment the density of the model structure, permitting the choice of a model structural material without regard for mass density scaling. An accurate simulation of the prototype structure in terms of global and local response parameters was achieved. As part of the conclusions, it was determined that tests of models with artificial mass simulation are suitable for many types of structural systems, particularly those which can be approximated by lumped mass systems (building systems with large floor masses).

A report that summarized part of a four-year study on the feasibility and limitations of small-scale model studies in earthquake engineering was also presented. Attention is set on dynamic modeling theory, a study of the mechanical properties of model materials, suitable model construction techniques and an evaluation of the accuracy of prototype response prediction. The basics of similitude theory and its application to dynamic modeling are reviewed. It was found that the most important aspect of model research is the adequate simulation of material properties. The research demonstrated that model analysis can be used successfully to obtain quantitative information on the seismic behavior of complex structures.

A state-of-the-art report on scale effects in commonly used experimental procedures in earthquake engineering research was also prepared. Only scale effects that occur in models which are made of prototype-like materials were addressed. Deductions made from basic material tests can illustrate the effects of time scaling (strain-rate effects) and length scaling (size effects) on the uniaxial stress-strain diagram and on commonly referenced material parameters. In addition to the effects on the material, distortions in the response of reduced scale models may occur due to a variety of sources. For steel structures and elements, one of the scaling problems discussed is due to fabrication. Scaling problems may occur during element fabrication and element assembly in medium and small-scale elements because they are usually welded together from plate elements, which may cause camber, distortions, and residual stresses. The effects of scaling length and/or time on the behavior of test specimens were evaluated for different experimental methods, such as quasi-static testing, pseudo-dynamic testing and reduced-scale model testing. In the case of reduced-scale model tests, results are affected by scaling of time and size, neglecting the strain-rate effects. It was concluded that the global elastic and inelastic response characteristics of complex structures can be simulated at model scales, even at rather small scales. Small-scale models have the advantage of allowing the testing to failure of complex structural configurations in a controlled laboratory environment and at an affordable cost.

An analytical model developed to study the linear and nonlinear dynamic response of a scaled four-story steel building was also proposed. The purpose of developing such model is because it is generally agreed that a combination of experimental and simulation techniques can be used more completely to explore a full range of behavioral modes. The analytical model was calibrated and validated against the results of an experimental program in which the studied scaled building was subjected to ground motions on a shaking table. A comparison of measured and calculated responses is presented in the paper. The analytical model is then used to predict the building's response if the physical constraints that preclude a shaking table from reproducing historical records with fidelity were eliminated. It was observed that the distortion between the intended and the measured input ground motion had little effect on the relative displacements. It was also seen that excellent agreement in base shear force and overturning-moment time histories was obtained when using both records.

The present invention provides a novel passive response control system developed and integrated to steel building. The inventive response control system utilizes a particular arrangement to connect the building stories with the intention of utilizing their natural motion to modify the building response to ground shaking. The intent of the system is to reduce the accelerations in the building levels caused by the ground shaking. This reduction in the accelerations will translate into lower base reactions of the structure. Since the response control system is a passive one, it has the benefit of not requiring any external power source to operate.

BRIEF DESCRIPTION OF THE DRAWINGS

Further features and advantages of the invention will become apparent from the following detailed description taken in conjunction with the accompanying figures showing illustrative embodiments of the invention, in which:

FIG. 34 shows a graph showing a comparison between rotational deflection and elastic deflection, according to the present invention.

FIG. 37 shows the scale model configurations, according to the present invention.

DETAILED DESCRIPTION OF THE INVENTION

Figure 2:
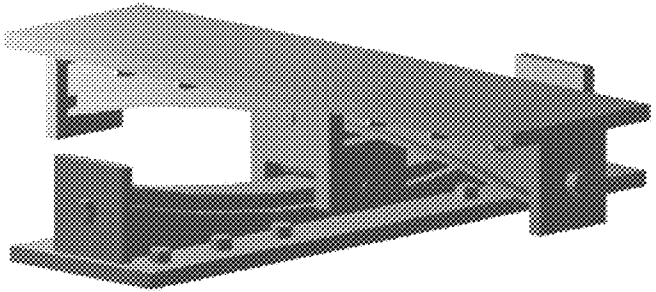
FIG. 2 shows an uplifting-restraining isolator of the prior art
Figure 1:
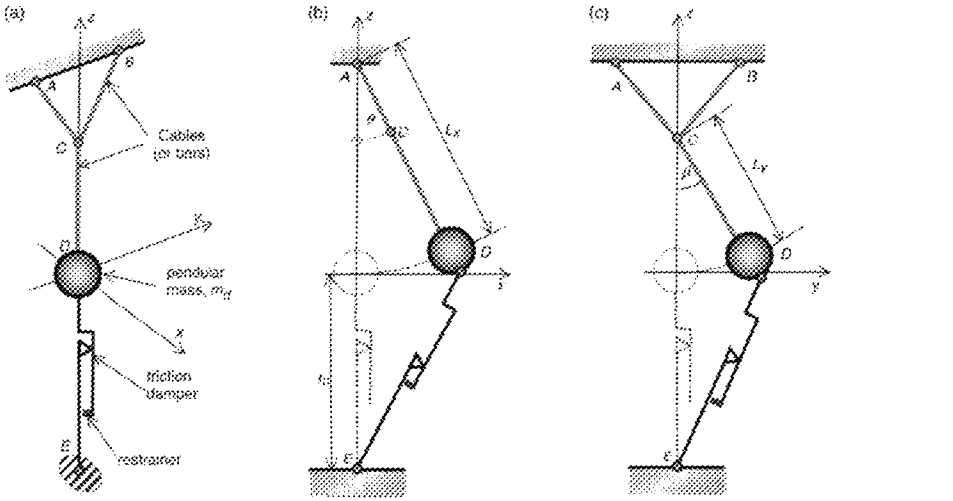
FIG. 1 shows a bidirectional and homogeneous tuned mass damper of the prior art.
Figure 3:
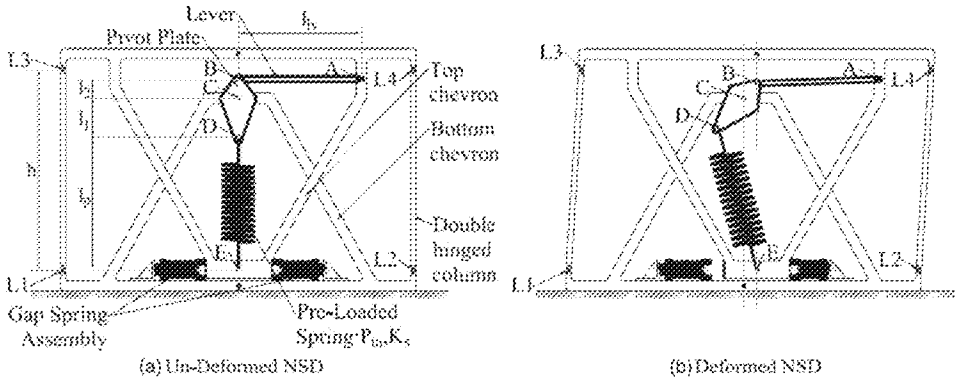
FIG. 3 shows a Negative Stiffness Device of the prior art.

The present invention is based on a scale model of a steel structure prototype. The scale model is used as an implementation of the proposed control arrangement of the present invention. The availability of materials for the construction of the scale model was a major restrictive factor when defining the prototype structure and the consequent scale model. The development of the model was conducted to create a simple small-scale prototype for shaking table tests.

The concepts of similitude theory used to define the scale model are discussed below as well as the prototype structure in which the scale model is based, and construction details and particular characteristics of the scale model are also discussed. Finally, the process of integrating the proposed passive control building arrangement into the scale model is explained.

In order to create a scale model that properly represents the dynamic behavior of a real structure, its definition must be based on modeling theory. Modeling theory establishes the rules according to which the geometry, material properties, initial conditions, boundary conditions and environmental effects (loading) of the model and the prototype have to be related so that the behavior of one can be expressed as a function of the behavior of the other. The theory which leads to the development of a complete set of correlation functions (sometimes referred to as scaling laws) defining the model-prototype correspondence is that of similitude.

All physical quantities can be expressed in terms of basic or fundamental quantities. Considering that these basic quantities are independent of each other, as many scales can be selected arbitrarily as there are basic quantities needed to describe the problem. A dynamic problem can be described by quantities such as mass, length and time; therefore, three arbitrary scales can be selected. In the case of the invention's particular model, different arbitrary scales were selected to account for specific needs. The size of the model needs to be reduced from that of the prototype, therefore requiring a length scale $l_r$ to be defined ($l_r=l_p/l_m$). The gravitational effects on the model cannot be controlled and will be the same as in the prototype; therefore, an acceleration scale $a_r$ equal to one is selected ($a_r=a_p/a_m=1$). A third aspect that needs to be addressed is the material used in the construction of the prototype and the model, specifically the modulus of elasticity of the materials. A scale Er to address the aspect of the modulus of elasticity is set ($E_r=E_p/E_m$). According to the present invention, the prototype structure is a steel building. If steel is also used in the model, the scale for the modulus of elasticity is set to 1. After setting these three similitude relationships, all the remaining similitude requirements can be derived from dimensional analysis.

Several important relationships for similitude requirements are presented in Table 1 below. It can be seen that the scale for the acceleration is always 1, since the gravity effects will be the same in the prototype and the model. The third column of the table presents the similitude relationships when the materials used in the prototype and the model are not necessarily the same. The fourth column presents the similitude relationships when the prototype and model share the same material and acceleration, as is the case according to the invention. Finally, the fifth column presents the similitude relationships when the three arbitrary scales selected (material, acceleration and length) are defined. A length scale of 1/20 is the one defined for the construction of the model.

TABLE 1

| Parameter | Units | Any Material | Same Material and Acceleration | Same Material and Acceleration (1/20 Model) |
|---|---|---|---|---|
| Length, L | L | $l_r$ | $l_r$ | 20 |
| Modulus of Elasticity, E | $\frac{F}{L^2}$ | $E_r$ | 1 | 1 |
| Acceleration, a | $\frac{T}{L^2}$ | 1 | 1 | 1 |
| Density, ρ | $\frac{F \cdot T^2}{L^4}$ | $\frac{E_r}{l_r a_r}$ | $\frac{1}{l_r}$ | 0.05 |
| Time, t | T | $l_r^{1/2}$ | $l_r^{1/2}$ | $\sqrt{20} = 4.47$ |
| Frequency, ω | $\frac{1}{T}$ | $l_r^{-1/2}$ | $l_r^{-1/2}$ | $\frac{1}{\sqrt{20}} = 0.223$ |
| Force, F | F | $E_r l_r^2$ | $l_r^2$ | 400 |
| Mass, m | $\frac{F \cdot T^2}{L}$ | $E_r l_r^2$ | $l_r^2$ | 400 |
| Strain | $\frac{L}{L}$ | 1 | 1 | 1 |
| Stress | $\frac{F}{L^2}$ | $E_r$ | 1 | 1 |
| Energy | F · L | $E_r l_r^3$ | $l_r^3$ | 8000 |

A true replica model requires a material whose specific stiffness E/ρ follows the same scaling law as the length dimension. Since for most practical purposes such materials cannot be found, true replica models have few applications in seismic testing of structures. Whenever possible, structural models are made of prototype or prototype-like material in order to minimize distortions of the basic material properties. This led to the use of the same material in the prototype and the model according to the present invention.

Mass similitude of the model must be satisfied for proper modeling of the dynamic behavior. Using the constant acceleration scaling and same material for the model, an additional mass must be applied to the model to compensate for the difference in the required and provided material densities.

The mass, m, is defined as the product of the material density, p, and material volume, V. Since the scaling factor for material volume is $l_r^3$, the required and provided masses of the model are defined as:

$$m_m^{req} = m_p \cdot \frac{1}{l_r^2} \quad \text{Eq. 1}$$

$$m_m^{prov} = m_p \cdot \frac{1}{l_r^3} \quad \text{Eq. 2}$$

where: $m_m^{req}$=required mass of the model; $m_m^{prov}$=provided mass of the model and $m_p$=mass of the prototype.

The difference in material density properties causes the provided mass to be less than required for similitude. An additional mass Δm must be provided to the model as follows:

$$\Delta m = m_p \cdot \left(\frac{1}{l_r^2} - \frac{1}{l_r^3}\right) \quad \text{Eq. 3}$$

Based on the length scale of 1/20 used in the model, the additional mass Δm that must be provided is 19/8000 of the prototype total mass. Considering that the scaling factor for required gravity acceleration is 1, the additional weight required in the model is:

$$\Delta W_m = \frac{19}{8000} W_p \cdot \frac{19}{8000} l_r^3 W_m^{prov} = 19 W_m^{prov} \quad \text{Eq. 4}$$

A different way to determine the required mass of the model to satisfy similitude is through the gravitational force. The required weight of the model, $W_m^{req}$, is defined in terms of the gravitational force of the prototype and the appropriate scale factor in the following manner:

$$W_m^{req} = W_p \cdot \frac{1}{l_r^2} = \frac{1}{400} W_p \quad \text{Eq. 5}$$

where: $W_p$=gravitational force of the prototype structure and $l_r$=geometric length scale factor.

This approach was the one used to determine the mass similitude requirements of the scale model. The total weight of the prototype was established in order to determine the required weight of the model.

Prototype Definition

The main concern when defining the prototype structure was that it should be representative of an industrial steel building but should make the integration of the proposed building arrangement feasible. Since the present invention is directed to the concept of the passive control building arrangement, it was decided that the building arrangement should be tested in its simplest form possible. A three-level structure was selected for the prototype because this number of levels allowed the arrangement to work properly while also being simple enough to be studied and monitored. It was also decided that conducting the tests in a single bay structure allowed the arrangement to be kept as simple as possible. The definition of the prototype was simultaneously limited by the constraints the available shaking table imposed on the resulting scale model and the available materials in the Structures Laboratory. In order to take advantage of the available materials and the space in the shaking table platform available in the laboratory, a square configuration was selected for the floor plan of all levels of the prototype.

Figure 4A:
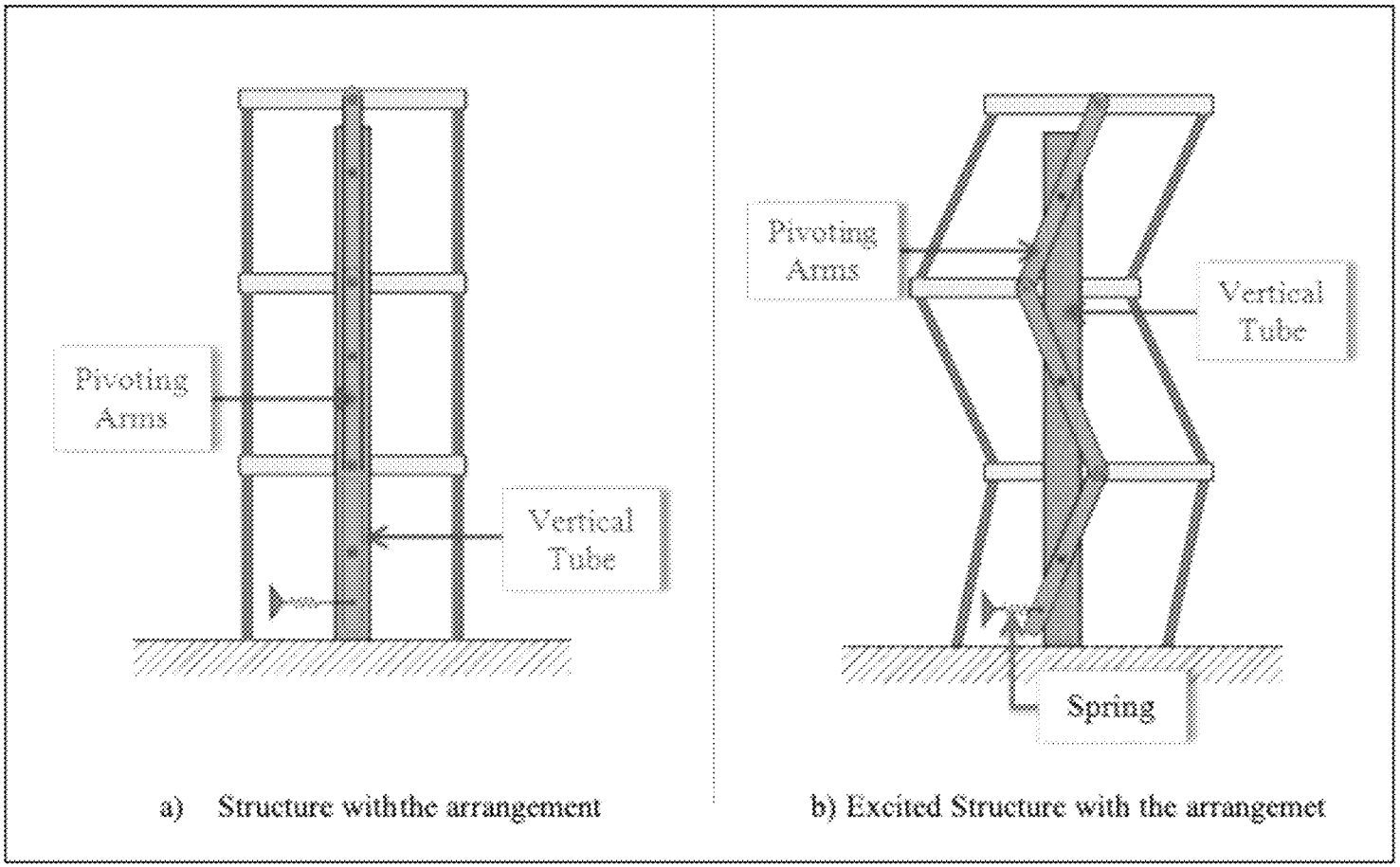
FIG. 4*a* shows a structure with the control arrangement, according to the present invention.
Figure 4B:
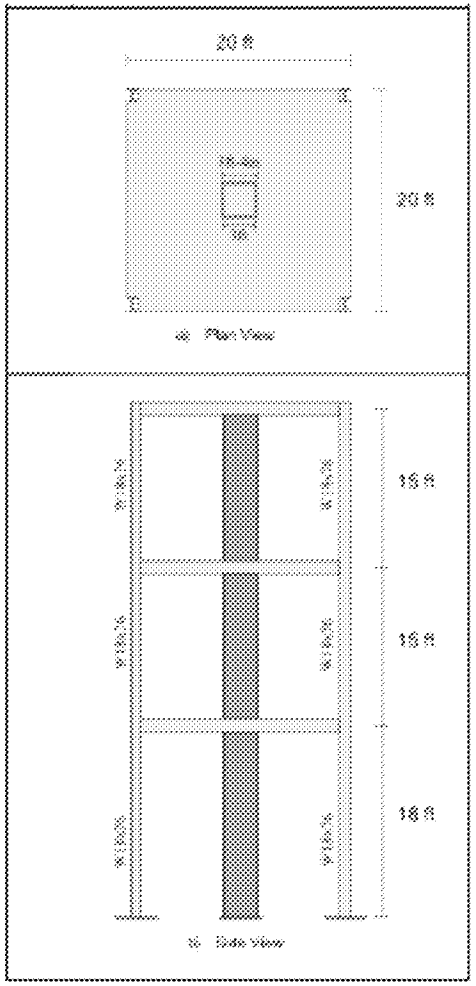
FIG. 4*b* shows a general layout of the prototype system, according to the present invention.

The process of defining the prototype was an iterative process that depended on the resulting scale model viability for construction. The resulting scale model had to meet some requirements. First, the dimensions and the consequential weight should meet the available shaking table physical constraints. Second, the scale model dimensions had to be suitable for construction with the available materials in the Structures Laboratory. Finally, the scale model dimensions and weight had to be manageable by a single person without the use of any lifting or transportation machinery. After an exhaustive process looking for the ideal combination of prototype dimensions, scaling relationship and resulting model, it was decided that a 1/20 scale was the more convenient alternative. The preliminary defined prototype layout is illustrated in FIG. 4*a* and FIG. 4*b*. The bay dimensions are 20 ft×20 ft. The story height for the first level is 18 ft, whereas for the second and third level it is 15 ft. The first level height was selected to be different because it is a popular practice in typical construction, and it has the added benefit of providing additional working space in the base of the resulting scale model.

The passive control building arrangement of the present invention is based on a mechanism in which individual elements connect adjacent stories. An element connects the first level with the second level, while a different element connects the second level with the third level. Three individual elements can be seen connecting the three stories. These three elements are known as pivoting arms. Between levels, these pivoting arms are pinned to a rigid vertical member. The vertical member must be considerably more rigid than the overall structure so the pin connection in every pivoting arm creates a steady axis of rotation between levels. The creation of the axis of rotation causes adjacent stories to pivot around it, resembling the third mode of vibration of a conventional building. When the building is excited, one level moves in one direction while the connected level will be forced to move in the opposite direction. A spring is connected to the lower part of the pivoting arm between the first level and the base of the building. This spring provides a restoring force to return the building to its neutral position when it suffers deformations. Modifications in the stiffness value of this spring are expected to modify the behavior of the control arrangement.

When selecting the weight of the prototype, it was intended to provide the lightest weight possible but was still representative of a real structure. It was opted to select a floor system with a unit weight of 36 lbs/ft$^2$. The selection of the unit weight was based on information provided in a steel roof and floor deck catalog from the VULCRAFT® steel products company. The catalog presented a series of composite steel floor decks, and it was observed that systems with a unit weight around 36 lbs/ft$^2$ were common. Based in this unit weight and taking into account the defined floor dimensions of 20 ft×20 ft, every floor of the prototype has a weight of 14.4 kips. Considering that the invention proposes a control arrangement, exceptions were made when complying with weight similitude requirements. One key exception is that the weight of the prototype columns was not considered. Therefore, the similitude requirements should comply with the determined weight of 14.4 kips per level of the prototype. As seen in Table 2 below, the required weight per floor for the scale model would result in 36 lbs.

TABLE 2

| Level | Prototype Weight (kips) | Model Weight (lbs) |
|---|---|---|
| Third | 14.4 | 36 |
| Second | 14.4 | 36 |
| First | 14.4 | 36 |
| Total | 43.2 | 108 |

The selection of the prototype columns was based on factors that were not related to weight issues. As it will be further discussed, the factor affecting the selection of the columns was the moment of inertia. The selection of the standard shape W10×77 is strongly correlated to the scale model construction. It is also noted that a vertical core is provided in the center of the prototype structure. This vertical core is essential for the integration of the proposed control arrangement. In this prototype structure it is defined as a square steel section of 3'4" wide with a thickness of 2". In a real building, vertical cores like this are not typically made of steel. Any vertical core that provides a similar rigidity is suitable for the implementation of the proposed control arrangement.

Model Definition and Construction

The primary objective of the scale model is to integrate the proposed passive control building arrangement. This implies that while satisfying the similitude requirements between the prototype and the model is important, defining a model that provides for the integration of the control arrangement is essential. Several decisions in the design and construction of the model were made taking this into account. Additionally, the available materials imposed another restraint when defining the model. The developed scale model is expected to be used for future research in uni-directional shaking table tests to study its behavior along its weak direction. To prevent rotational instability when such tests are performed, it was decided that connecting the stories with elements resembling columns was not the best option. Instead, steel plates were selected as the elements to connect the levels. Steel plates have the benefit of being able to resemble the behavior of the prototype columns along their weak direction, while providing stability to eliminate any possible rotation in the model. Although the prototype is defined with four columns per level, the scale model is composed of two plates per level, where the two vertical plates can be seen in FIG. 5.

Since the major aspect of the columns that affect the response of the model is the moment of inertia, this was the governing factor when pursuing for similitude between the prototype columns and the model steel plates. Due to the fact that each steel plate of the model would resemble two columns of the prototype, the combined moment of inertia of two prototype columns should meet similitude requirements with one steel plate of the model. The required and provided moment of inertia for the columns of the model is presented in Table 3 below. When the moment of inertia of a W10×77 prototype column is scaled, it requires the model to have a column with a moment of inertia of 0.00096 $in^4$. Because the steel plates used in the model represent two columns instead of one, the required moment of inertia for the plates is 0.00192" $in^4$. The steel plates used in the model adequately provide a moment of inertia of 0.00195" $in^4$, therefore fulfilling similitude requirements. It can be noted that for the cross-sectional area the similitude requirements are not fully satisfied. The response of the model is more influenced by the moment of inertia of the columns than by its geometry or area, and therefore these parameters can be varied.

TABLE 3

| Attribute Shape | Prototype Columns W10x77 | Scale Model Columns: Required 2 columns | Scale Model Columns: Provided 12" X⅛" plate |
|---|---|---|---|
| Inertia ($in^4$) | 154 | 0.00192 | 0.00195 |
| Area ($in^2$) | 22.6 | 0.113 | 1.50 |

Figure 7:
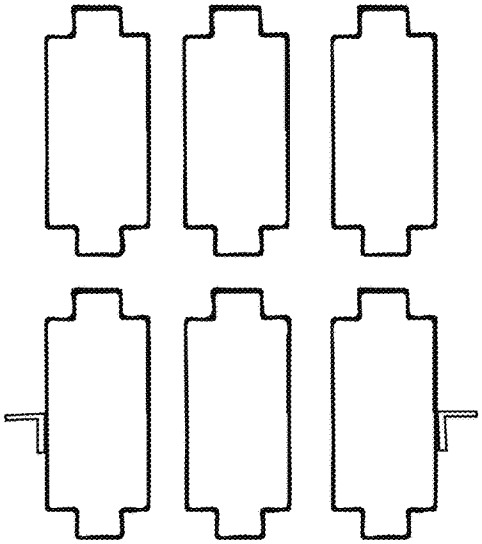
FIG. 7 shows a photo of the steel plates used as masses, according to the present invention.
Figure 6:
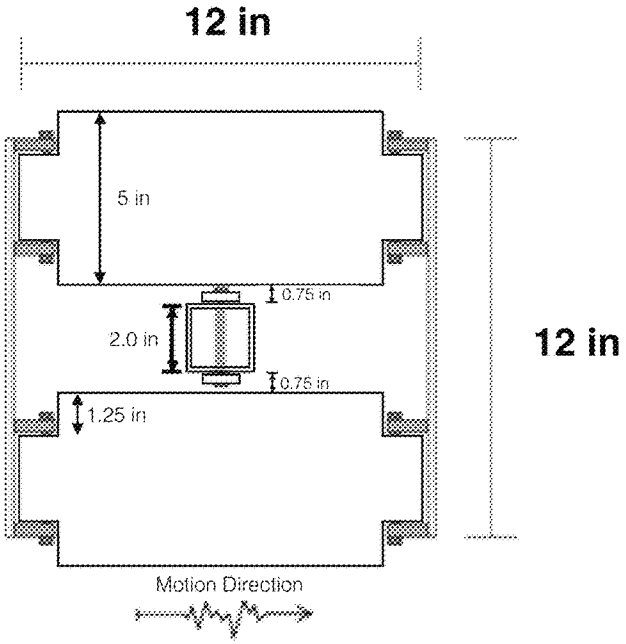
FIG. 6 shows a plan layout of the scaled model, according to the present invention.

The plan layout of the scale model is presented in FIG. 6. The integration of the proposed building arrangement had to be taken into account when defining the plan layout. The proposed building arrangement requires a vertical member tall enough to be linked with the pivoting arms. A 2"×2" square tube was selected as the vertical member. The height of the vertical member implies that the stories had to leave free space in the center to accommodate the vertical tube. After considering different options with the available materials, it was determined that 1" thick steel plates with dimensions of 12" long and 10" wide can represent the levels masses. In order to leave space in the center for the vertical tube, each plate was divided in two pieces 12" long and 5" wide. As seen in the plan layout, every level had two of these 12"×5"×1" steel plates that were actually resembling the mass of one story. A gap of 3.5" was left between the two plates to accommodate the vertical tube. This gap between the plates caused a protrusion of ¾" out of the vertical walls steel plates. It was needed to cut 1¼ inch from the exterior borders of the plates to connect them to the vertical walls. The same cut was made in the interior of the plates to maintain the symmetry of the plates. A black and white picture of the six actual plates used in the scale model is presented in FIG. 7. The mass steel plates are connected to the vertical walls with pin connections.

The weight provided by the model is summarized in Table 4 below. The required weight considers only the weight of the prototype floor system. The weight of the columns was not considered. If the weight of the columns was considered, additional weight must have been added to the model. It was opted not to do this because weight was an issue when complying with the limitations of the available shaking table.

TABLE 4

| Level | Required Weight (lbs) | Provided Weight (lbs) | Difference Percentage |
|---|---|---|---|
| First | 36.0 | 34.00 | 5.5% |
| Second | 36.0 | 34.00 | 5.5% |
| Third | 36.0 | 34.00 | 5.5% |

Figure 5:
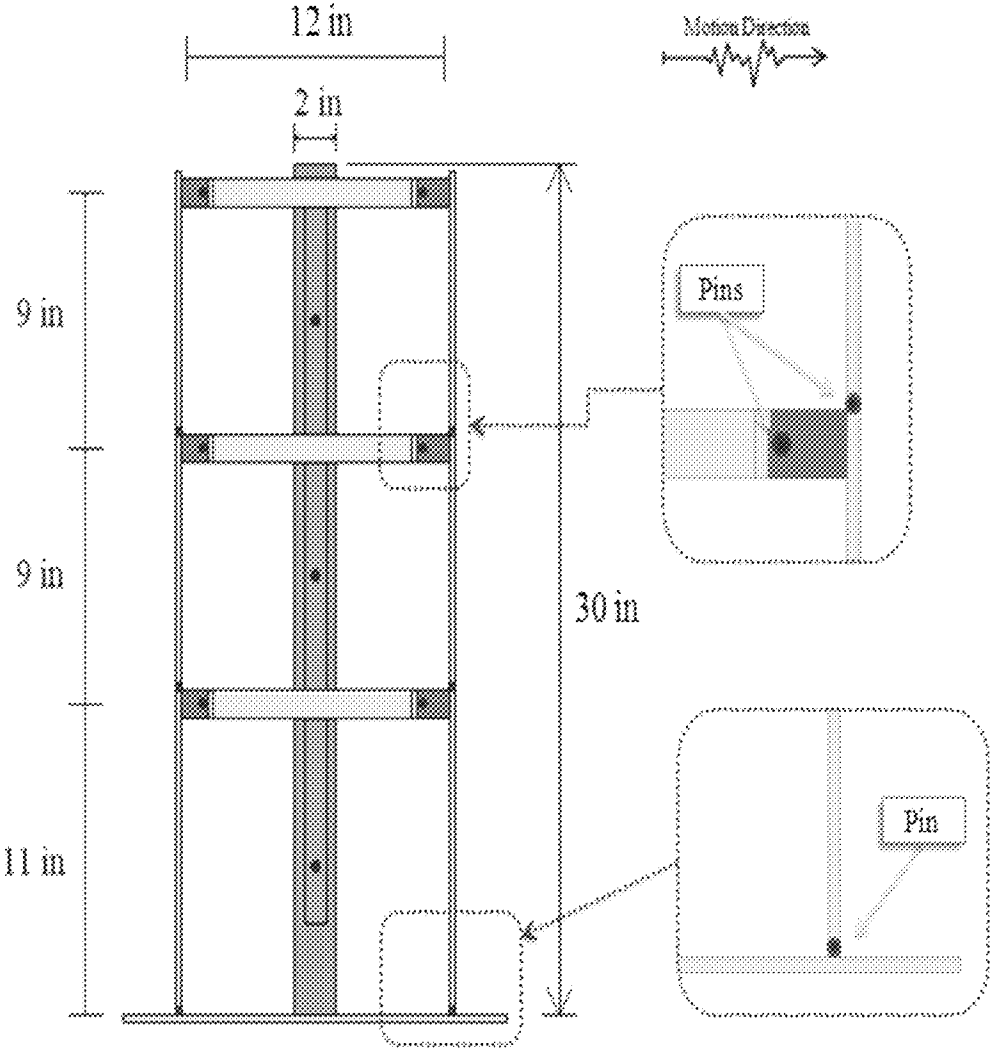
FIG. 5 shows a front view layout of the scaled model, according to the present invention.

A front view of the model showing its elevations is presented in FIG. 5. The definition of the elevations of the scale model was based in similitude requirements. The bays dimension is 12 inches long. The first level has a height of 11 inches, while the second and third level have elevations of 20 inches and 29 inches, respectively. The figure also shows all the pin connections in the walls and floors of the model. Pins are present in the base of the vertical walls and throughout their length. These pins are part of the integration of the control arrangement and will be further discussed below.

Integration of the Passive Control Building Arrangement

One of the main features of present invention is to integrate the proposed building arrangement to the scale model. This prompted special considerations when constructing the model. Particularly, additional tasks were executed to integrate the essential components of the arrangement, which are the elements that connect adjacent stories (denominated pivoting arms) and the vertical rigid member to which these arms are connected.

Figure 8:
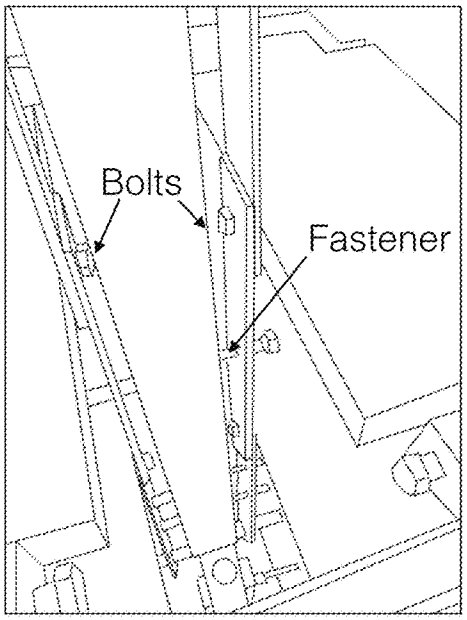
FIG. 8 shows the pivoting arms connections, according to the present invention.

A HSS 2×2×3/32 square steel tube with a height of 30 inches was selected to be used as the vertical member. The tube is placed in the center of the model and is connected to the base with a fixed connection. The required pivoting arms that connect adjacent stories are 1½ in wide steel plates with a thickness of ⅛ in. Since the stories masses have been divided into two plates per level, a pair of elements is needed per level. As seen in FIG. 6 and FIG. 8, the pivoting arms are pinned to the stories plates on the center of the inside face. The arms are also pinned between stories to the vertical steel tube. There is an additional pair of pivoting arms that is connected to the first level and is also pinned to the vertical steel tube between the first level and the base of the model.

Figure 9:
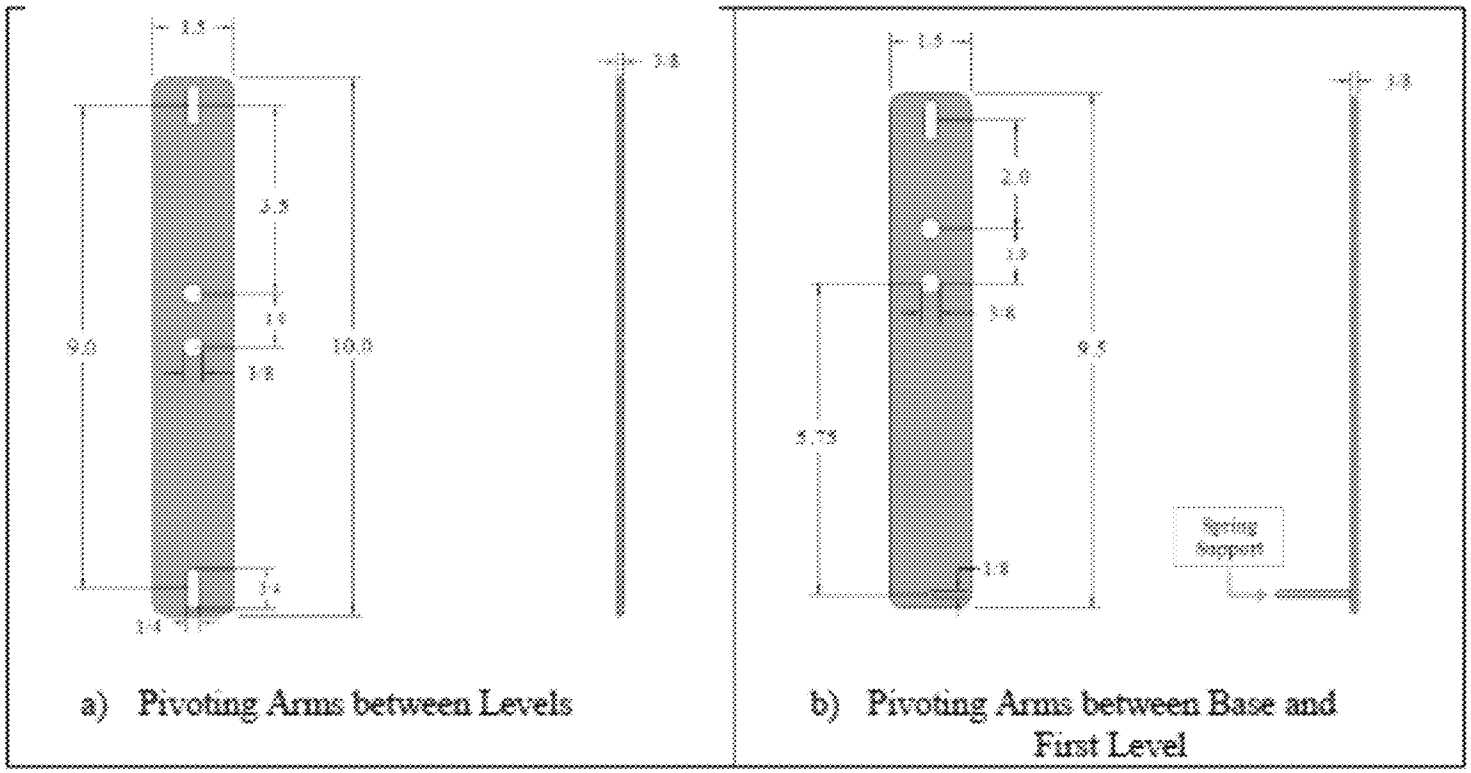
FIG. 9 shows a pivoting arms layout, according to the present invention.

The layout of the pivoting arms between the third, second and first levels is presented in FIG. 9. These arms are connected by its ends to adjacent stories. The connection between the arms and the stories plates is a particular one because it transmits forces in the horizontal direction only. This happens because the bolts that connect the pivoting arms and the mass plates can move freely in elongated slots that were cut into the arms. As seen in FIG. 9, these slots have three quarters of an inch in longitude and are ¼" width. The slots were incorporated to the swinging arms to facilitate the horizontal movement of the levels and prevent the model from getting stuck up. The other two circular holes in the middle section of the arm are used to connect the arms with the vertical tube. This hole is expected to prevent movements in the horizontal and vertical direction but allow the arm to rotate freely. Although two circular holes are presented in the layout, only one hole is used at a time to connect the arm to the vertical tube. The reason for having two different holes is that it provides the option of moving the fastener position and change the geometric configuration of the arrangement. A black and white picture of the actual pivoting arms connected to the vertical tube is presented in FIG. 8. This picture shows bolts connecting the pivoting arms to the stories plates and one long fastener connecting both pivoting arms to the vertical tube.

The pair of pivoting arms between the base and the first level has a different layout than the other two pairs of arms. Two circular holes are also provided to connect the arms to the vertical tube, but the lower end of the arm is totally different. The reason for the difference is that these arms are connected in the lower end to springs instead of another level. For that reason, a circular rod of ⅛" is provided to support the springs. The springs that will be connected to the lower part of the pivoting arms must also be supported at the other end. The way in which the spring is supported at both ends is presented in FIG. 10. It can be observed that the pivoting arm has two springs attached. Each of these springs is connected at the other end to a rod fixed to the base of the model.

Figure 10:
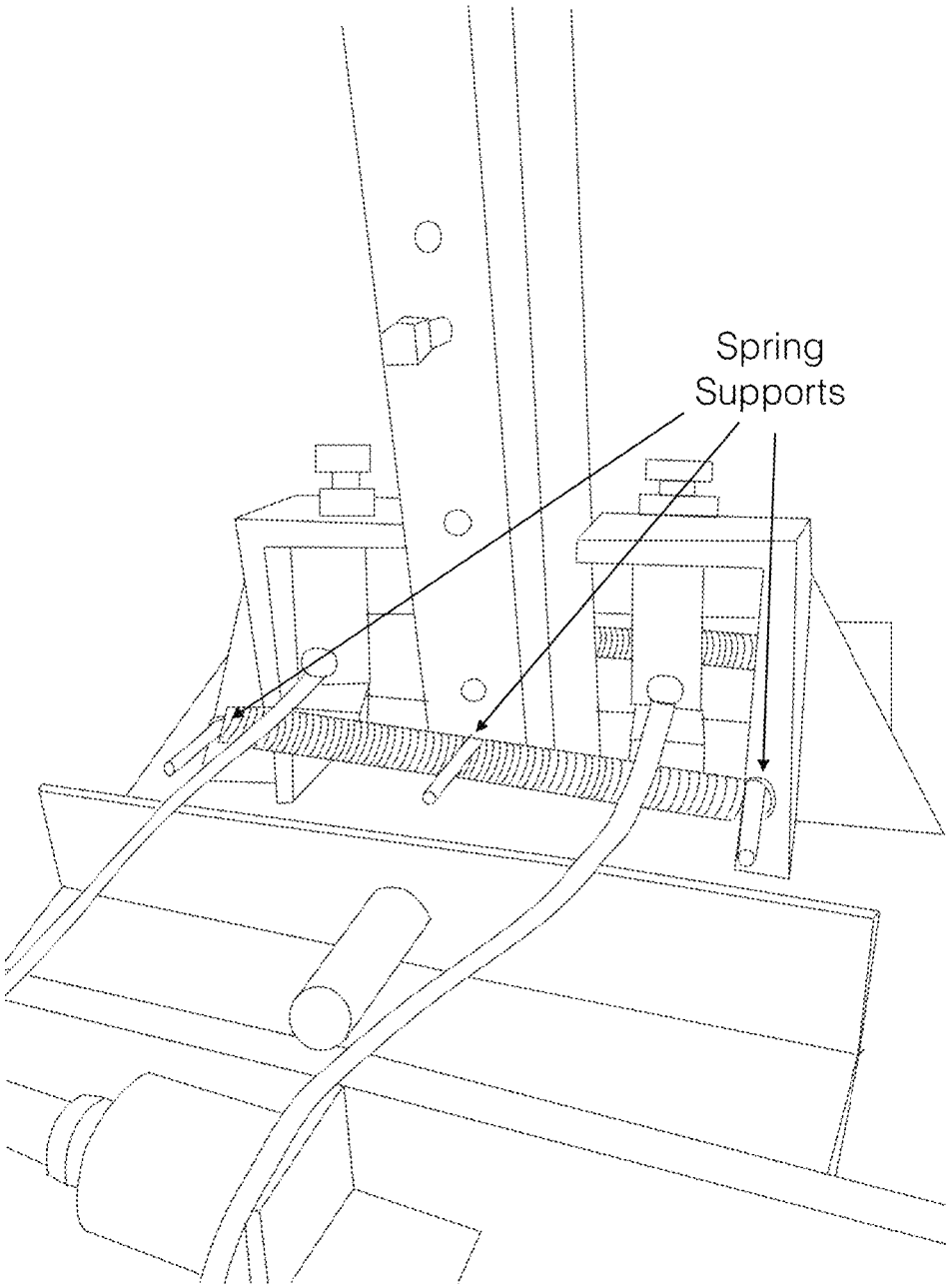
FIG. 10 shows the springs connection to the pivoting arm, according to the present invention.
Figure 12:
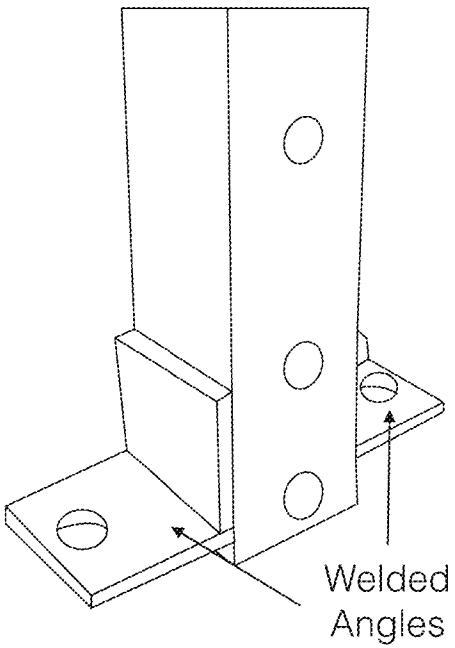
FIG. 12 shows angles welded to the vertical tube, according to the present invention.
Figure 11:
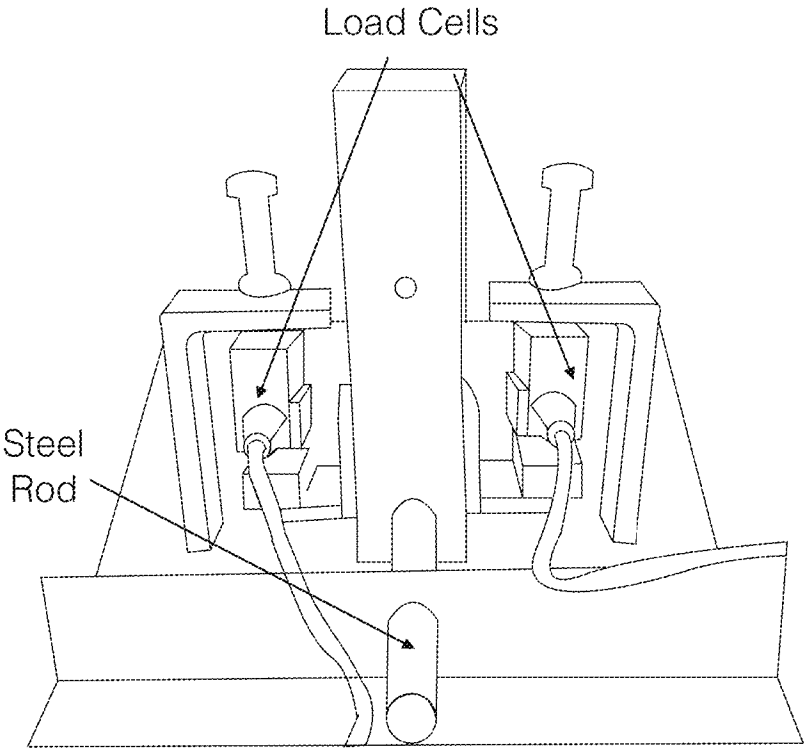
FIG. 11 shows the fixed connection using load cells, according to the present invention.

The black and white picture shown in FIG. 10 also shows two load cells connected to the base of the model and the vertical tube in a particular fashion. If shaking table tests are made to the model, these load cells can measure the moment transferred to the base of the vertical tube. Since load cells measure axial loads, a particular layout was constructed that allows the load readings to be converted to moment. The layout can be better appreciated in FIG. 11. The vertical square tube is connected to a steel rod, resembling a pin connection. If the two load cells are not connected, the vertical tube can rotate freely around the steel rod. The vertical element requires a fixed connection at the base that restrains rotation to fulfill its function. This is made by welding two angles (FIG. 12) to the side of the tube that are then connected to the two load cells, which are also connected to the base of the model. The two load cells create a force couple that fixes the tube, preventing any rotation. Since the load cells measure the load they are experiencing when creating the force couple, they can measure the moment that is transferred to the base.

Figure 14:
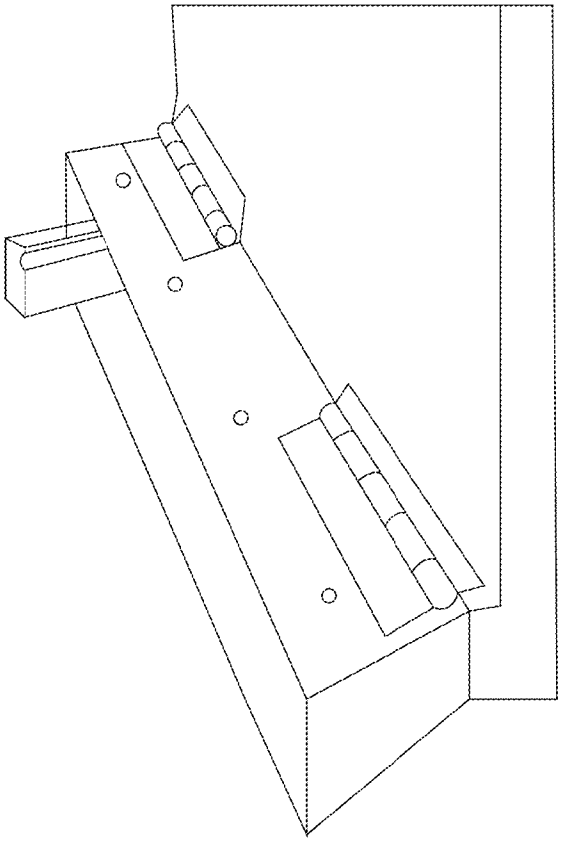
FIG. 14 shows the connection between the vertical walls and the base, according to the present invention.
Figure 13:
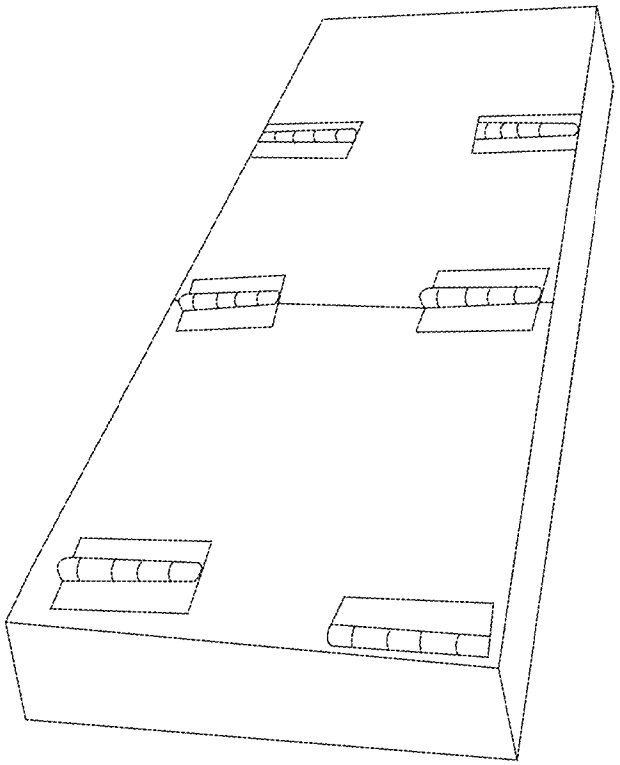
FIG. 13 shows the connection of hinges to the vertical walls, according to the present invention.
Figure 16:
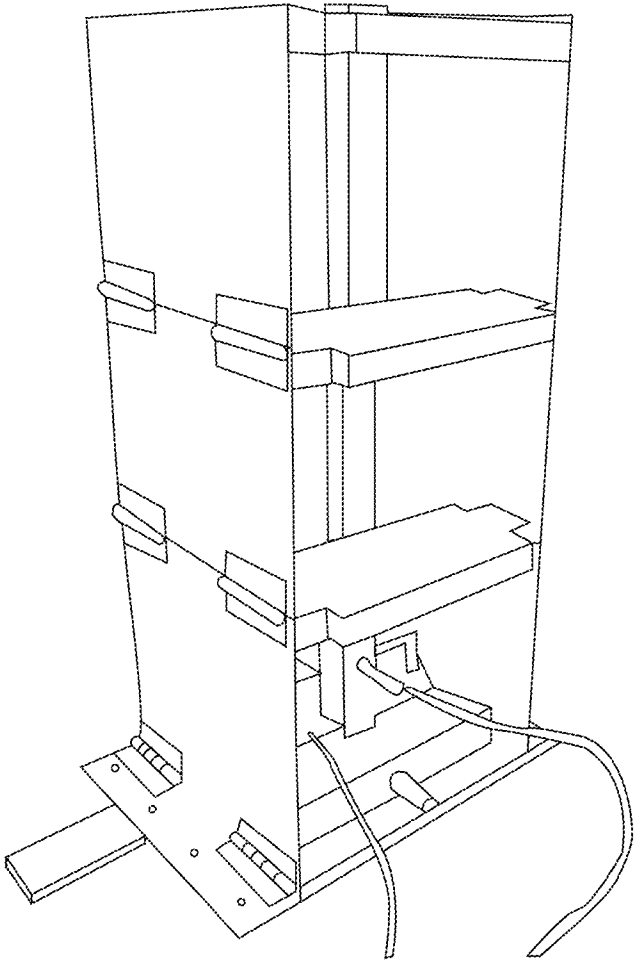
FIG. 16 shows an isometric view of constructed scale model, according to the present invention.
Figure 15:
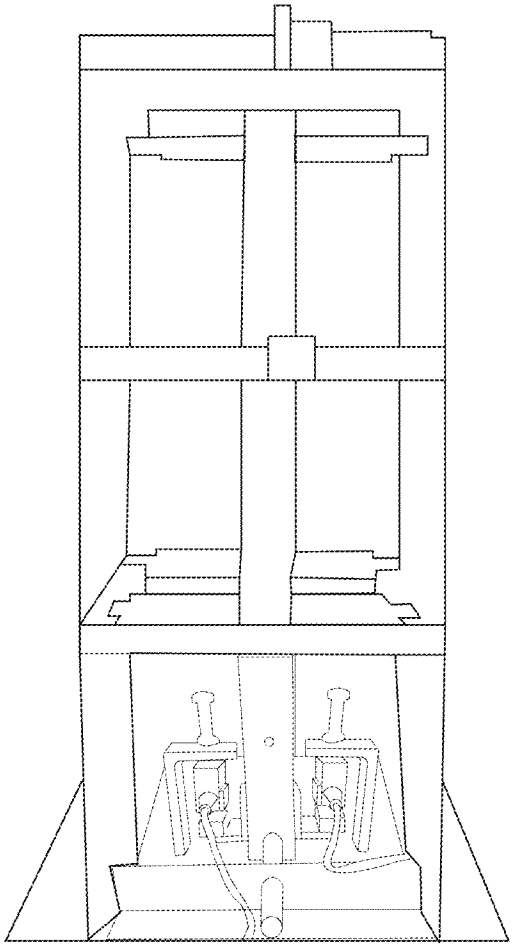
FIG. 15 shows a front view of the constructed scale model, according to the present invention.

It was previously explained that the vertical walls were not continuous throughout their length. The walls have pins at their base and at the height of the stories. These pins would articulate the walls at the same height of the floors and would prevent the wall from resisting lateral movements at these joints. This is a fundamental modification that was necessary to integrate the control arrangement. These pins throughout the height of the wall were constructed in the laboratory with door hinges. The wall plates were cut through their length and door hinges were welded to the wall sections next to each other. The walls were also connected to the base of the model with welded door hinges. A black and white picture of the retrofitting process of the door hinges to the vertical walls is presented in FIG. 13. The hinges connecting the walls and the base are presented in FIG. 14. Additional black and white pictures of the constructed scale model are presented in FIG. 15 and FIG. 16.

Load Path Distribution of Control Arrangement

Figure 17:
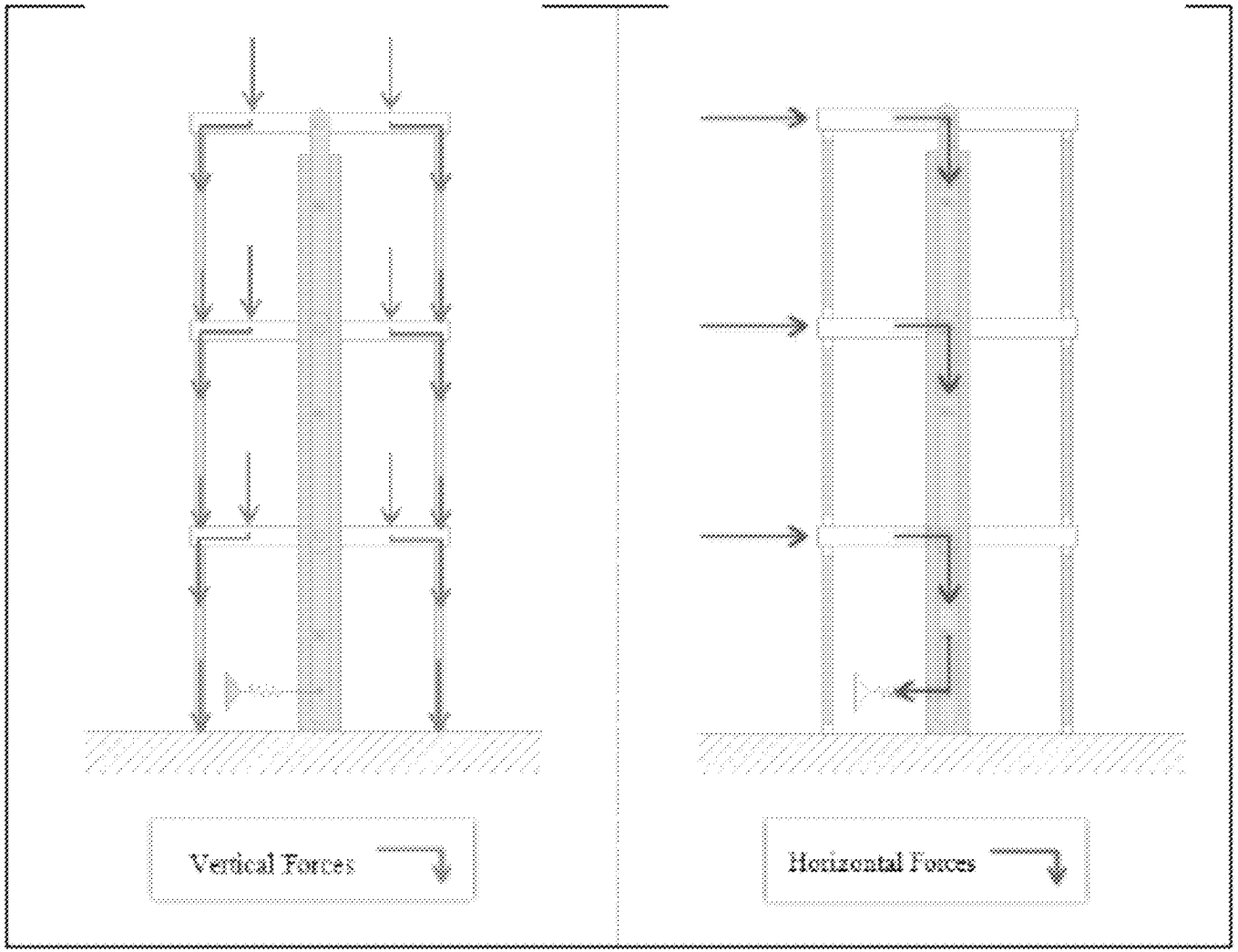
FIG. 17 shows a schematic diagram of the forces distribution, according to the present invention.

The modifications necessary to incorporate the control arrangement changes completely the manner in which the loads are transferred throughout the structure. Aspects like the presence of hinges in the vertical walls and the pivoting arms modify completely the manner in which the lateral loads are transferred. A schematic diagram showing the loading paths of the model is presented in FIG. 17.

The slots incorporated at the ends of the pivoting arms allow vertical translation, thus incapacitating the arms from transmitting vertical loads. Therefore, the vertical loads are completely transferred throughout the vertical walls until reaching the base. However, the incorporation of the hinges into the vertical walls prevents the transfer of horizontal loads. Consequently, the horizontal loads are transferred only through the pivoting arms. The pivoting arms continue to transfer the horizontal loads up to the spring connected to the base of the model. Horizontal reactions are created in the vertical tube at the positions of the fasteners that are connected to the pivoting arms.

Minimum Spring Stiffness to Maintain Equilibrium

Figure 18:
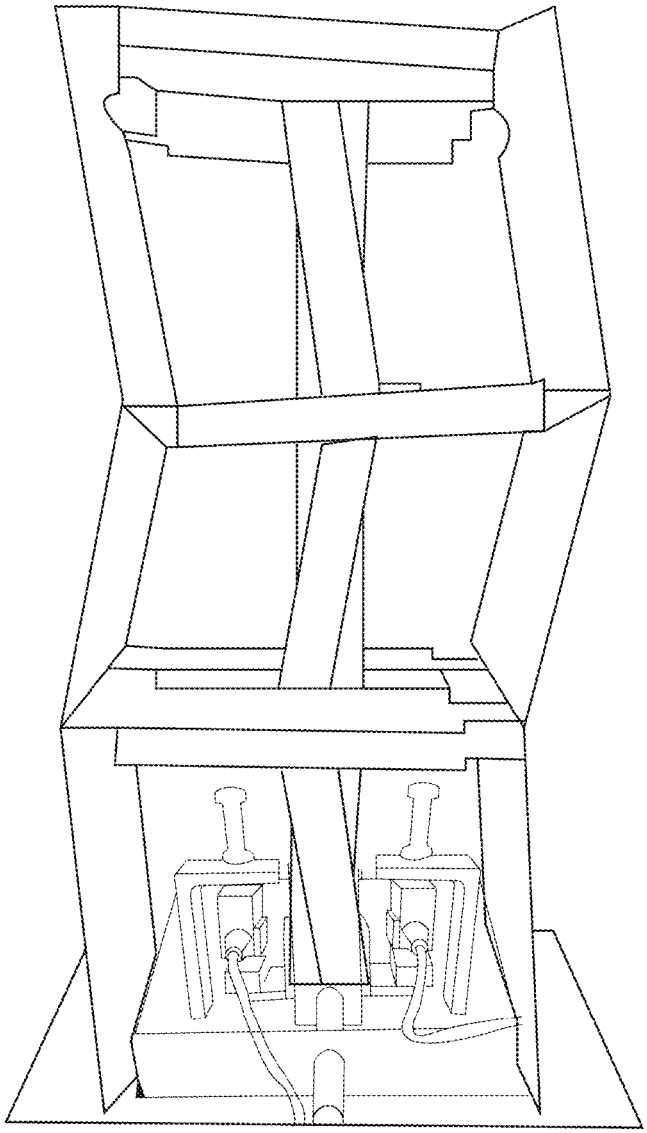
FIG. 18 shows the unstable condition of model, according to the present invention.

During the process of assembling the scale model with the control arrangement, it was observed that not every spring could maintain the building in its equilibrium position. When springs with lower stiffness were used, the building would move away from its equilibrium position and continue to do so until it reached a displacement limit imposed by any of the pivoting arms. An example of this condition is presented in FIG. 18. In contrast, the building would not depart away from its equilibrium position when springs with higher stiffness were used. Also, if the building was forced out of its equilibrium position, it would easily return to back. This behavior led to formulating a hypothesis that a minimum value for spring stiffness would be required to prevent the building from falling away out of its equilibrium position. Based on engineering mechanics, a derivation was made to prove the hypothesis and calculate theoretically the minimum required spring stiffness to maintain equilibrium in the model.

Figure 19:
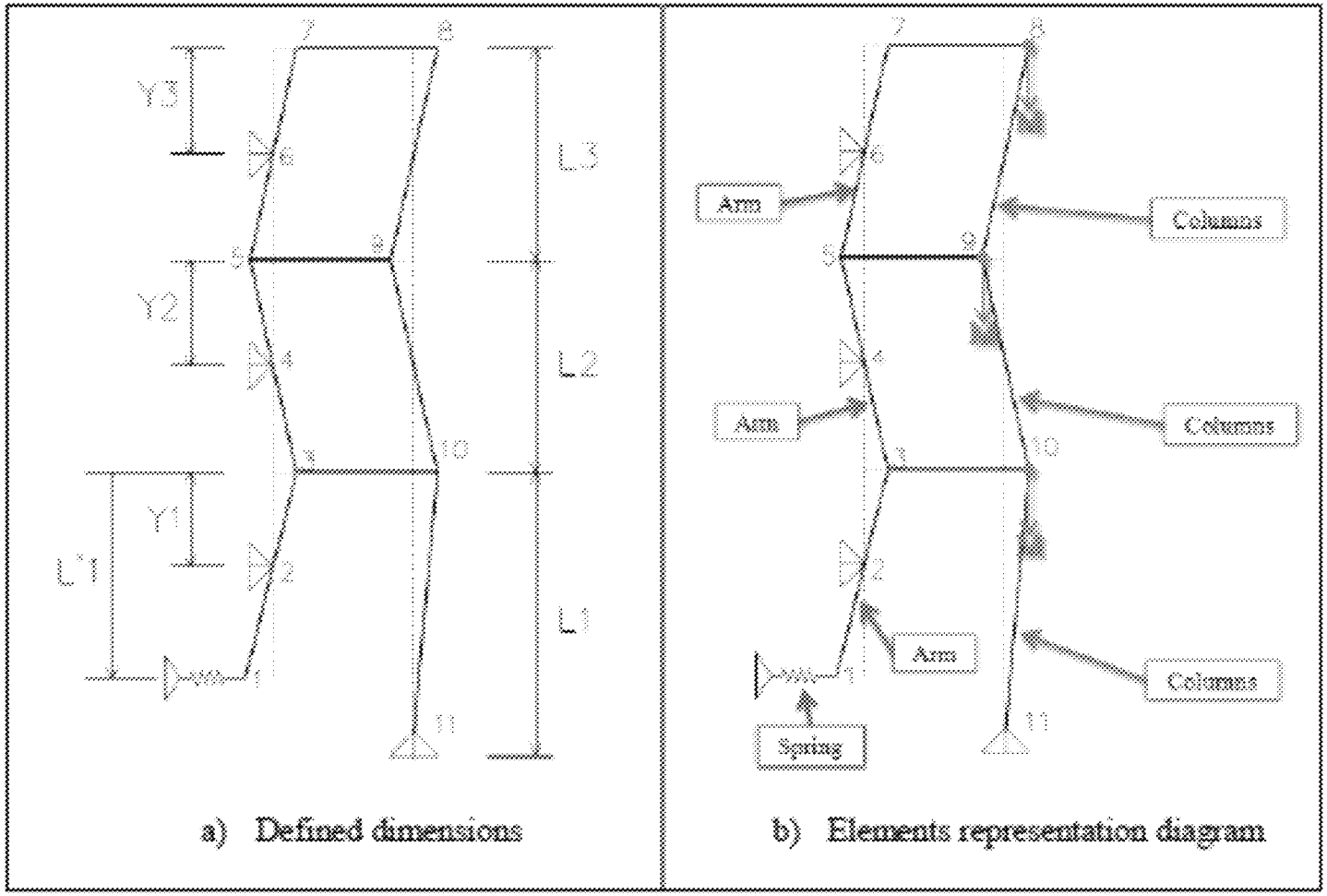
FIG. 19 shows a free-body diagram for minimum spring stiffness computation, according to the present invention.

A free-body diagram of the model which was used for the derivation is presented in FIG. 19. The free body diagram represents the building when it is out of its equilibrium position. The illustration does not graphically depict the scale model in an identical manner because a series of assumptions were made to simplify the derivation. The first assumption is that both columns (also referred to as walls) of every level can be represented by a single element, with the masses of the levels concentrated at the end joints. This can be observed at the right side of FIG. 19, which shows three columns with concentrated weights at joints 8, 9 and 10. As illustrated, the elements between the aforementioned joints represent the columns for each level. The elements between joints 1-3, 3-5 and 5-7 represent the pivoting arms of the control arrangement and are properly identified in the figure. In the physical scale model, the columns and the pivoting arms are connected via the plates and bolts at each level. As seen in the free body diagram, it was assumed that these sections are connected via horizontal elements that do not represent any particular section of the model. The only purpose of these horizontal elements is to transmit horizontal reactions between the ends of the pivoting arms and the columns. The last made assumption establishes that the vertical tube is completely rigid and does not suffer any axial deformation or lateral deflection. Based on this assumption, the connection between the pivotal arms and the vertical tube can be represented with pin supports. As shown, the arms are restrained in the middle section by pin supports.

The mechanics of the model can be discerned by examining the free-body diagrams. The concentrated weights at the column sections cause eccentric forces that destabilize the model out of its equilibrium position. These destabilizing forces can be counteracted by horizontal forces transmitted through the horizontal elements connected to the pivoting arms. The only way that the pivoting arms can create the required counteracting forces is through their connection to the spring in joint 1. Based on this reasoning, it was decided to start the derivation by calculating the destabilizing forces created in the column elements.

Figure 20:
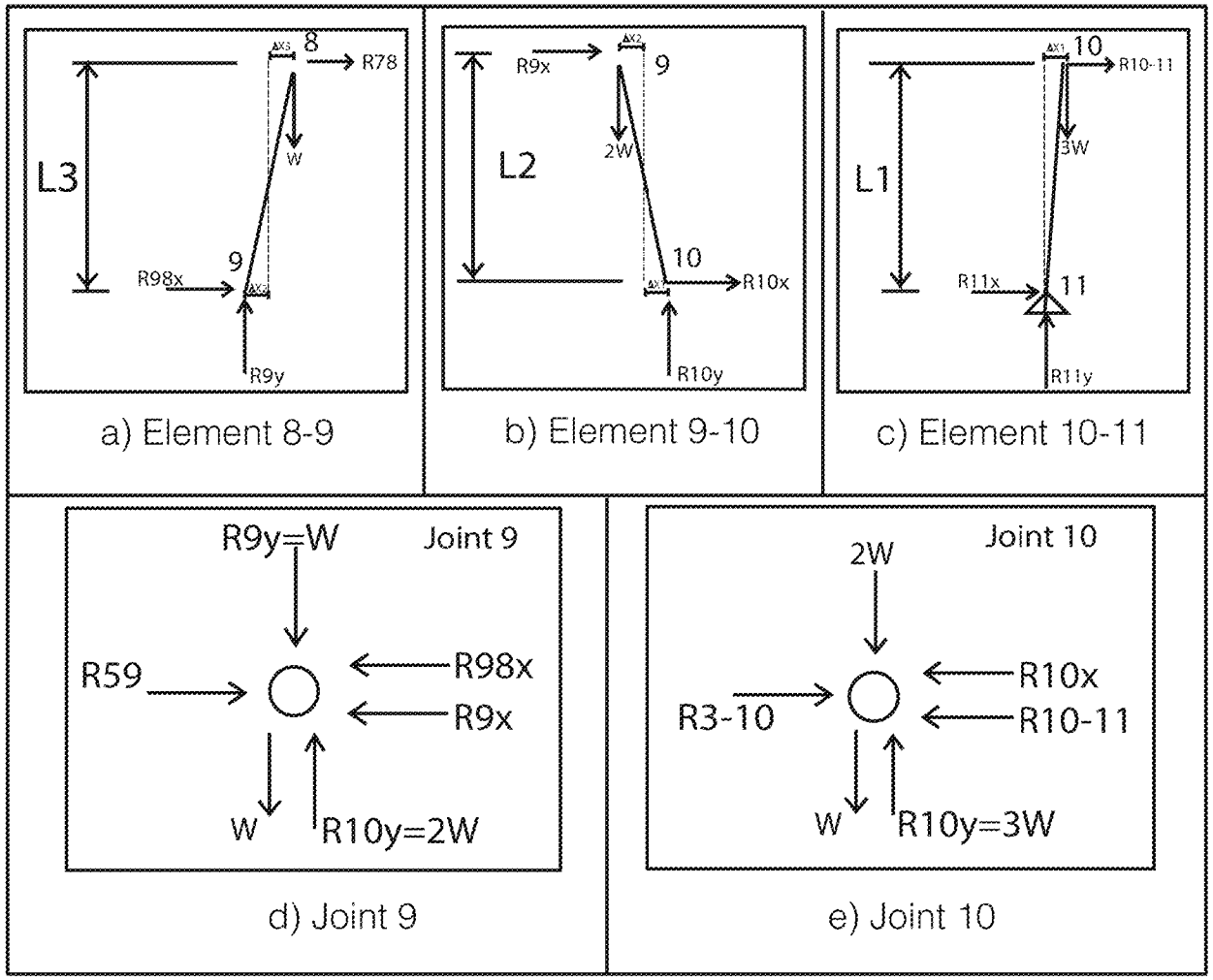
FIG. 20 shows a free-body diagram of the column sections and the joints, according to the present invention.

The free-body diagrams of the column elements and joints used for the first part of the derivation can be observed individually in FIG. 20. It should be mentioned that for the following equations, positive moments are defined as those moments who act in a counterclockwise manner. The first element to be analyzed is element 8-9. Starting by defining static equilibrium in the y direction, the reaction $R_{98y}$ can be found:

$$\Sigma F_y = R_{98y} - W = 0 \quad \text{Eq. 6}$$

$$R_{98y} = W \quad \text{Eq. 7}$$

The horizontal reaction $R_{78}$ is found by determining moment equilibrium in node 9:

$$\Sigma M_9 = -R_{78}L_3 - W(\Delta x_3 + \Delta x_2) = 0 \quad \text{Eq. 8}$$

$$R_{78} = \frac{-W(\Delta x_3 + \Delta x_2)}{L_3} \quad \text{Eq. 9}$$

It is observed in Eq. 9 that reaction $R_{78}$ has a negative sign; meaning that it acts in the opposite direction to which it was defined (acts to the left). Similarly, reaction $R_{98x}$ is found by moment equilibrium in node 8:

$$\Sigma M_8 = R_{98x}L_3 - R_{98y}(\Delta x_3 + \Delta x_2) = 0 \quad \text{Eq. 10}$$

$$R_{98x} = \frac{R_{98y}(\Delta x_3 + \Delta x_2)}{L_3} \quad \text{Eq. 11}$$

Substituting Equation 7 in Equation 9, results in:

$$R_{98x} = \frac{W(\Delta x_3 + \Delta x_2)}{L_3} \quad \text{Eq. 12}$$

After determining the reactions for element 8-9, the same procedure is used to determine the reactions in elements 9-10. Starting with static equilibrium in the y direction, reaction $R_{10y}$ can be obtained:

$$\Sigma F_y = R_{10y} - 2W = 0 \quad \text{Eq. 13}$$

$$R_{10y} = 2W \quad \text{Eq. 14}$$

By determining moment equilibrium in node 10, reaction $R_{9x}$ is found:

$$\Sigma M_{10} = 2W(\Delta x_2 + \Delta 1) - R_{9x}L_2 = 0 \quad \text{Eq. 15}$$

$$R_{9x} = \frac{2W(\Delta x_2 + \Delta x_1)}{L_2} \quad \text{Eq. 16}$$

Determining moment equilibrium in node 9 and using Equation 14 results in:

$$\Sigma M_9 = R_{10y}(\Delta x_2 + \Delta x_1) + R_{10x}L_2 = 0 \quad \text{Eq. 17}$$

$$R_{10x} = \frac{12W(\Delta x_2 + \Delta x_1)}{L_2} \quad \text{Eq. 18}$$

In the case of element 10-11, the only reaction of interest is $R_{10\text{-}11}$. It can be simply calculated by writing the moment equilibrium equation in node 11:

$$\Sigma M_{11} = -3W(\Delta x_1) - R_{10\text{-}11}L_1 = 0 \quad \text{Eq. 19}$$

$$R_{10\text{-}11} = \frac{3W(\Delta x_1)}{L_1} \quad \text{Eq. 20}$$

After determining the reactions at the end joints of the column elements, equilibrium equations must be defined in the joints to determine the net reactions that are transferred through the horizontal elements. In the case of joint 8, the only reaction is $R_{78}$; therefore, the reaction transmitted through the horizontal element 7-8 is the reaction itself, allowing to omit the statement of equilibrium for this joint. Analyzing joint 9 it is necessary to determine the reaction that will be transferred through element 5-9. By enforcing static equilibrium in the x direction for joint 9, equation 4.16 results in:

$$\Sigma F_x = R_{59} - R_{98x} - R_{9x} \quad \text{Eq. 21}$$

and substituting equations 12 and 16 into equation 21, the reaction $R_{59}$ is:

$$R_{59} = \frac{W(\Delta x_3 + \Delta x_2)}{L_3} + \frac{2W(\Delta x_2 + \Delta x_1)}{L_2} \quad \text{Eq. 22}$$

Similarly, joint 10 is analyzed to determine the horizontal reaction that will be transferred through element 3-10. The static equilibrium equation in the x direction for joint 10 is:

$$\Sigma F_x = R_{3\text{-}10} + R_{10x} + R_{10\text{-}11} \quad \text{Eq. 23}$$

And when equations 18 and 20 are substituted into equation 23, the reaction $R_{3\text{-}10}$ becomes:

$$R_{3-10} = -\left(\frac{2W(\Delta x_2 + \Delta x_1)}{L_2} + \frac{3W(\Delta x_1)}{L_1}\right) \quad \text{Eq. 24}$$

Figure 22:
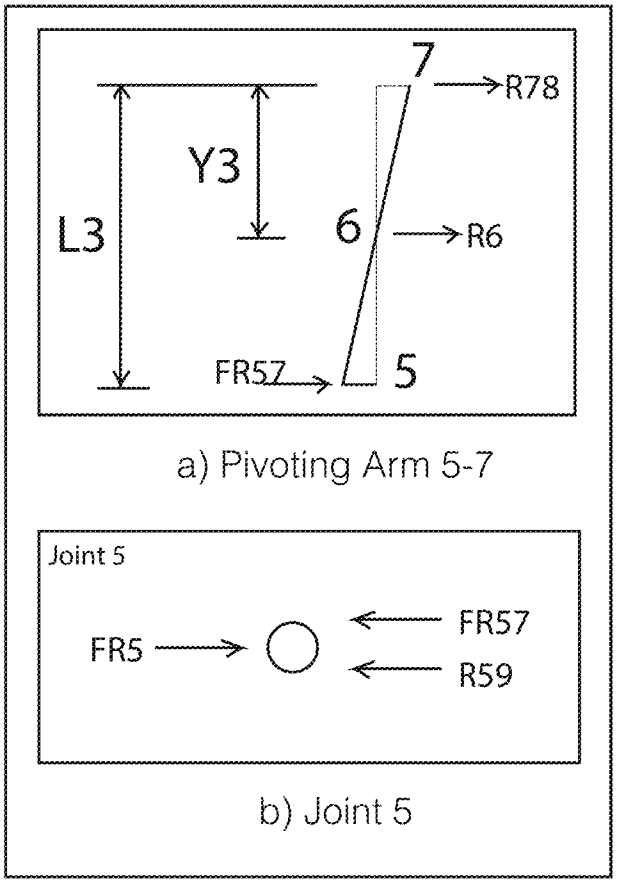
FIG. 22 shows a free body diagrams for pivoting arm 5-7 and joint 5, according to the present invention.
Figure 21:
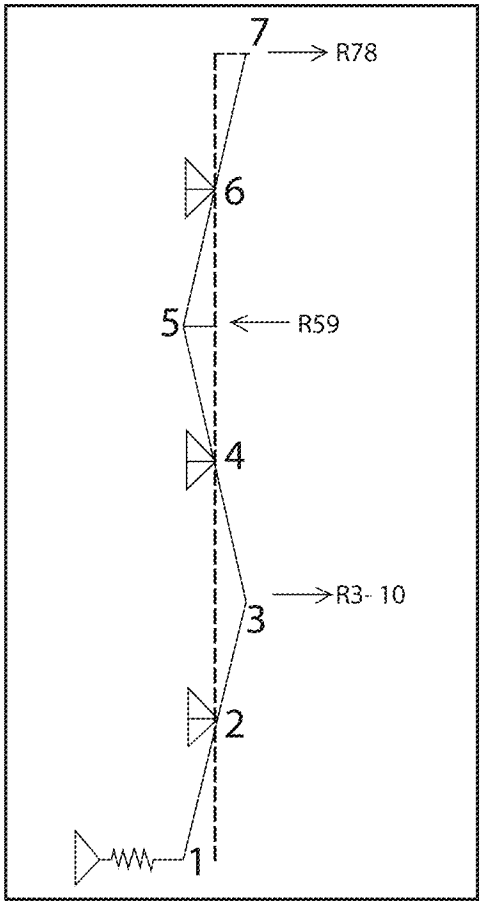
FIG. 21 shows the reactions transferred to the pivoting arms, according to the present invention.
Figure 23:
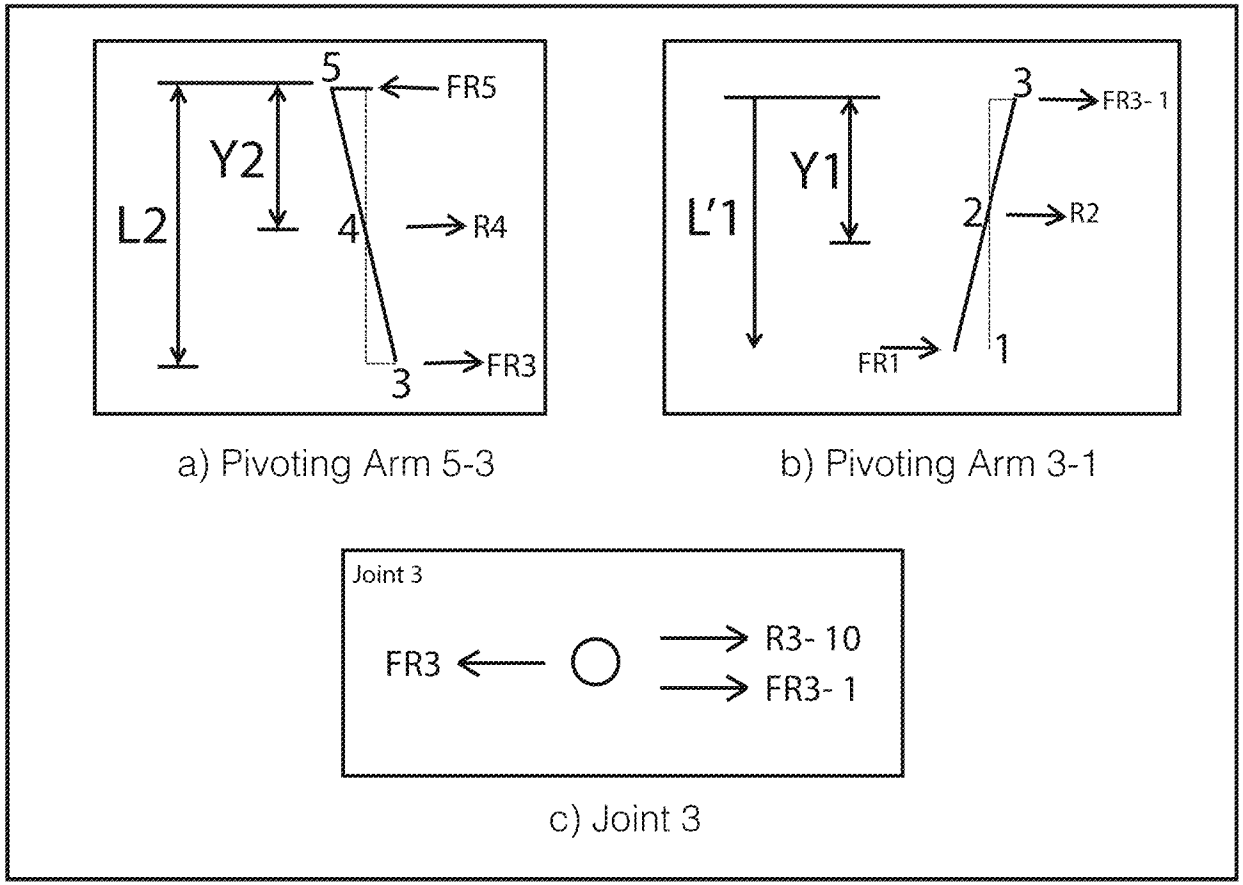
FIG. 23 shows a free-body diagrams for arm 5-3, arm 3-1 and joint 3, according to the present invention.

All the destabilizing reactions have been calculated for the model. These are transferred through the horizontal elements to the pivoting arms. FIG. 21 presents a diagram of the destabilizing forces that must be counteracted by the pivoting arms. In order to find the necessary force that the spring must provide to maintain equilibrium in the model, the reactions throughout the pivoting arms must be calculated. The final part of the derivation is based on the free body diagrams presented in FIG. 22 and FIG. 23.

The pivoting arms are restrained by pin supports around which they can rotate. Moment equilibrium equations in these supports provide an alternative to calculate the unknown reactions throughout the pivoting arms. Beginning with element 7-5, the moment equilibrium equation at node 6 allows us to calculate the reaction $F_{R57}$:

$$\Sigma M_6 = F_{R57}(L_3 - Y_3) - R_{78}Y_3 = 0 \quad \text{Eq. 25}$$

$$F_{R57} = R_{78}\frac{Y_3}{(L_3 - Y_3)} \quad \text{Eq. 26}$$

Joint 5 must be evaluated to find the reaction $F_{R5}$ that is transferred to element 5-3. Establishing static equilibrium in the x direction and using equation 26, $F_{R5}$ is:

$$\Sigma F_x = F_{R5} - F_{R57} - R_{59} = 0 \quad \text{Eq. 27}$$

$$F_{R5} = R_{78}\frac{Y_3}{(L_3 - Y_3)} + R_{59} \quad \text{Eq. 28}$$

Element 5-3 is evaluated to find the reaction that is transferred to Joint 3. Using moment equilibrium at node 4, the reaction $F_{R3}$ results in:

$$\Sigma M_4 = F_{R23}(L_2 - Y_2) + F_{R5}Y_2 = 0 \quad \text{Eq. 29}$$

$$F_{R23} = -F_{R5}\frac{Y_2}{(L_2 - Y_2)} \quad \text{Eq. 30}$$

With the equation of static equilibrium in the x direction for Joint 3 and equation 26, the reaction $F_{R23\text{-}1}$ transferred to element 3-1 is:

$$\Sigma F_x = R_{3\text{-}10} - F_{R3} + F_{R3\text{-}1} = 0 \quad \text{Eq. 31}$$

$$F_{R3-1} = -\left(F_{R5}\frac{Y_2}{(L_2 - Y_2)} + R_{3-10}\right) \quad \text{Eq. 32}$$

Finally, element 3-1 can be evaluated and the reaction $F_{R1}$ that corresponds to the force produced by the spring can be calculated. It should be clarified that the moment arm from node 2 to the spring is $L'_1$, not $L_1$. Considering this and satisfying moment equilibrium in node 2, the reaction $F_{R1}$ results is:

$$\Sigma M_2 = F_{R1}(L'_1 - Y_1) - F_{R3\text{-}1}Y_1 = 0 \quad \text{Eq. 33}$$

$$F_{R1} = F_{R3-1}\frac{Y_1}{(L'_1 - Y_1)} \quad \text{Eq. 34}$$

Before substituting the necessary equations to calculate $F_{R1}$, three basic definitions are presented to simplify the resulting expression considerably. These definitions, presented in equations 35, 36 and 37, represent the ratio between the swinging arm fasteners and the corresponding level height.

$$r_1 = \frac{Y_1}{(L'_1 - Y_1)} \quad \text{Eq. 35}$$

$$r_2 = \frac{Y_2}{(L_2 - Y_2)} \quad \text{Eq. 36}$$

$$r_3 = \frac{Y_1}{(L_3 - Y_3)} \quad \text{Eq. 37}$$

Using equation 34 and substituting equations 37, 36, 35, 32, 28, 24, 22 and 9, the resulting spring force is:

$$F_{R1} = \frac{W(\Delta x_3 + \Delta x_2)}{L_3}r_3r_2r_1 + \left(\frac{W(\Delta x_3 + \Delta x_2)}{L_3} + \frac{2W(\Delta x_2 + \Delta x_1)}{L_2}\right)r_2r_1 + \left(\frac{2W(\Delta x_2 + \Delta x_1)}{L_2} + \frac{3W(\Delta x_1)}{L_1}\right)r_1 \quad \text{Eq. 38}$$

Considering that the weight and geometric configuration of the levels is constant, it can be established that the force that must be provided by the spring is a function of the displacements of the model stories. All these displacements can be geometrically expressed as a function of the spring displacement $\Delta x_R$:

$$\Delta x_1 = \Delta x_R\frac{Y_1}{(L'_1 - Y_1)} = \Delta x_R r_1 \quad \text{Eq. 39}$$

$$\Delta x_2 = \Delta x_1\frac{Y_2}{(L_2 - Y_2)} = \Delta x_R r_1 r_2 \quad \text{Eq. 40}$$

-continued $$\Delta x_3 = \Delta x_2 \frac{Y_3}{(L_3 - Y_3)} = \Delta x_R r_1 r_2 r_3 \quad \text{Eq. 41}$$

Using equations 39 to 41 in equation 38, the resulting spring force is:

$$F_R = W\Delta x_R\left(\frac{r_1r_2 + r_1r_2r_3}{L_3}(r_1r_2r_3) + \frac{r_1r_2 + r_1r_2r_3}{L_3}(r_1r_2) + \frac{2(r_1r_2 + r_1)}{L_2}(r_1r_2) + \frac{2(r_1r_2 + r_1)}{L_2}(r_1) + \frac{3r_1^2}{L_1}\right) \quad \text{Eq. 42}$$

$$F_R = K\Delta x_R \quad \text{Eq. 43}$$

Considering that the force in a spring is defined by equation 43, the variable $\Delta x_R$ can be eliminated from equation 42. This implies that the force required from the spring to maintain stability in the system will depend on the geometric configuration of the model and the spring stiffness. This confirms the proposed hypothesis that a minimum value for spring stiffness was required in order for the model to function properly. The spring stiffness minimum value can be calculated using equation 44:

$$K_{min} = W\left(\frac{r_1r_2 + r_1r_2r_3}{L_3}(r_1r_2r_3) + \frac{r_1r_2 + r_1r_2r_3}{L_3}(r_1r_2) + \frac{2(r_1r_2 + r_1)}{L_2}(r_1r_2) + \frac{2(r_1r_2 + r_1)}{L_2}(r_1) + \frac{3r_1^2}{L_1}\right) \quad \text{Eq. 44}$$

By examining this equation, it can be concluded that in order to reduce the value of minimum stiffness, the ratio between the swinging arm fasteners and the corresponding level height ($r_1r_2r_3$) must be reduced. Based on their definition, this implies moving upward the position of the pivoting arms fasteners. Considering that the ratio $r_1$ is present in all terms of the equation, it is expected that a modification in this particular ratio will have a major effect in $K_{min}$ that when any of the two other ratios are changed.

Analytical Model Development

An analytical model was created in the SAP2000 software program to simulate the behavior of the constructed scale model. The analytical model was calibrated using a series of experimental data collected from the scale model. Different information will be assessed from the analytical model in order to describe the dynamic behavior of the constructed model. The development and calibration of the analytical model is explained below.

Analytical Model Description

The SAP2000 program is designed to perform structural analysis and also has the capability to simulate earthquake motion by time history analysis. A two-dimensional frame model was developed in the program to represent the scale model with the proposed control arrangement. The model created is used for lateral load analysis only. Therefore, the load patterns defined in the program include a self-weight multiplier of zero. This implies that the vertical displacements, reactions, etc. caused by the weight of the model are not considered. However, the mass of the sections is used when the program performs time history analysis.

The first step to create the model is inputting the information necessary to define the geometric configuration. Although the scale model was created to be used for tests in one direction, representing the model in two dimensions presents some limitations. The limitation is caused by the fact that the position of the pivoting arms and the vertical tube would merge in a two-dimensional representation. Physically, the vertical tube is positioned behind the pivoting arms. In order to properly describe this spatial configuration a third dimension is required. Therefore, a special assumption was made to overcome the limitation. The pivoting arm and the vertical tube were modeled as elements with different horizontal coordinates (x direction). Specifically, they were modeled with a separation of 0.2 inches. Additional information of this particular is explained later.

Figure 24:
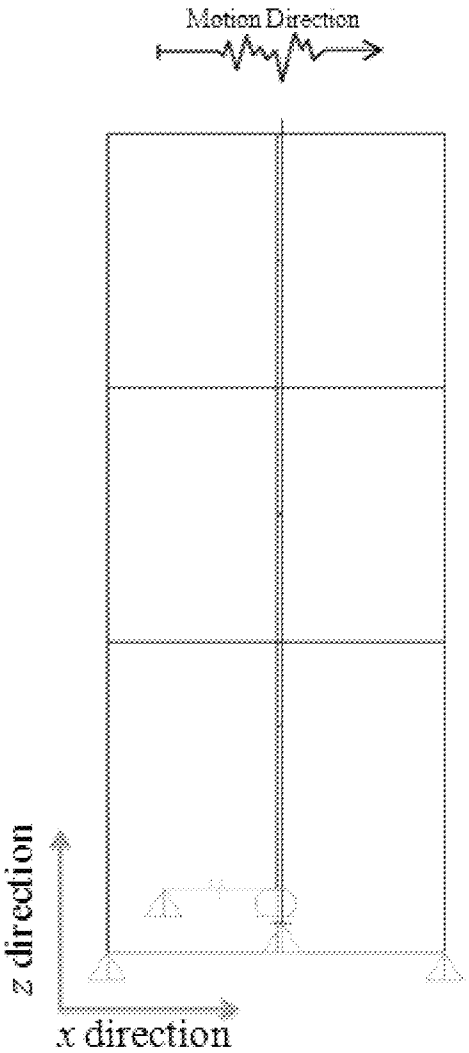
FIG. 24 shows a SAP2000 graphical representation of the analytical model, according to the present invention.

After all the necessary data to create the two-dimensional geometric configuration of the model has been inputted into the program, it presents a graphical representation of the structure as shown in FIG. 24. The elements of the model are then assigned a section property that contains vital information for the analysis. Table 5 presents the information that was entered into the program to define the six different sections of the model. All the sections are defined in the program as Frame Sections, except for the spring section which is defined as a Link/Support.

TABLE 5

| Section | Material | Shape or Type | Depth | Width | Flange Thickness | Web Thickness | Diameter |
|---|---|---|---|---|---|---|---|
| Walls | A992Fy50 | Rectangular | 12 | 0.125 | n/a | n/a | n/a |
| Floors | A992Fy50 | Rectangular | 1 | 10 | n/a | n/a | n/a |
| Arms | A992Fy50 | Rectangular | 0.5 | 0.125 | n/a | n/a | n/a |
| Tube | A992Fy50 | Tube | 2 | 2 | 0.0829 | 0.0829 | n/a |
| Fastener | A992Fy50 | Circular | n/a | n/a | n/a | n/a | 0.375 |
| Spring | n/a | Link/Support | n/a | n/a | n/a | n/a | n/a |

(all units in inches)

Figure 25:
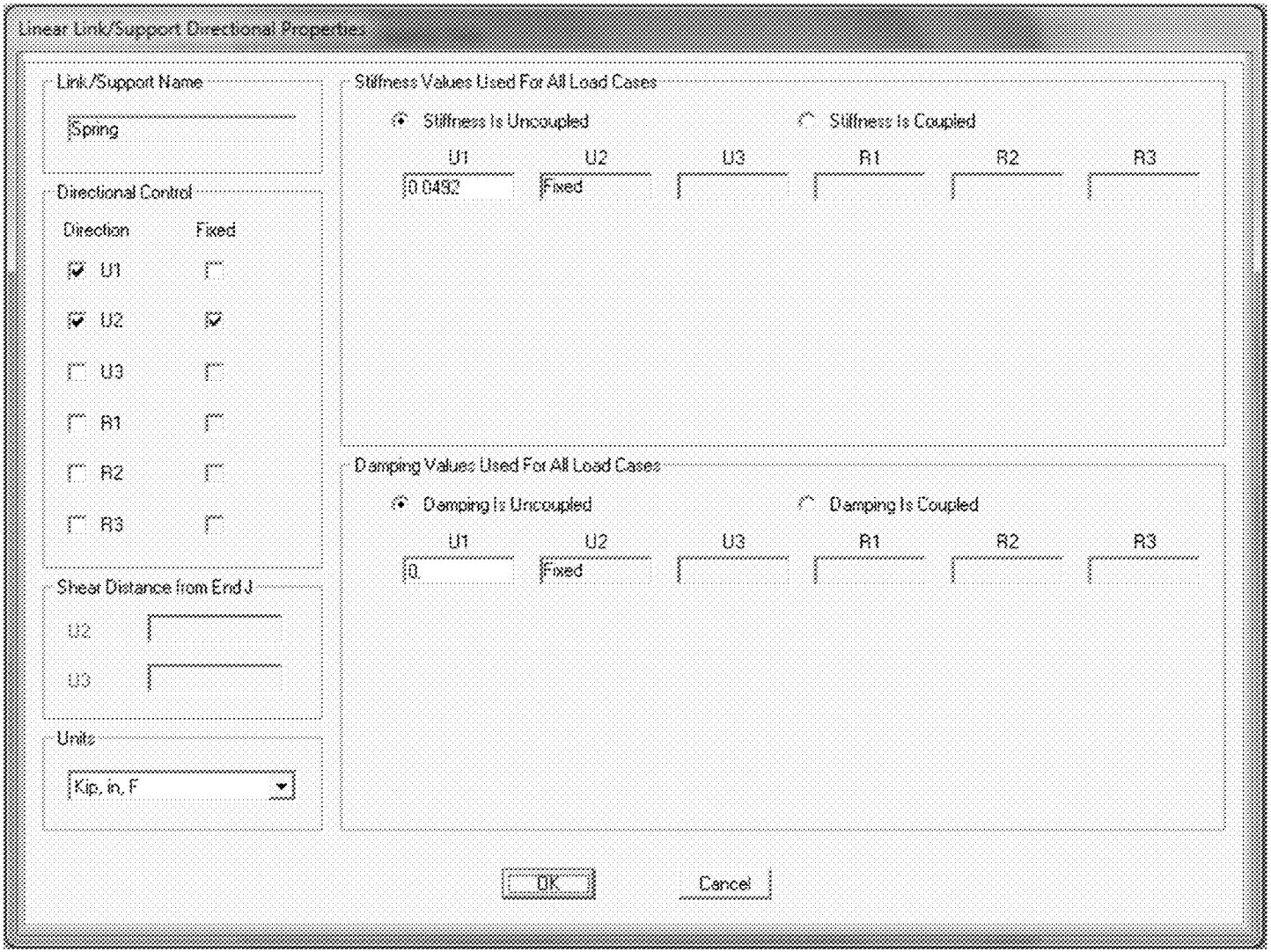
FIG. 25 illustrates a window GUI for the link/support directional properties of the spring section, according to the present invention.

The information entered for the spring section is displayed in FIG. 25. This section represents the spring configuration in the scale model. For the Directional Control options, the checkmarks for directions U1 (x direction) and U2 (y direction) were selected. For the direction U2, the Fixed option is selected because physically the spring is restricted for vertical movements. The Fixed option for the U1 direction is not selected. Instead, the stiffness value of the spring is entered in the Stiffness Values Used For All Load Cases section under the U1 direction. The spring is not physically restricted for rotation in any direction, therefore no directional control option is selected for R1 and R2.

Figure 26:
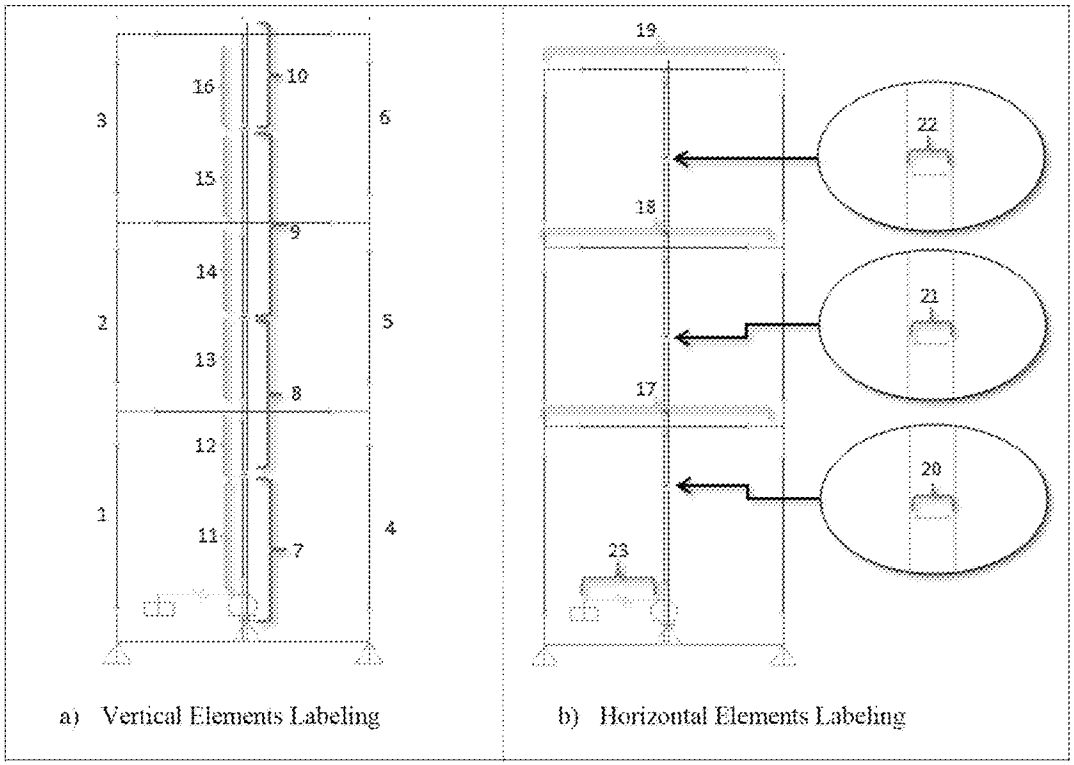
FIG. 26 shows a labeling scheme of the SAP2000 model elements, according to the present invention.

After all the sections have been defined, they are assigned to their corresponding elements. To indicate which section is assigned to each element, first the elements must be identified. FIG. 26 shows how the elements were labeled for identification. As presented in Table 6 below, the sections corresponding to the vertical elements are the Walls, Tube and Arms sections. For the horizontal elements, the corresponding sections are Floors, Fastener and Spring.

Additional valuable information is presented in Table 6. Besides presenting the coordinates for the ends of each element, columns 7 and 8 identify which joints have a restraint and which type of restraint. Finally, columns 9 and 10 indicate if the elements have moment releases at any of their joints. The assignment of moment releases plays a significant role in the definition of the analytical model and should be discussed at length.

Moment releases are assigned at both joints to every wall section. This allows the walls to articulate similarly to the physical scale model. Similarly, the floor elements have moment releases at both joints to represent the pin connection with the columns. Although the floors seem to intersect with the vertical tube and arms, they are defined as continuous elements from beginning to end. However, there is a connection in the middle of the floors with the arms. Although there is a pair of arm elements between floors in the analytical model, they really represent each pivoting arm between stories in the physical model. For instance, the arm elements 15 and 16 symbolize the pivoting arm between the third and second stories of the scale model. The same can be said about elements 13-14 and 11-12 which symbolize the other two pivoting arms, respectively. The assignment of moment releases is essential for the proper representation of the pivoting arm. Looking at elements 15 and 16, it can be observed that element 16 has a moment release at the top node, while element 15 has a moment release in the bottom node. The node which is shared between the two elements does not have any moment release. This means that elements 15 and 16 act continuous (there is moment transfer) but do not transfer any moment to the connected floors. The pairs 13-14 and 11-12 behave in the same manner as the pair 15-16.

It can be seen that each pair of arm elements is connected in the middle to small horizontal elements that have been assigned the Bolt frame section. These horizontal elements are responsible of connecting the arms to the vertical tube. Since these elements represent the bolts connecting the pivoting arms and the vertical tube in the physical model, they should only transmit directional forces. Therefore, moment releases have been assigned at the beginning and end of the elements. The elements with the Tube section assigned do not have any moment releases. This is because they symbolize the vertical tube, which is a continuous member throughout its full height. However, it should be clarified that a pin restraint in combination with a partial fixity release has been assigned at the lower node of element 7 instead of assigning a completely fixed restraint. As it will be described in a following section, the connection of the tube to the base of the model is not an ideal fixed connection. The partial fixity release will represent the rotational stiffness of the tube.

TABLE 6

Analytical Model Calibration

| | | i coordinate | | j coordinate | | Joint Restraints | | Moment Releases | |
|---|---|---|---|---|---|---|---|---|---|
| Section | Element | x | z | x | z | i coord. | j coord. | i coord. | j coord. |
| Walls | 1 | −6 | 0 | −6 | 11 | PIN | FREE | ✓ | ✓ |
| | 2 | −6 | 11 | −6 | 20 | FREE | FREE | ✓ | ✓ |
| | 3 | −6 | 20 | −6 | 29 | FREE | FREE | ✓ | ✓ |
| | 4 | 6 | 0 | 6 | 11 | PIN | FREE | ✓ | ✓ |
| | 5 | 6 | 11 | 6 | 20 | FREE | FREE | ✓ | ✓ |
| | 6 | 6 | 20 | 6 | 29 | FREE | FREE | ✓ | ✓ |
| Tube | 7 | 0.2 | 1 | 0.2 | 8 | PIN* | FREE | Partial Fix* | |
| | 8 | 0.2 | 8 | 0.2 | 15.5 | FREE | FREE | | |
| | 9 | 0.2 | 15.5 | 0.2 | 24.5 | FREE | FREE | | |
| | 10 | 0.2 | 24.5 | 0.2 | 29.5 | FREE | FREE | | |
| Arms | 11 | 0 | 2.25 | 0 | 8 | ROLLER | FREE | ✓ | |
| | 12 | 0 | 8 | 0 | 11 | FREE | FREE | | ✓ |
| | 13 | 0 | 11 | 0 | 15.5 | FREE | FREE | ✓ | |
| | 14 | 0 | 15.5 | 0 | 20 | FREE | FREE | | ✓ |
| | 15 | 0 | 20 | 0 | 24.5 | FREE | FREE | ✓ | |
| | 16 | 0 | 24.5 | 0 | 29 | FREE | FREE | | ✓ |
| Floors | 17 | −6 | 11 | 6 | 11 | FREE | FREE | ✓ | ✓ |
| | 18 | −6 | 20 | 6 | 20 | FREE | FREE | ✓ | ✓ |
| | 19 | −6 | 29 | 6 | 29 | FREE | FREE | ✓ | ✓ |
| Fastener | 20 | 0 | 8 | 0.2 | 8 | FREE | FREE | ✓ | ✓ |
| | 21 | 0 | 15.5 | 0.2 | 15.5 | FREE | FREE | ✓ | ✓ |
| | 22 | 0 | 24.5 | 0.2 | 24.5 | FREE | FREE | ✓ | ✓ |
| Spring | 23 | 0 | 2.25 | −4 | 2.25 | ROLLER | FIXED | ✓ | ✓ |

(* This node has a partial fixity representing the vertical tube rotational stiffness. Coordinate units are in inches)

Experimental data was collected from the scale model with the intention of calibrating the analytical model. The data from the scale model consists of information on the stiffness of the spring used to balance the model, results from a static test made on the vertical tube, and displacement measurements made on every level when the model is pulled off from its equilibrium position.

Spring Stiffness

Figure 27:
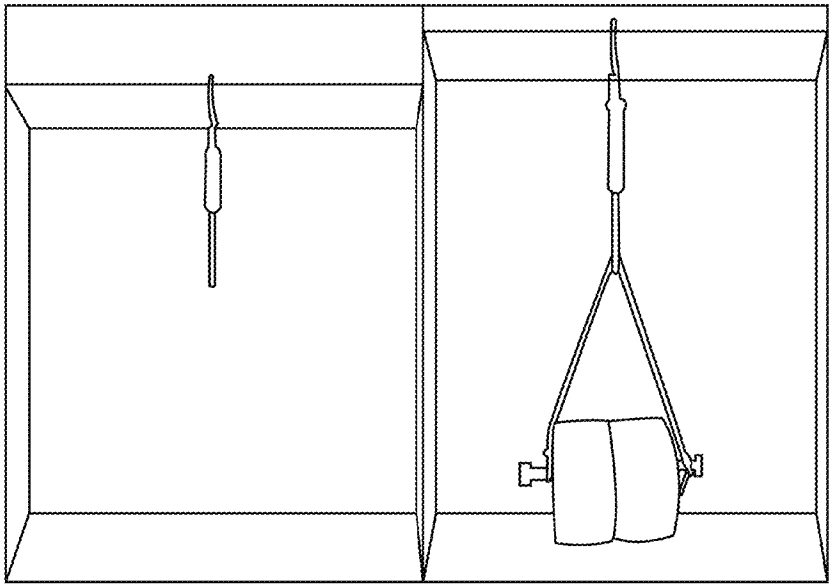
FIG. 27 shows a spring axial load test, according to the present invention.

An axial load test was carried out on the springs used in the model to obtain their stiffness value. The test consisted of applying an axial load of ten pounds to the spring in order to measure its difference in length when the load is applied. The test configuration can be seen in FIG. 27. The figure shows the spring without any applied load and with the applied load. The spring length without any applied load is $$1-\frac{11''}{16}.$$

When the load is applied, the spring length extends to 2.5 inches.

The stiffness of the spring is calculated using Equation 45, $$K_s = \frac{F}{x} \quad \text{Eq. 45}$$

where $K_s$ is spring stiffness, F is the force applied to the spring, and x is the displacement produced by the applied force. Considering that the applied force of ten pounds resulted in a displacement of $$\frac{13''}{16},$$

the stiffness value of the spring is 12.3 lbs/in. The calculated value of the stiffness coefficient for the spring is not the value to be used in the SAP2000 model, since the scale model utilizes a configuration of two pair of springs as the stabilizing force.

Figure 28:
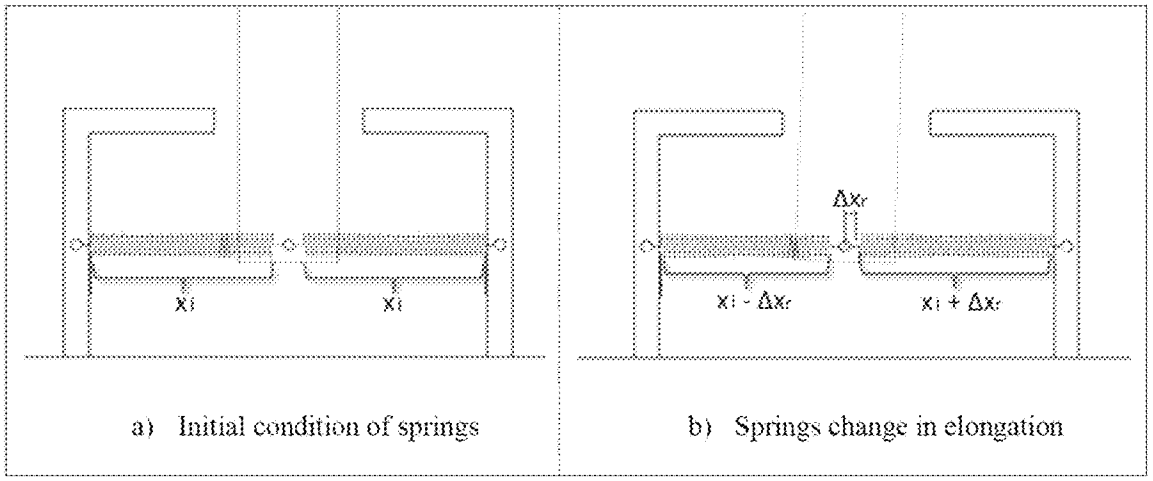
FIG. 28 illustrates the elongation of the spring, according to the present invention.
Figure 46:
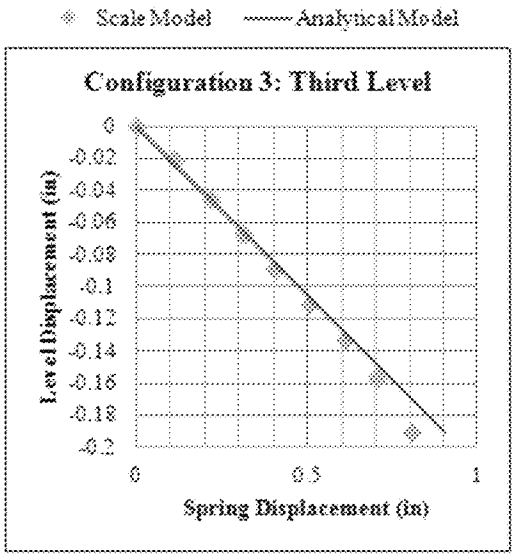
FIGS. 38-46 shows displacement validation plots for various configurations, according to the present invention.

Each pair of springs used in the configuration is placed in one face of the model. Each spring of a particular pair acts in opposite directions. Each spring has an initial elongation when it is attached to the model. This can be seen in FIG. 28, which shows the elongation of the springs in the initial condition and how the elongation changes when the model is shaken off its equilibrium position.

Figure 29:
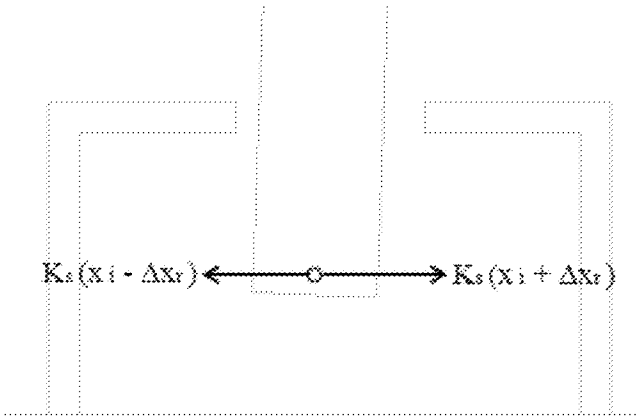
FIG. 29 shows a diagram of spring forces, according to the present invention.

A diagram of the reactions produced by one pair of springs is shown in FIG. 29, in which it can be seen that each spring force acts in opposite directions. Equation 46 depicts the equilibrium in the horizontal direction for the forces shown in the free-body diagram. The simplification shown in equation 47 represents the restoring force that each pair of springs applies.

$$K_s(x_i+\Delta x_R)-K_s(x_i-\Delta x_R)=F_R \quad \text{Eq. 46}$$

$$F_R=2K_s(\Delta x_R) \quad \text{Eq. 47}$$

As mentioned previously, the experimental model used two pairs of springs, one pair in each one of the bottom arms. Therefore, the total restoring force is:

$$F_R=4K_s(\Delta x_R) \quad \text{Eq. 48}$$

From equation 48 it can be deduced that the overall stiffness value for the configuration of the springs is four times the stiffness of the individual spring used. Based on the calculation made in Equation 45, the total stiffness of the springs configuration is 49.2 lbs/in. This is the input value in the x (U1) direction used for the Spring Section in the SAP2000 model.

Vertical Tube Rotational Stiffness

Figure 31:
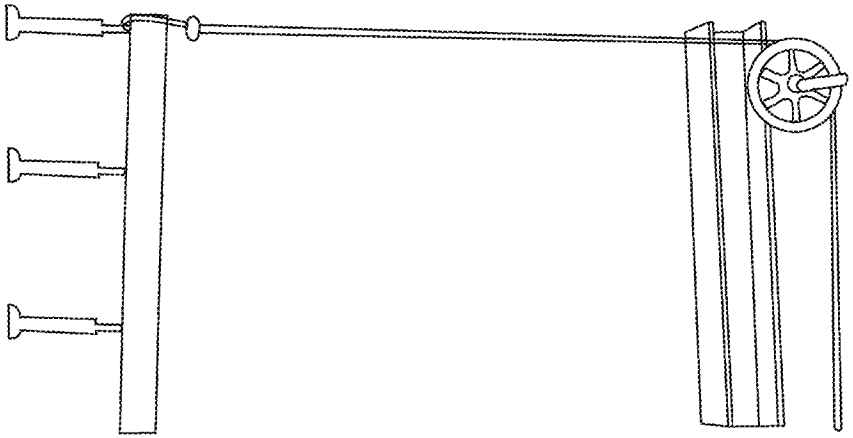
FIG. 31 shows the horizontal cable used in the vertical tube test, according to the present invention.
Figure 30:
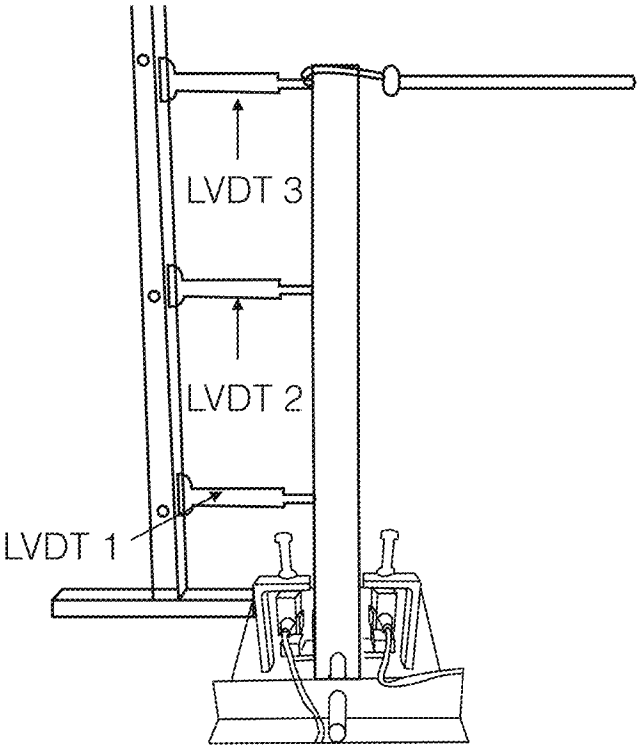
FIG. 30 shows the vertical tube during a test, according to the present invention.
Figure 33:
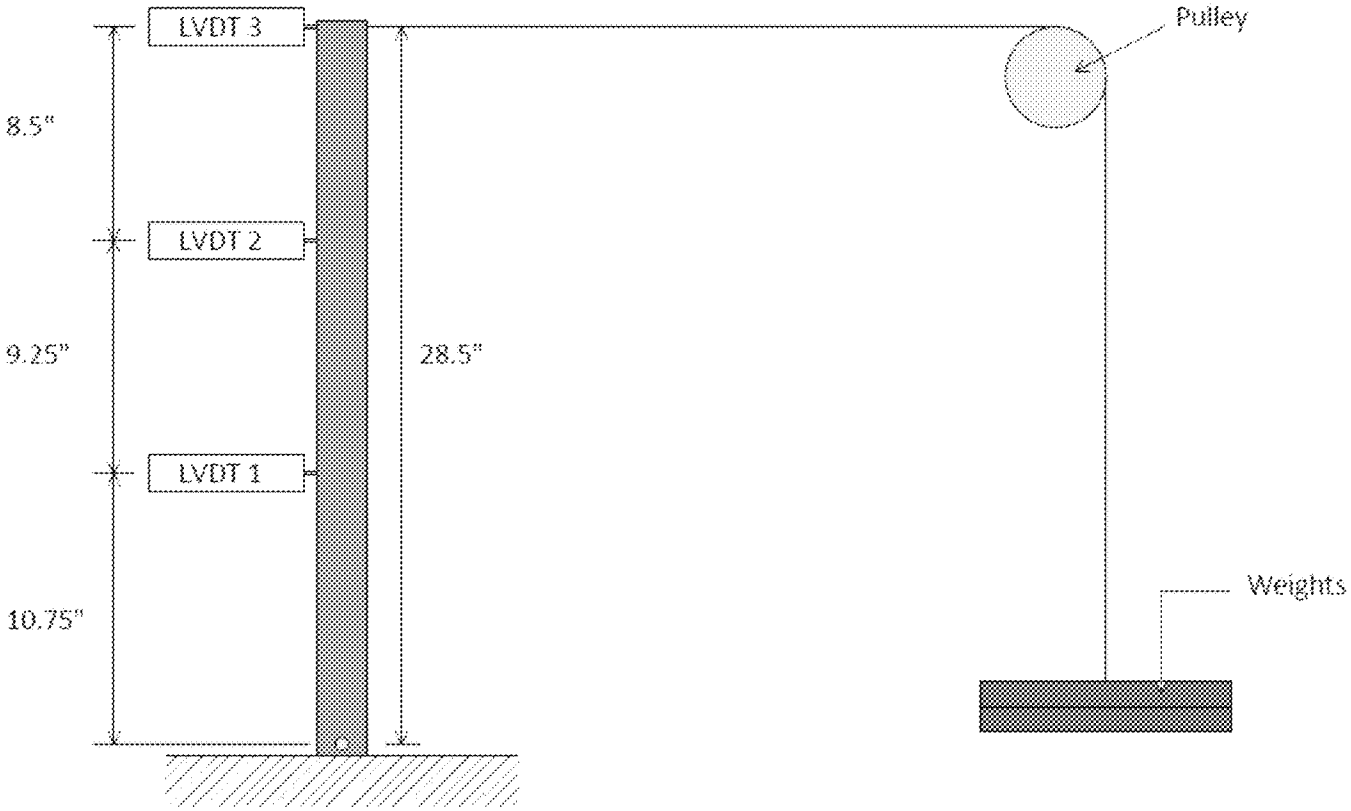
FIG. 33 illustrates the vertical tube test configuration, according to the present invention.
Figure 32:
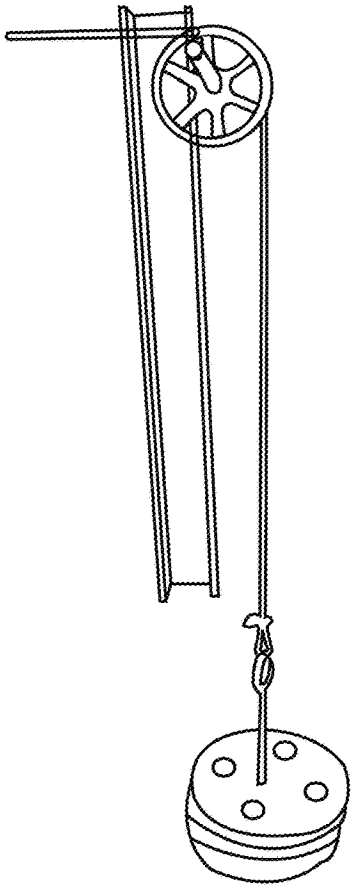
FIG. 32 shows the pulley and weights used in the vertical tube test, according to the present invention.

The scale model design was based on the assumption that the vertical tube was connected to the base with a fixed connection using two load cells which do not allow any rotation. A static test was made on the vertical tube in order to measure the rotational stiffness and verify that this assumption is reasonable. The test consists in applying a horizontal load at the top of the tube only, making it to act as a vertical cantilever beam. In order to do this, the complete building was dismantled, except for the vertical tube and the load cells fixing it to the base. As it can be seen in FIG. 30, which presents a photograph from the actual test, three Linear Variable Differential Transformers (LVDT) measuring deflections were positioned throughout the height of the tube. The horizontal load was applied by a cable attached to the top of the tube. This cable passes through a pulley and is connected at the other end to hanging weights, as shown in FIG. 31 and FIG. 32. A schematic showing the test configuration with its dimensions is presented in FIG. 33.

The LVDT's measure the deflections of the tube along its height when load is applied. The measured deflection consists of two components. One component of the deflection is a direct result of the elastic deformation of the tube. The second component of the deflection is attributed to the rotation of the tube. The elastic deflection is calculated using Equation 49, which corresponds to the deflection equation for a cantilever beam.

$$v = \frac{Px^2}{6EI}(3L - x) \quad \text{Eq. 49}$$

where, v is the elastic deflection, P is the applied load, x is the position along the tube where the displacement is measured, E is the modulus of elasticity and I is the inertia of the vertical tube.

The deflection that can be attributed to the rotation of the tube is calculated using Equation 50:

$$\delta = x\tan\left(\frac{PL}{k_\theta}\right) \quad \text{Eq. 50}$$

where $k_\theta$ is the rotational stiffness of the tube, P is the applied load and L is the length between the applied load and the base of the tube.

All the variables affecting the elastic deformation are already known; therefore, the elastic deformation can be calculated in all positions for every applied load. The rotational deflection of the tube, δ, cannot be calculated until the rotational stiffness of the tube is known. To obtain the rotational stiffness of the tube, the Solver tool of the program Microsoft Office Excel was used. The Microsoft Office Excel Solver tool uses the Generalized Reduced Gradient (GRG2) nonlinear optimization code, which was developed by Leon Lasdon, University of Texas a Austin, and Alan Waren, Cleveland State University. The Solver tool adjusts the value in a specified changing cell (called the adjustable cell), in order to find an optimal value for a formula in another cell (called the target cell) on a worksheet. In this case, the adjustable cell represents the value of the rotational stiffness. The formula in the target cell is the root-mean square error between the calculated deflection and the experimental results. The Solver tool found an optimal value of 139,585 lbs-in/rad, which resulted in a root-mean-square error of 4.05%. Table 7 presents a comparison between the total deflection calculated and the experimental results. It can be observed that the error percentage is very consistent with the root mean-square error of 4.05%, except for the LVDT 1 when the load is 24.75 lbs which results in an error percentage of 8.61%.

TABLE 7

| Load | Total Deflection, v + δ (in) | | | Experimental Results (in) | | | Error percentage | | |
|---|---|---|---|---|---|---|---|---|---|
| (lbs) | LVDT 3 | LVDT 2 | LVDT 1 | LVDT 3 | LVDT 2 | LVDT 1 | LVDT 3 | LVDT 2 | LVDT 1 |
| 24.75 | 0.164 | 0.113 | 0.058 | 0.170 | 0.108 | 0.064 | 3.60% | −4.27% | 8.61% |
| 49.5 | 0.328 | 0.225 | 0.117 | 0.324 | 0.219 | 0.120 | −1.16% | −2.85% | 2.51% |
| 74.25 | 0.492 | 0.338 | 0.175 | 0.469 | 0.341 | 0.173 | −4.83% | 0.92% | −1.43% |

It can be appreciated in FIG. 34 the extent to which the rotational deflection controls the total deflection of the tube. The rotational deflection is in the order of ten times the elastic deflection. This means that the assumption that the tube is completely fixed to the base is not accurate. Therefore, the rotational stiffness of the tube should be incorporated into the SAP2000 model.

Validation of Displacements Geometry

Another test was performed with the purpose of validating that the displacements geometry in the scale model were similar to those from the analytical model. This means that when the model is displaced from its equilibrium position, the displacements of the scale and analytical model produced by the mechanism at all levels should coincide.

Figure 36:
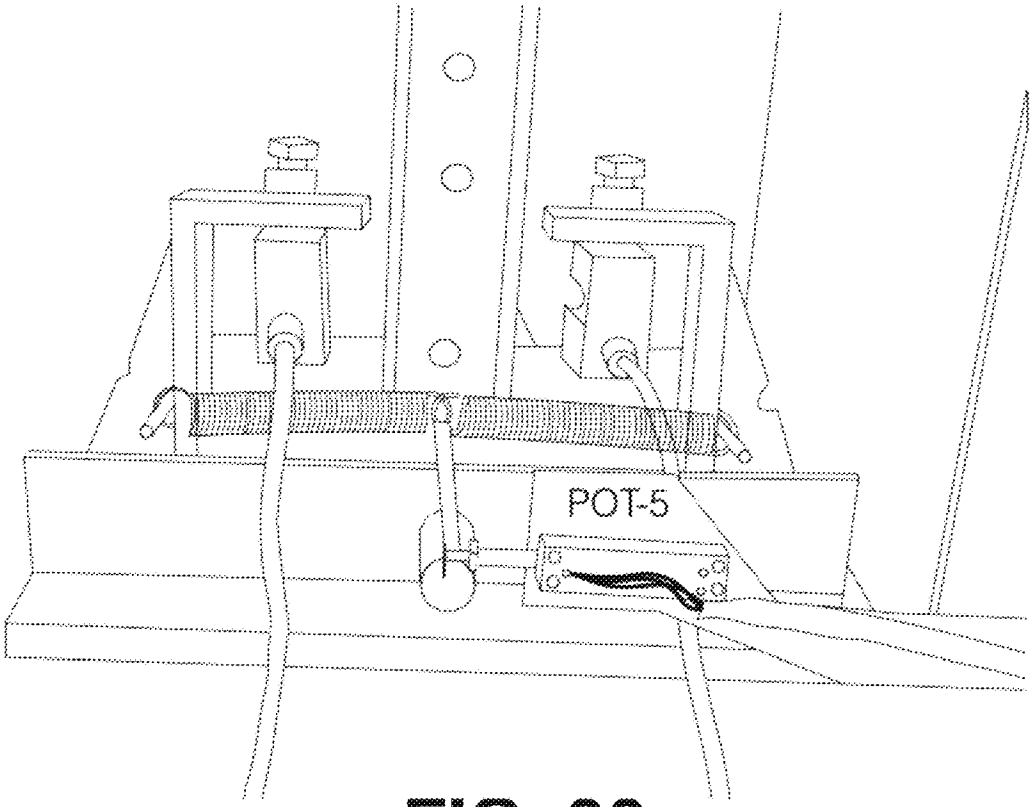
FIG. 36 shows the extensometer in restoring springs, according to the present invention.
Figure 35:
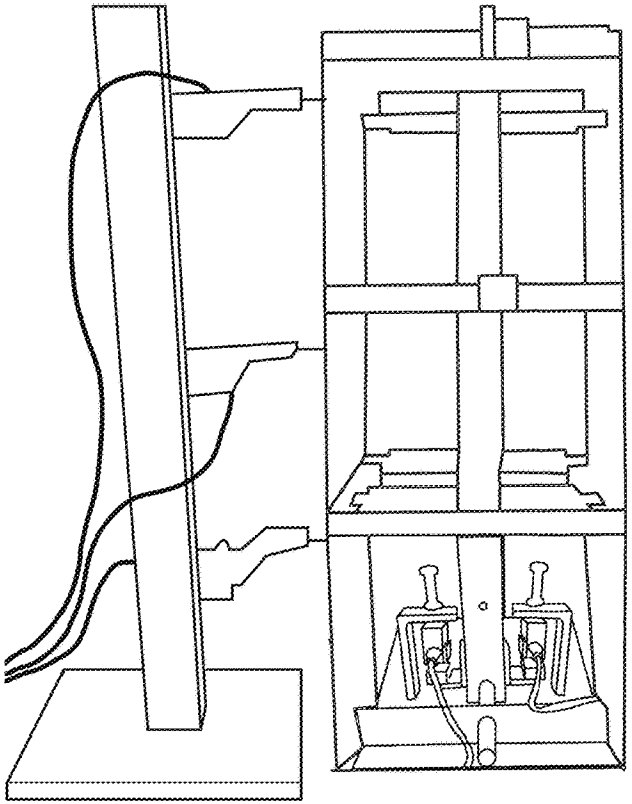
FIG. 35 shows the extensometers in all levels, according to the present invention.
Figure 38:
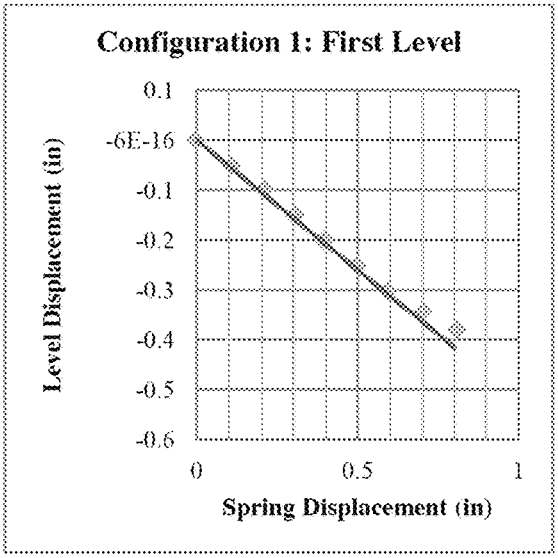
Figure 39:
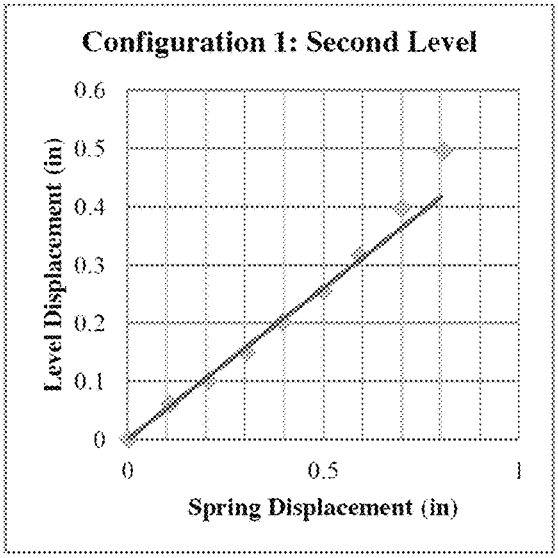
Figure 40:
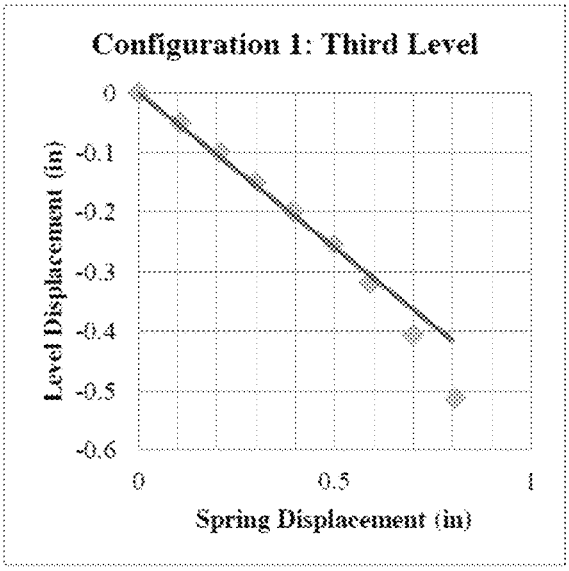
Figure 41:
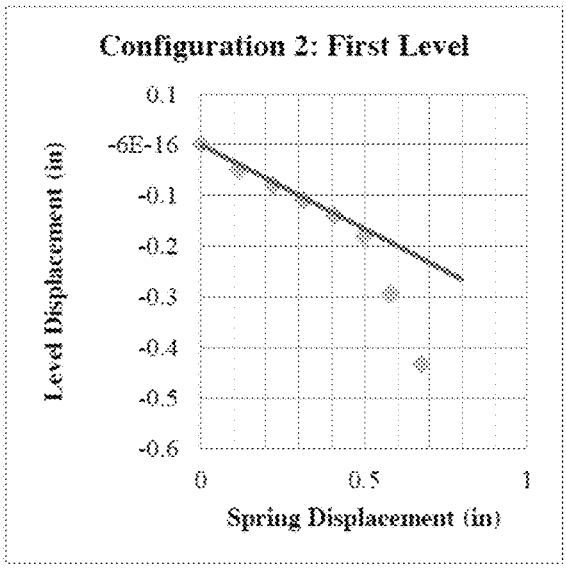
Figure 42:
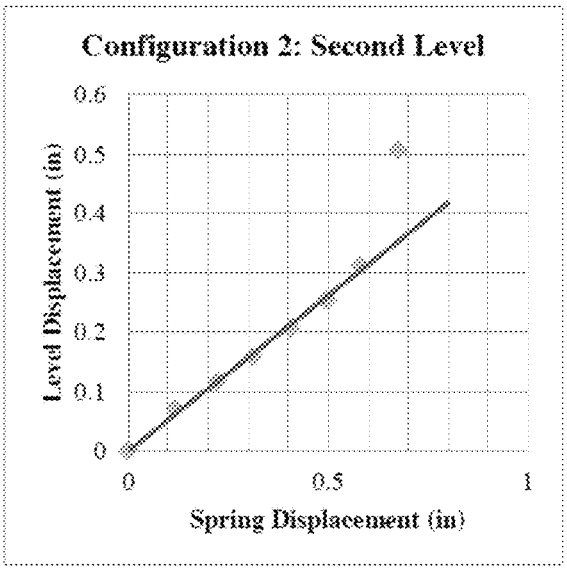
Figure 43:
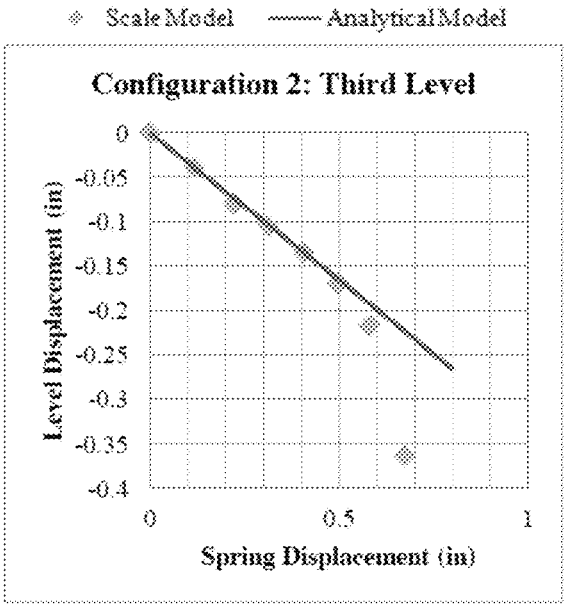
Figure 44:
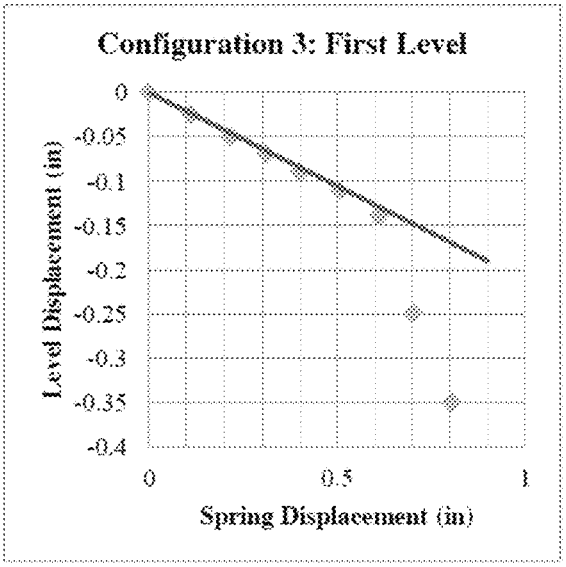
Figure 45:
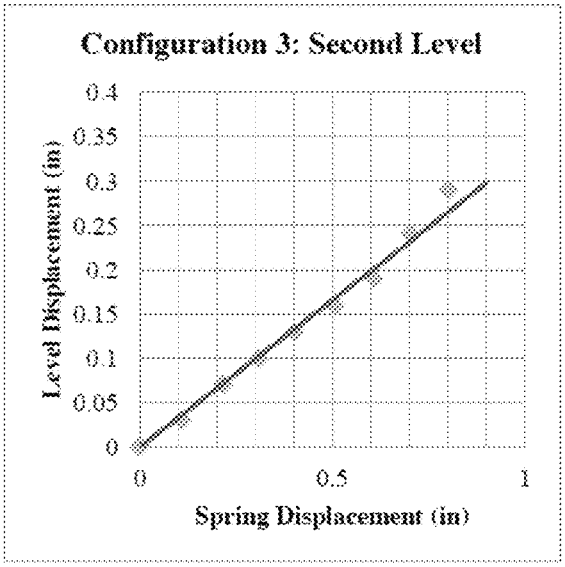

Four extensometers were used to measure the displacements in the model. Three of them measured the displacement at the three levels. The fourth one was used to measure the displacement experienced by the restoring springs. FIG. 35 shows the location of the extensometers used along the height of the model. FIG. 36 illustrates how an extensometer is connected to the restoring springs.

The test was carried out in a displacement controlled manner. The arm connected to the springs was moved away from its initial condition, thus measuring the displacement on the springs. The mechanism automatically causes all stories of the model to experience displacements, which were also measured. The test was performed for three different configurations of the model, as depicted in FIG. 37. The variation in the three configurations was the position of the fasteners that connect the pivoting arms to the vertical tube. The fastener between the first level and the base was kept constant in the same position, while the fasteners between the first, second and third levels were varied.

The test results are presented as x-y plots in FIG. 38 through FIG. 46. The results for the level displacements measured in the scale model are presented for every 0.1 inch of measured spring displacement. The relationship between level and spring displacement for the analytical model is presented with a continuous line for each level of every configuration. It can be observed that for spring displacements under 0.5 inches, the three tested configurations are in good agreement with the analytical model. After this value, a nonlinear behavior starts to emerge in the scale model. Therefore, the analytical model can be used to predict the expected displacements in the scale model up to a certain value of spring displacement. The nonlinearity after certain point presented in the scale model can be attributed to effects of constructability limitations, which can result in excessive friction between elements, unnecessary joggle of bolts, and other complications.

Dynamic Properties of Arrangement

The dynamic properties of the scale model with the passive control arrangement are studied in this chapter using the analytical model developed in SAP2000. The dynamic behavior of a structure can be understood when the natural frequencies and their corresponding vibration modes are known. Such valuable information is obtained from the analytical model of the program. Different variations were made to the model in order to explore how the dynamic behavior changes with distinct parameter configurations. The two parameters that were focused in this investigation were: a) Position of Pivoting Arm Fasteners and b) Stiffness of Restoring Spring System The dynamic properties of the different alternatives of the scale model are compared with an additional model that resembles a conventional building with the same geometric and weight characteristics.

Evaluated Alternatives

Modifying the geometric configuration of the pivoting arm fasteners and the spring stiffness provides the capability of creating a vast number of variation alternatives. Eight different alternatives of the scale model with the control arrangement are presented to study how variations in these parameters affect the dynamic properties of the model. An analytical model resembling a conventional building was also developed to be used for comparative measures.

Figure 47:
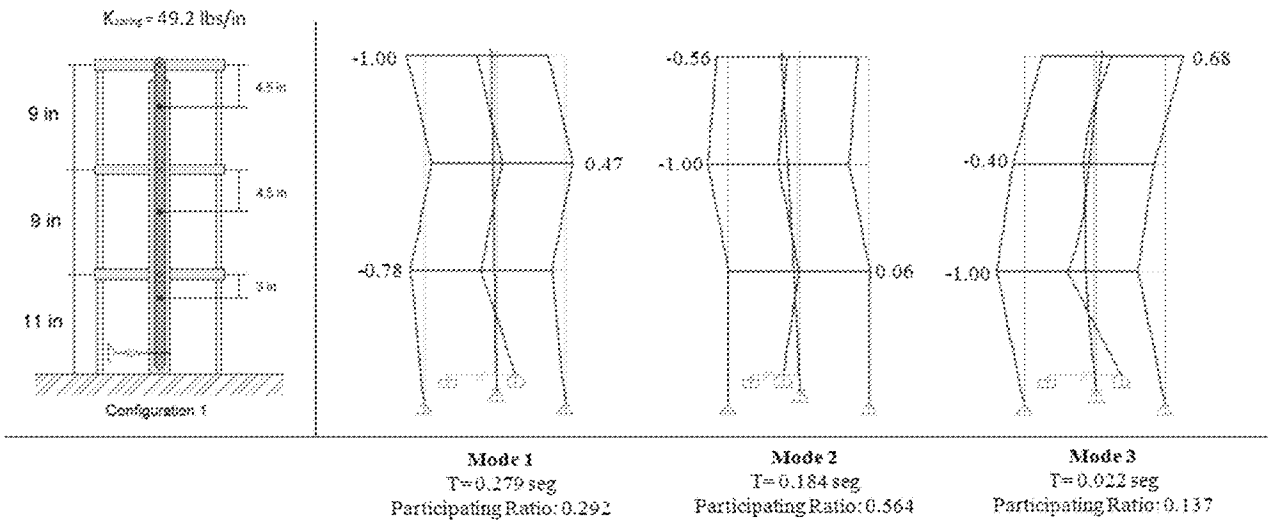
FIG. 47 shows the modal information for configuration 1, according to the present invention.

FIG. 47 will be used to explain the information displayed in the illustrations. This particular figure presents a summary of the modal information for Configuration 1. Similar information is presented for all the alternatives studied. The convention used to name the three modal periods is to start by the mode with the higher natural period. The modal participating mass ratio is also presented for each mode. It can be noticed that if all the participating ratios are added they won't reach 100 percent. Examining the case of Configuration 1, the participating ratios accumulate to a total of 0.993. The missing 0.007 necessary to achieve the value of 1 is distributed in higher vibration modes whose contribution to the overall behavior of the model can be disregarded. On account that this behavior is the same for all the variations, only the three main vibration modes are presented for each case.

Position of Pivoting Arm Fasteners

The position of the fasteners that connect the pivoting arms to the vertical tube can be modified in order to create different geometric configurations. The manner in which the floor stories are forced to move by the building arrangement depends on the geometric configuration of the pivoting arm fasteners. Therefore, the dynamic behavior of the model will change when the geometric configuration of the pivoting arm fasteners is modified. The same three configurations that were used to calibrate the analytical model were analyzed to study the different dynamic characteristics of each configuration. The stiffness value of the spring is kept constant in this section to observe uniquely the effect of the geometric configuration of the fasteners.

The modal information for the Configuration 1 is summarized in FIG. 47. The fasteners for the two higher pivoting arms were positioned exactly at the middle between levels. Examining the modal shapes, it can be observed that none of the shapes resemble the typical first mode of vibration of conventional buildings. More specifically, it can be noted that for each mode the floor with the highest displacement is different. For the first mode, the floor with the highest displacement is the third one. For the second mode the highest displacement is experienced by the second floor. Finally, the first floor has the highest displacement for the third mode. The difference between the periods for the first and second modes is almost 0.1 seconds. The difference between the second and the third mode periods is considerably more pronounced. The participating mass ratio for the second mode is considerably higher than for the two other modes. It is almost two times the participating mass ratio for the first mode, and more than four times the ratio for the third mode.

Figure 48:
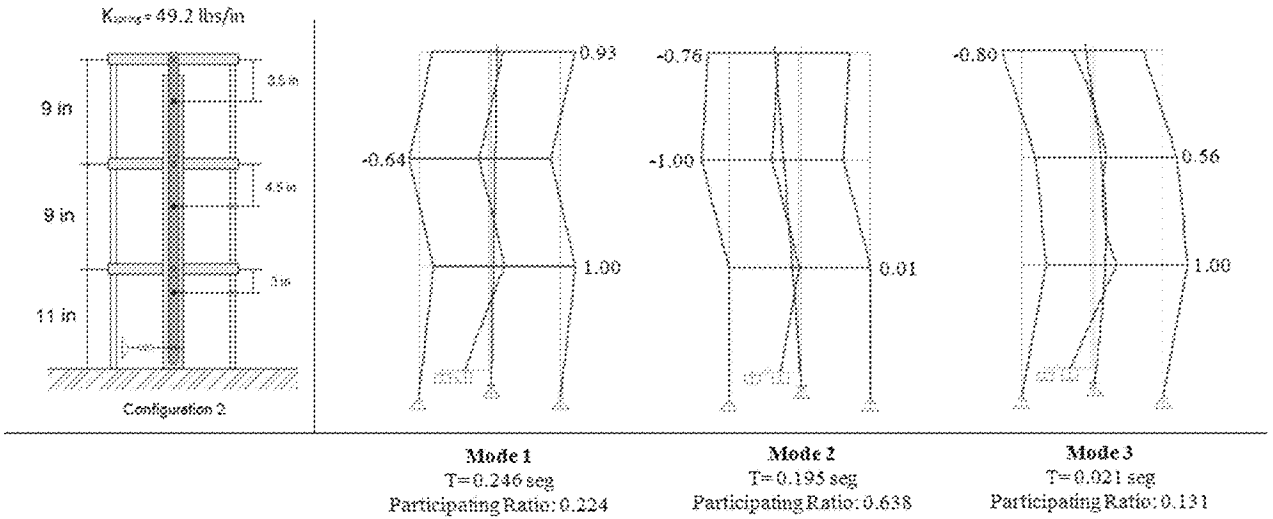
FIG. 48 shows the modal information for configuration 2, according to the present invention.

In Configuration 2 the fastener between the third and second story is located one inch upwards. As it is seen in FIG. 48, this simple variation has noticeable effects in the dynamic characteristics of the model. The modal shapes for all modes are different from the Configuration 1 shapes. For the first mode, the level with the highest displacement changed from the top level to the first one. Although the floor with the highest displacement for the other two modes remained the same when compared with Configuration 1, a difference of the other levels displacements is observable. The periods for the first and second mode were affected considerably. The period for the first mode decreased, while the period for the second mode increased. This change in both periods decreased the gap between them from 0.1 seconds for Configuration 1 to 0.05 seconds in Configuration 2. On the other hand, no major change is observed in the period or the participating mass ratio for the third mode. However, the participating ratios for the first and second modes were altered. The participating mass ratio for the second mode of vibration increased while the ratio for the first mode decreased.

Figure 49:
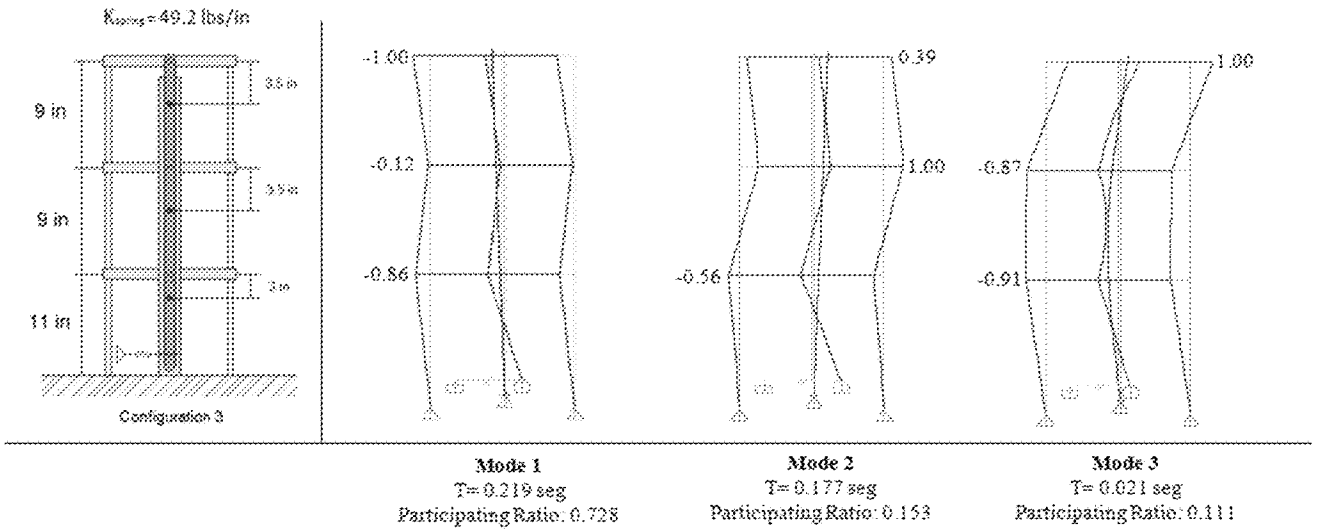
FIG. 49 shows the modal information for configuration 3, according to the present invention.

For Configuration 3, the fastener between the second and first level is also moved one inch upwards. As seen in FIG. 49, this variation changes the dynamic behavior of the model as well. The modal shapes are different from Configuration 1 and Configuration 2, although a relationship between them cannot be clearly established. The periods for the first and second mode were also affected. The first mode period was further decreased when compared to the other two configurations. The participations ratios were changed as well. It can be observed that different from the other two configurations, the mode with the higher participating mass ratio for this configuration is the first mode of vibration.

The results presented for these three alternatives demonstrate that changing the position of the fasteners will result in different dynamic properties for the model. The position of the fasteners affects the modal shapes, period and participating mass ratio. The period and participating mass ratio for the third mode remains almost unchanged if compared to the extent in which the period and participating ratio of the first and second mode are affected.

Stiffness of Restoring Spring System

Here, Configuration 1 is analyzed with different values of stiffness for the restoring spring system. The objective is to evaluate how the variation in stiffness affects the dynamic behavior of the model. Three different variations were selected. One alternative double the stiffness value of the spring, the second alternative reduces the stiffness value to half the original value, and the last alternative uses the minimum value for spring stiffness calculated using equation 44.

Figure 50:
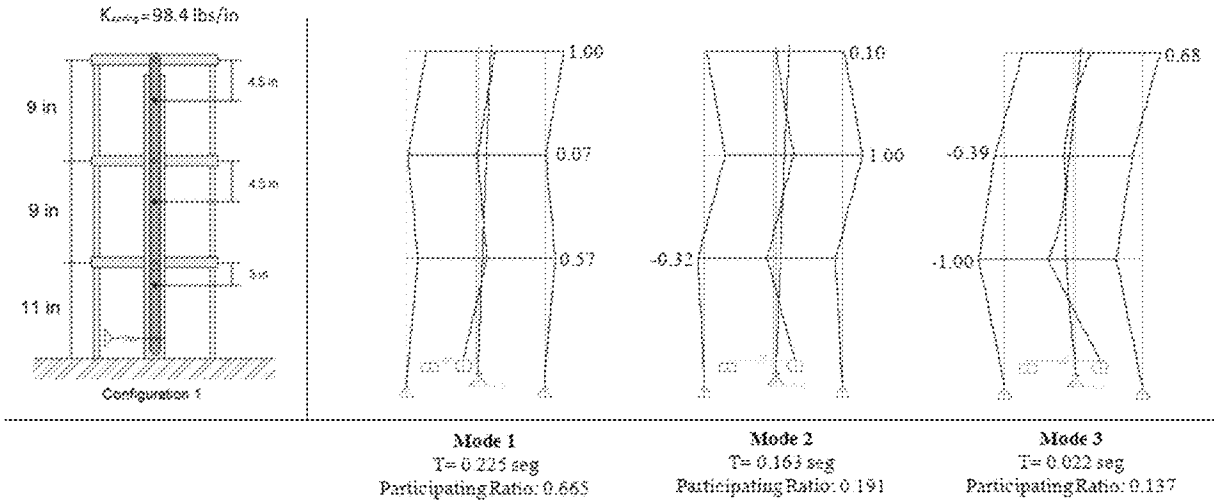
FIG. 50 shows the modal information for configuration 1 with double spring stiffness, according to the present invention.

The first alternative presented in FIG. 50 corresponds to the geometric Configuration 1 but with double the spring stiffness value (98.4 lbs/in). The dynamic behavior is considerably different from the original Configuration 1. All the modal shapes are different, although it can be noted that similarly to the original configuration, the level with the highest displacement is different for each mode. The vibration mode with the highest participating mass ratio is now the first one, in contrast with the original configuration in which it was the second mode. The third mode has the same values of period and participating mass factor in both alternatives of the Configuration 1.

Figure 51:
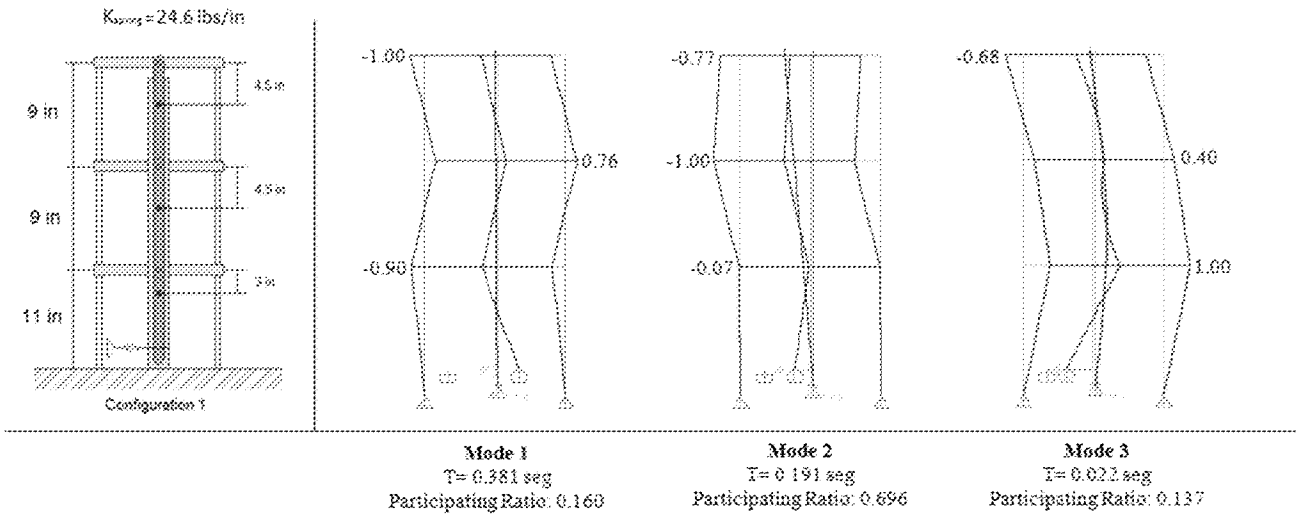
FIG. 51 shows the modal information for configuration 1 with spring stiffness halved, according to the present invention.

The second alternative evaluated in this section reduces the spring stiffness to 24.6 lbs/in, half the stiffness of the original Configuration 1. It can be observed in FIG. 51 that the reduction in spring stiffness has a considerable effect in the dynamic properties of the model. The modal shapes are different than those of the two other alternatives of Configuration 1, although the pattern of having a different floor level with the highest displacement for each mode remains the same. Compared with the other two alternatives for Configuration 1, the difference between the first and second mode periods is considerably more marked. The difference between them in this case is 0.19 seconds, whereas for the original Configuration 1 it was 0.095. The bigger the difference between the first and second mode periods is more favorable for the development of the control arrangement, since it provides a wider range of alternatives for dynamic design. However, the participating mass ratio for Mode 1 was reduced from 0.292 to 0.16 and for Mode 2 it was increased from 0.594 to 0.696. This means that even though the first mode period was moved away from the range of 0.15-0.25 seconds, its effect on the overall response of the structure is reduced. Therefore, the decrease in the participating mass ratio of Mode 1 is not very favorable to the development of the control arrangement.

The other alternative considered for Configuration 1 provides the minimum value of spring stiffness, calculated according to equation 44. In the case of Configuration 1, the minimum value for the spring stiffness is 13.12 lbs/in. The purpose of testing this alternative is that it represents a limiting condition of the effect the spring stiffness can have, since the spring cannot be further reduced from the minimum value.

Figure 52:
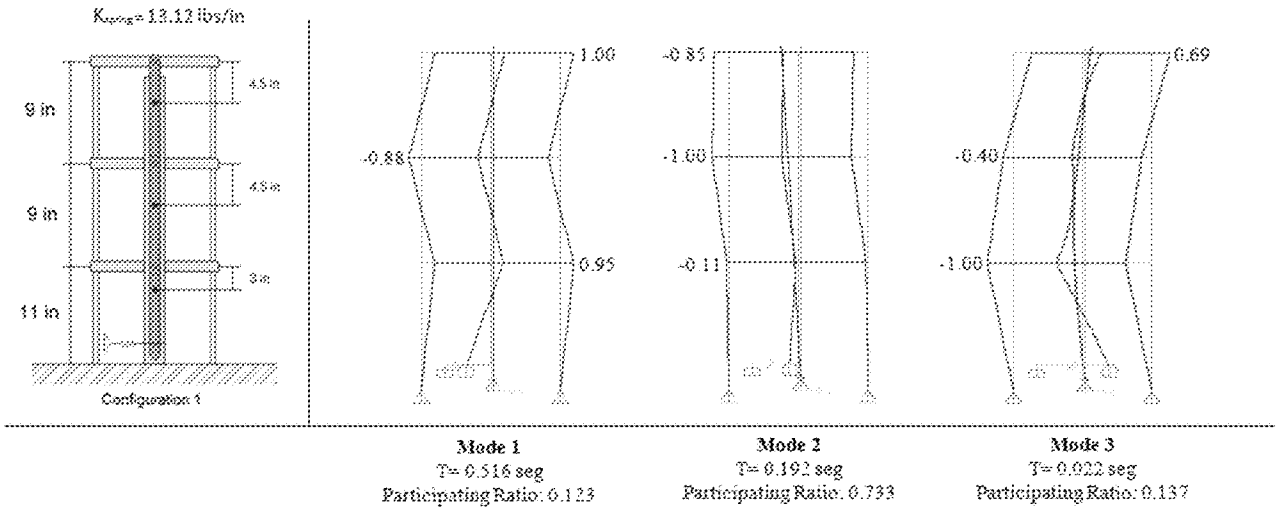
FIG. 52 shows the modal information for configuration 1 with minimum spring stiffness, according to the present invention.

The results of the Configuration 1 with the minimum spring stiffness are presented in FIG. 52. It can be observed that this alternative also presents the behavior of having a different floor level with maximum displacement for each modal shape. This suggests that this behavior is characteristic for the Configuration 1, since it remains constant for the different spring stiffness values. The period for the first mode of the model was increased even more for this alternative, going above 0.5 seconds. However, it is the only alternative in which the participating mass ratio for Mode 1 is even lower than the ratio for Mode 3. This means that even when this alternative was able to almost double the first mode period, its effect on the response of the model is considerably reduced by the low participating mass ratio.

Relationships between the dynamic behavior of the model and the spring stiffness values can be established when the results are examined. Based on the results summary presented here in Table 5-1, it can be observed that when the spring stiffness is reduced, the first mode period tends to rise. However, the participating mass ratio for the first mode decreases when the stiffness value is reduced. It can be observed that the second mode period also increases when the spring stiffness value is reduced, although to a lesser extent when compared to the increment observed for the first mode. Differently from the first mode, the participating mass ratio for the second mode increases when the stiffness value is reduced. It can be noted that the third mode properties were not affected by the spring stiffness whatsoever.

TABLE 8

| Alternative | Spring Stiffness (lbs/in) | Mode 1 Period T (sec) | Mode 1 Participating Ratio | Mode 2 Period T (sec) | Mode 2 Participating Ratio | Mode 3 Period T (sec) | Mode 3 Participating Ratio |
|---|---|---|---|---|---|---|---|
| Conf. 1-2K | 98.4 | 0.225 | 0.665 | 0.163 | 0.191 | 0.022 | 0.137 |
| Conf. 1 | 49.2 | 0.279 | 0.292 | 0.184 | 0.564 | 0.022 | 0.137 |
| Conf. 1-K/2 | 24.6 | 0.381 | 0.160 | 0.191 | 0.696 | 0.022 | 0.137 |
| Conf 1-K min | 13.12 | 0.516 | 0.123 | 0.192 | 0.733 | 0.022 | 0.137 |

Alternatives Varying Both Parameters

Two more alternatives were tested in this section in which both parameters where changed simultaneously. The spring stiffness was reduced to 24.6 lbs/in, half the original stiffness, for both Configuration 2 and Configuration 3. The purpose of this section is to prove that when both parameters are combined, the dynamic properties are also expected to change. Determining a clear relationship of how both parameters interact which can lead to predicting results is outside the scope of this investigation.

presented in Table 9. When the spring stiffness is reduced in the three configurations, the first mode period is increased. On the contrary, the participating ratio decreases when the spring stiffness is reduced. For the second mode the behavior is different. The mode period sees a less dramatic increment when the spring stiffness is reduced; however, the participating ratio increases considerably when the spring stiffness is reduced. Contrary to the other two modes, the mode 3 does not reflect any change in the mode period and participating ratio when the spring stiffness is reduced.

TABLE 9

| Alternative | K spring Stiffness (lbs/in) | Mode 1 Period (sec) | Mode 1 Participating Ratio | Mode 2 Period (sec) | Mode 2 Participating Ratio | Mode 3 Period (sec) | Mode 3 Participating Ratio |
|---|---|---|---|---|---|---|---|
| Conf. 1 | 49.2 | 0.279 | 0.292 | 0.184 | 0.564 | 0.022 | 0.137 |
| Conf. 1-K/2 | 24.6 | 0.381 | 0.160 | 0.191 | 0.696 | 0.022 | 0.137 |
| Conf. 2 | 49.2 | 0.246 | 0.224 | 0.195 | 0.638 | 0.021 | 0.131 |
| Conf. 2-K/2 | 24.6 | 0.341 | 0.085 | 0.199 | 0.778 | 0.021 | 0.131 |
| Conf. 3 | 49.2 | 0.219 | 0.728 | 0.177 | 0.153 | 0.021 | 0.111 |
| Conf. 3-K/2 | 24.6 | 0.281 | 0.258 | 0.19 | 0.624 | 0.021 | 0.111 |

Figure 53:
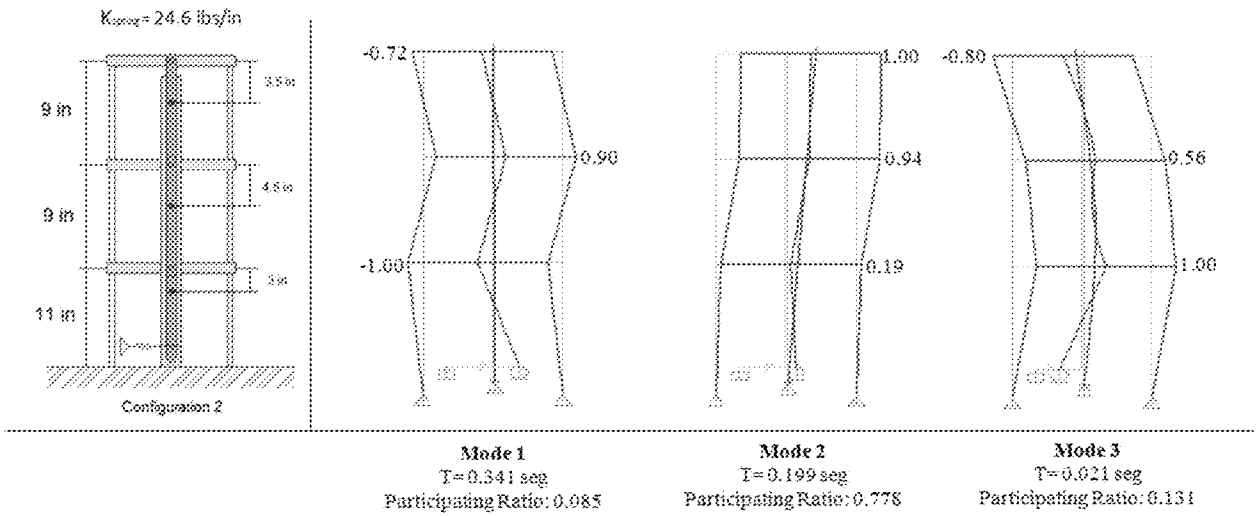
FIG. 53 shows the modal information for configuration 2 with half the spring stiffness, according to the present invention.

The modal information for the model of Configuration 2 with half spring stiffness (Conf. 2-K/2) is presented in FIG. 53. The mode shapes for this alternative are different from the ones of the original Configuration 2 presented in FIG. 48. The period for the first mode increased from 0.246 seconds for the original configuration to 0.341 seconds for Conf. 2-K/2. The participating ratio for the first mode decreased from 0.224 to 0.08. The second mode period experienced a slight increment of 0.004 seconds. However, the participating ratio for the second mode increased from 0.638 in Configuration 2 to 0.778 in Conf. 2-K/2. The third mode did not experience any change for mode period or participating ratio.

Figure 54:
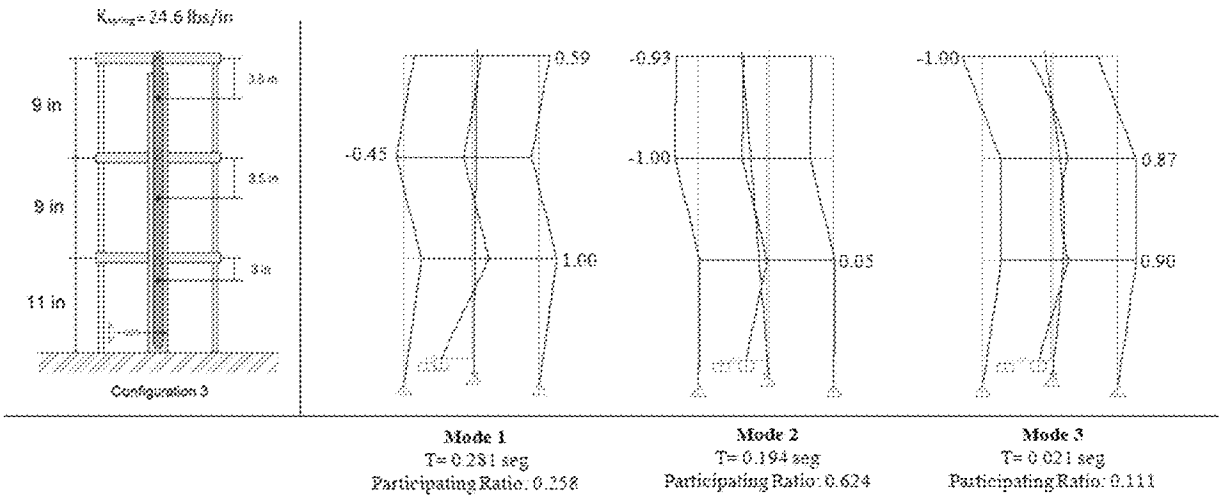
FIG. 54 shows the modal information for configuration 3 with half the spring stiffness, according to the present invention.

The modal information for Configuration 3 with the spring stiffness reduced to half (Conf. 3-K/2) is presented in FIG. 54. The mode shapes for the first two modes are noticeable different from the modal shapes presented in FIG. 49 for the original Configuration 3. The first mode period increased from 0.219 seconds in the original Configuration 3 to 0.281 seconds in Conf. 3-K/2. The participating ratio for this mode decreased from 0.728 to 0.258. The second mode period saw an increase from 0.177 seconds in the original Configuration 3 to 0.194 seconds in Conf. 3-K/2. On the contrary, the participating ratio for this mode increased from 0.153 to 0.624. Similar to the other two configurations, the third mode period and participating ratio was not affected by the change in spring stiffness.

The reduction in spring stiffness has similar effects in the dynamic properties of the three configurations tested. This can be better appreciated when looking at the information The results presented in this section indicate that both the geometric configuration of the swinging arm fastener and the spring stiffness have a simultaneous effect in the dynamic behavior of the model. The alternatives tested in this section do not provide sufficient results to predict the manner in which modifying both parameters simultaneously affect the dynamic properties. However, it can be established that the effects of reducing the spring stiffness are similar independently for the geometric configuration of the swinging arm fasteners. Furthermore, it can be appreciated that when the spring stiffness is reduced, the first mode period is consistently increased, but the participating ratio of the second mode increases considerably. This indicates that even when the first mode period can be significantly changed, its effect on the overall response of the model is diminished by the increased participation factor of the second mode.

Comparative Model Resembling a Conventional Building

A variation of the scale model resembling a conventional building was tested with the SAP2000 program for comparative purposes. The purpose of the comparative model is to resemble a conventional building with similar material, weight and geometric characteristics as the constructed scale model. Similarities in these aspects allow correlating the results from the conventional building with the results of the scale model with the control arrangement. The correlation between these results can be used to determine benefits and disadvantages of the proposed passive control building arrangement.

Figure 55:
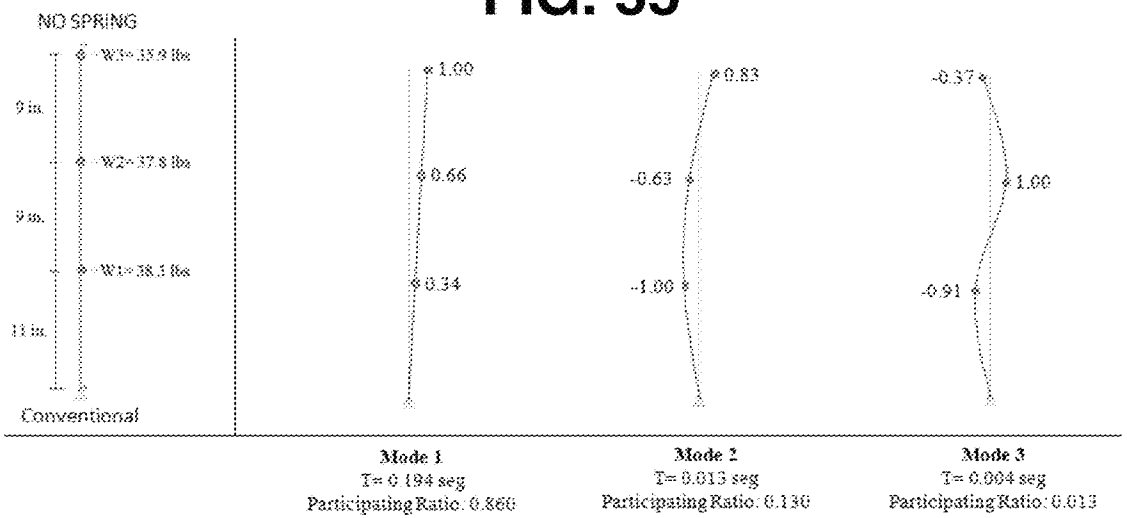
FIG. 55 shows modal information for the model resembling a conventional building, according to the present invention.

The comparative model resembling a conventional building consists of testing only the vertical cantilever tube with masses simulating the contribution of the structure's different levels. This is a representation of a conventional building in which all the lateral loads are transferred to the vertical core. The model with the assigned masses per level is presented in FIG. 55. This figure also presents the same modal information that was presented for the previously discussed alternatives. It can be noted that the first mode, with a period of 0.194 seconds, has the highest participating ratio value with 0.849. The other two modes have very low periods and participating ratios. Therefore, the seismic response of the conventional building will be governed by the first mode characteristics.

Observing the summary presented in Table 10, it can be determined that the first mode period of 0.194 seconds for the conventional building is similar to the periods for the second vibration mode of the alternatives with the control arrangement. The average value of the second mode period for all the evaluated models with the control arrangement is 0.187 seconds, just 0.007 seconds apart of the first mode period of the conventional building. For the first mode periods, it can be seen that models with the control arrangement have a higher first mode period than the conventional mode. It can also be observed that the first mode of the conventional building presents the highest participating ratio of all the evaluated alternatives. Therefore, this alternative is the only one whose seismic response is expected to be governed by one vibration mode only. The seismic response for the alternatives with the control arrangement is expected to be controlled by the first and second vibration modes.

TABLE 10

| | | Mode 1 | | Mode 2 | | Mode 3 | |
|---|---|---|---|---|---|---|---|
| Alternative | K spring (lbs/in) | Period (sec) | Participating Ratio | Period (sec) | Participating Ratio | Period (sec) | Participating Ratio |
| Conventional | % | 0.194 | 0.860 | 0.013 | 0.130 | 0.004 | 0.013 |
| Conf. 1 | 49.2 | 0.279 | 0.292 | 0.184 | 0.564 | 0.022 | 0.137 |
| Conf. 2 | 49.2 | 0.246 | 0.224 | 0.195 | 0.638 | 0.021 | 0.131 |
| Conf. 3 | 49.2 | 0.219 | 0.728 | 0.177 | 0.153 | 0.021 | 0.111 |
| Conf. 1-2K | 98.4 | 0.225 | 0.665 | 0.163 | 0.191 | 0.022 | 0.137 |
| Conf. 1-K/2 | 24.6 | 0.381 | 0.160 | 0.191 | 0.696 | 0.022 | 0.137 |
| Conf. 1-K min | 13.12 | 0.516 | 0.123 | 0.192 | 0.733 | 0.022 | 0.137 |
| Conf. 2-K/2 | 24.6 | 0.341 | 0.085 | 0.199 | 0.778 | 0.021 | 0.131 |
| Conf. 3-K/2 | 24.6 | 0.281 | 0.258 | 0.194 | 0.624 | 0.021 | 0.111 |

Conclusions from Modal Information of Evaluated Alternatives

The modal information obtained from the eight evaluated alternatives of the model with the control arrangement and the additional comparative model resembling a conventional building makes it possible to draw the following conclusions.

The position of the swinging arm fasteners has a direct effect on the dynamic properties of the model. Each geometric configuration has unique modal shapes, mode periods and mode participating ratios. The period and participating ratio for the third vibration mode are the ones less affected by the geometric configuration of the swinging arm fasteners. Modifying the stiffness value of the restoring spring system for the Configuration 1 affects the dynamic characteristics of the first and second vibration modes of the model. A reduction in the spring stiffness will result in an increment for the first mode period but a reduction in the Modal Participating Mass Ratio for the mode. In the case of the second vibration mode, the reduction in the spring stiffness will result in a less dramatic increment of the mode period, while a notable increase in the participating ratio. Reducing the spring stiffness in half for Configuration 2 (Conf. 2-K/2) and Configuration 3 (Conf. 3-K/2) presented similar results to the Configuration 1 with half spring stiffness (Conf. 1-K/2). The reduction in spring stiffness resulted in an increase of the first and second mode periods. The increment experienced by the first mode period is considerably higher than the one experienced by the second mode. However, the reduction in the spring stiffness augmented the second mode participating ratio while reducing the first mode participating ratio. Modifying the stiffness value for the restoring spring system did not affect the third mode period or participating ratio for any of the three geometric configurations tested. The first vibration mode for all the alternatives with the control arrangement is higher than the first vibration mode of the comparative model resembling a conventional building.

Seismic Response Evaluation

It was previously demonstrated that the passive control building arrangement presented in this investigation can modify the dynamic behavior of a structure. We now intend to prove that the modification capabilities of the proposed arrangement can be used to reduce the seismic response of a structure. Different ground motion records were used to simulate earthquake tests and evaluate the seismic response of various proposed alternatives of the scale model with the control arrangement. The model resembling a conventional building was also evaluated to be used as a comparative guideline. The earthquake tests were simulated via time history analysis in the SAP2000 program. Data for peak acceleration, peak interstory drift ratio and peak base shear is presented for every evaluated alternative.

Selection of Ground Motion Records

Figure 57:
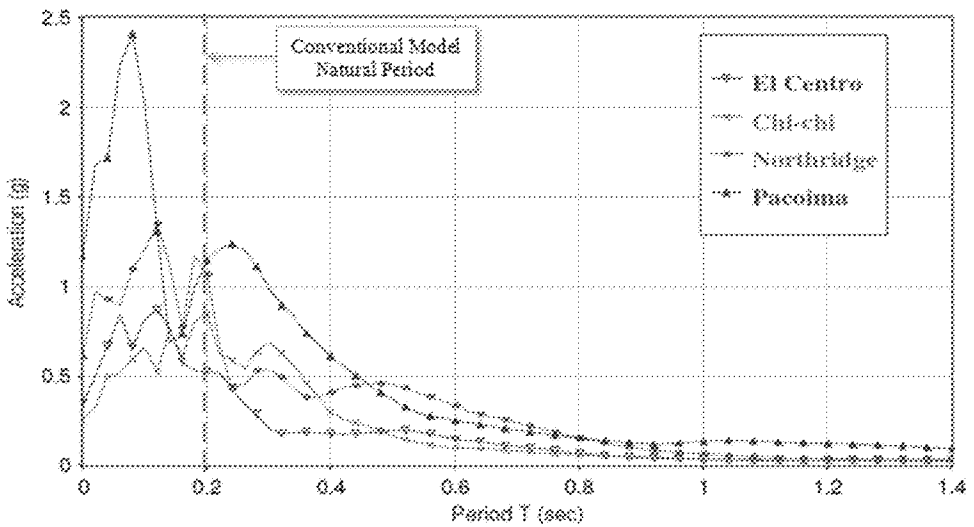
FIG. 57 shows a plot of earthquakes response spectra with 5% of critical damping, according to the present invention.
Figure 56:
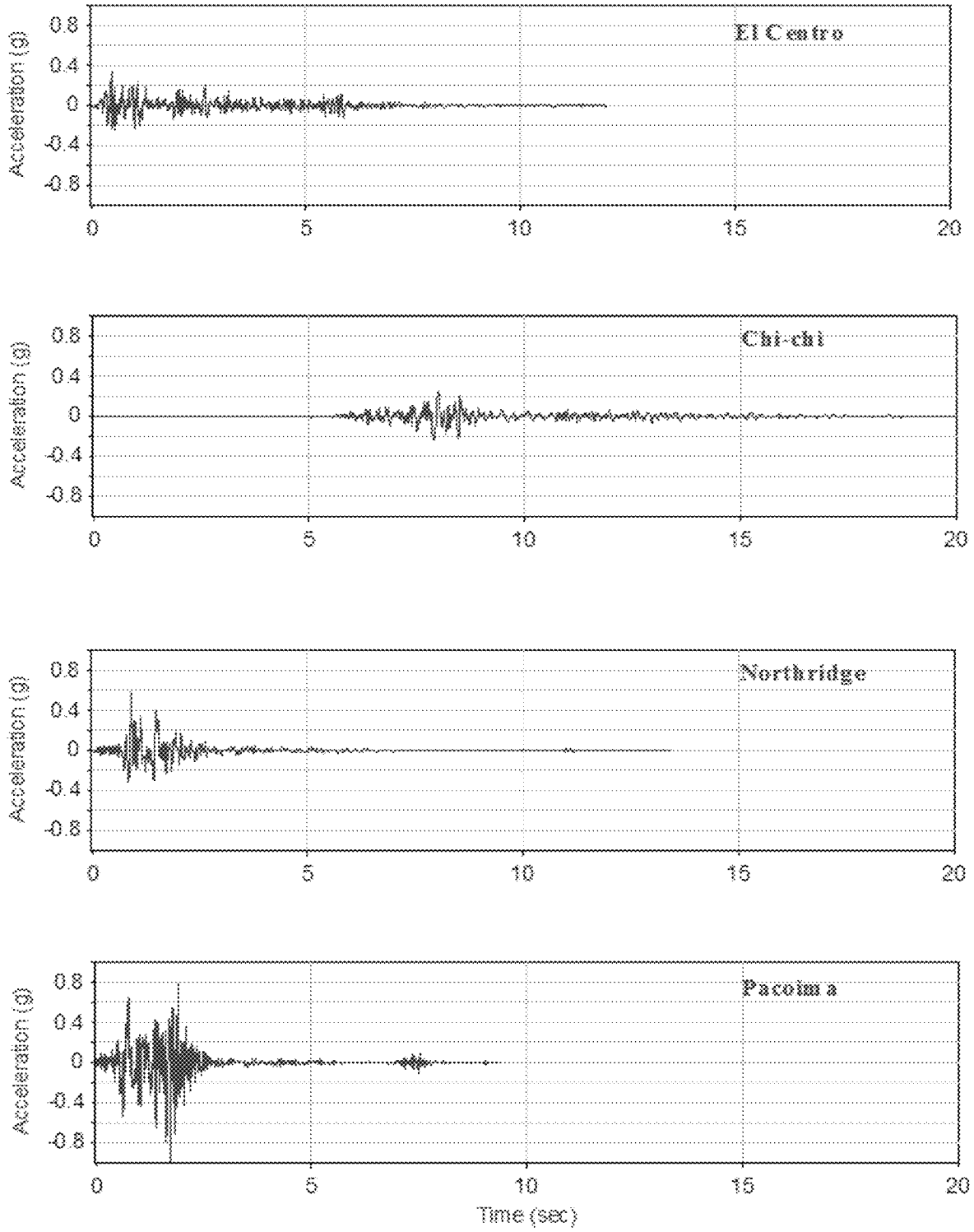
FIG. 56 shows time-scaled earthquakes ground motion records, according to the present invention.

Four ground motion records were selected to use in the earthquake tests. In order to comply with time similitude requirements, the records had to be scaled down with a scale factor for time ($t_r$) of $1/\sqrt{1_r}=1/\sqrt{20}$. When selecting the earthquakes, it was intended that the dominant frequency content of the scaled earthquake records should be within the range of the comparative building first period. Characteristic information of the selected earthquakes is presented in Table 11 below. The last two columns present the dominant period for the original record and for the scaled record used in the actual tests. The scaled ground motion records used for the earthquake tests are presented in FIG. 56, while the response spectra are presented in FIG. 57. The ground motion records were obtained from the Pacific Earthquake Engineering Research Center (PEER) Ground Motion Database.

TABLE 11

| Record Name | Earthquake Date And Component | Peak Acceleration (g) | Original Record Dominant Period (secs) | Scaled Record Dominant Period (secs) |
|---|---|---|---|---|
| ELCS00E | 1940 El Centro, S00E | 0.348 | 0.53 | 0.12 |
| CHY035W | 1999 Chi-Chi, 035W | 0.252 | 0.89 | 0.20 |
| SYL090 | 1994 Northridge, 090 | 0.604 | 0.53 | 0.12 |
| PACS16E | 1971 Pacoima, 516E | 1.171 | 0.40 | 0.09 |

Proposed Alternatives for Seismic Control

Figure 58:
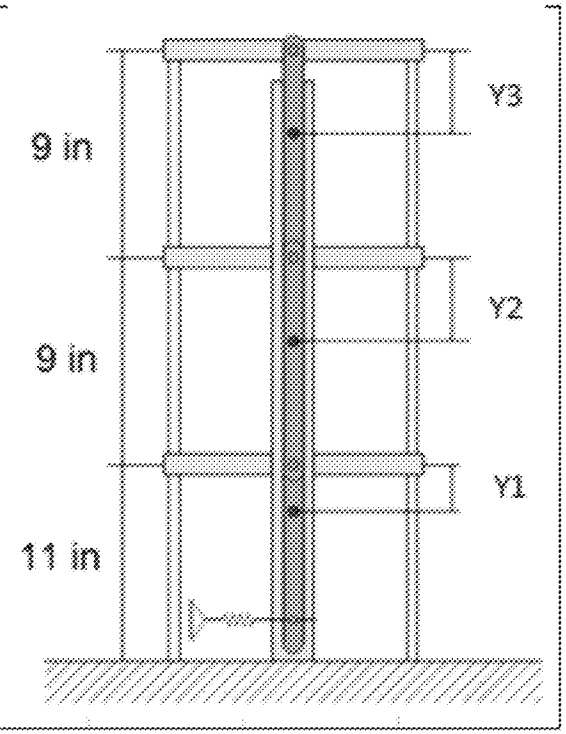
FIG. 58 illustrates the description of tested alternatives, according to the present invention.

A search process was conducted to find a combination of parameters (restoring spring stiffness and position of pivoting arm fasteners) that resulted in a model with the potential of improving the scale model seismic response. Two alternatives are proposed in this section that possess characteristics for improving the seismic response. A summary of the properties of the alternatives is presented in FIG. 58. It should be pointed out that the process of finding these two alternatives was carried out by a trial and error process. These alternatives fulfill the expected benefits of the arrangement but do not necessarily represent the optimal selection of parameters that could be achieved if a more rigorous mathematical process was followed.

It can be observed that the fasteners position was dramatically modified for both proposed configurations. The fastener between the second and third level was moved downwards, while the fastener between the first and second level was moved upwards. This means that these two fasteners are just five inches apart for both configurations. The fastener between the base and first level was also modified, moving it downwards closer to the ground. The spring stiffness for PROP 1 was reduced to its minimum, while the spring stiffness for PROP 2 was left the same at 49.2 lbs/in.

Figure 59:
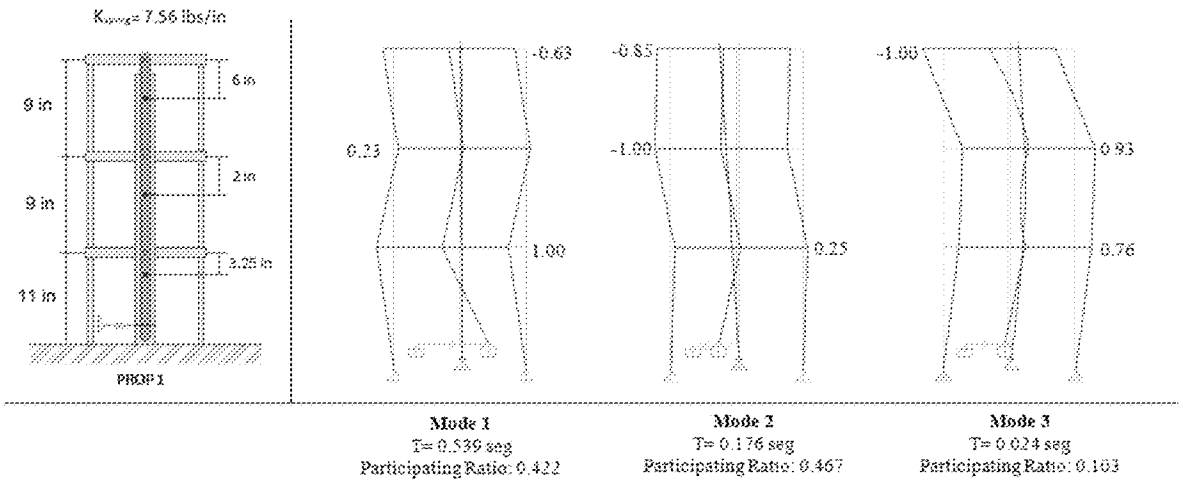
FIG. 59 shows modal information for PROP 1, according to the present invention.
Figure 60:
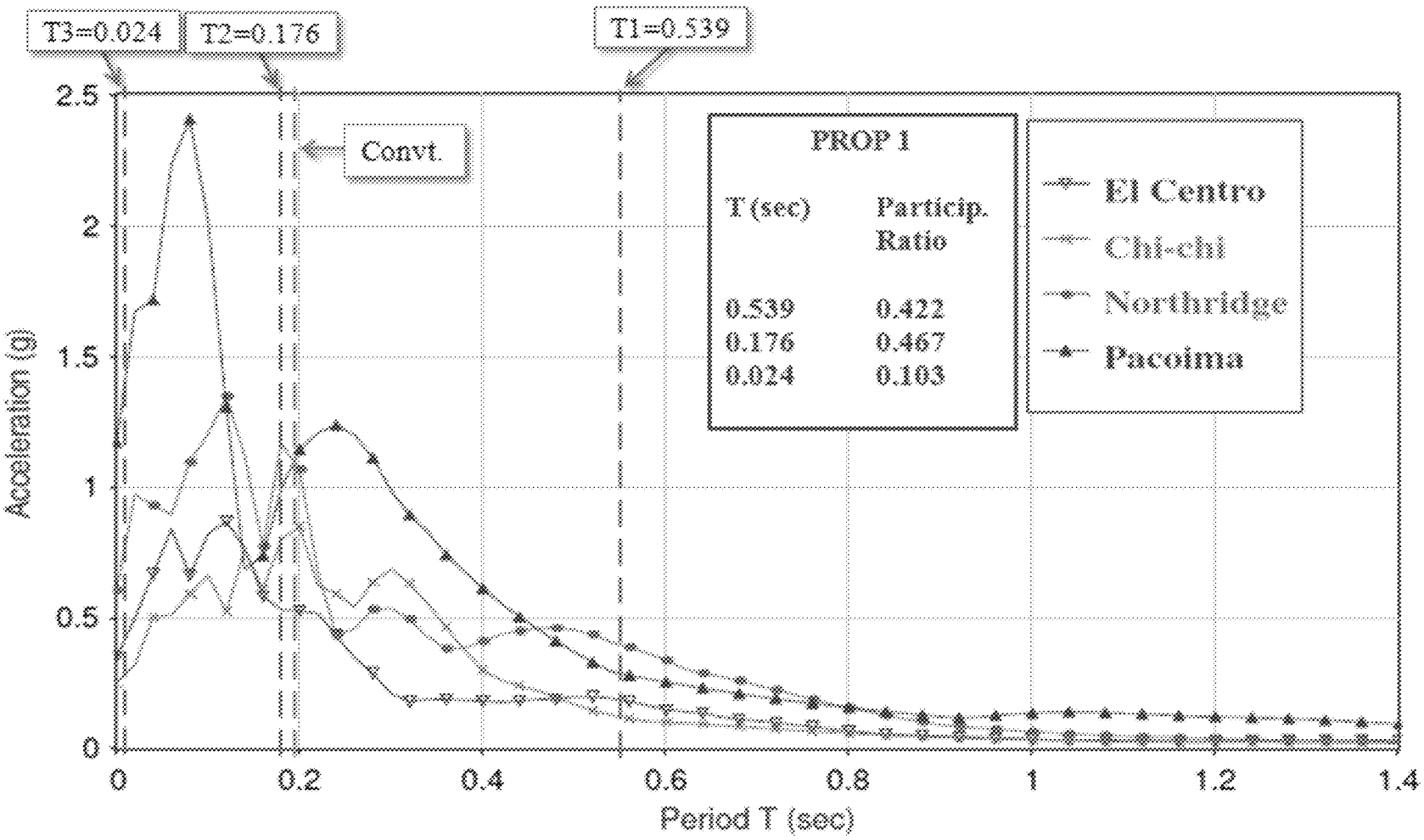
FIG. 60 shows response spectra with natural periods for PROP 1, according to the present invention.

The modal information for the first proposed alternative, PROP 1, is presented in FIG. 59. The three modal periods are identified in the earthquakes response spectra that is presented in FIG. 60. It can be observed that the first mode period of this alternative was increased considerably, moving it away from the different earthquakes spectra peak. The second mode period is similar to the conventional model natural period; however, the participating mass ratio for this mode was reduced to only 0.467. This implies that the modal participating mass ratio was distributed between the first and second mode. It can be noted that the modal shapes look similar to the ones previously presented, in which the floor level with the highest displacement is not always the top one.

Figure 61:
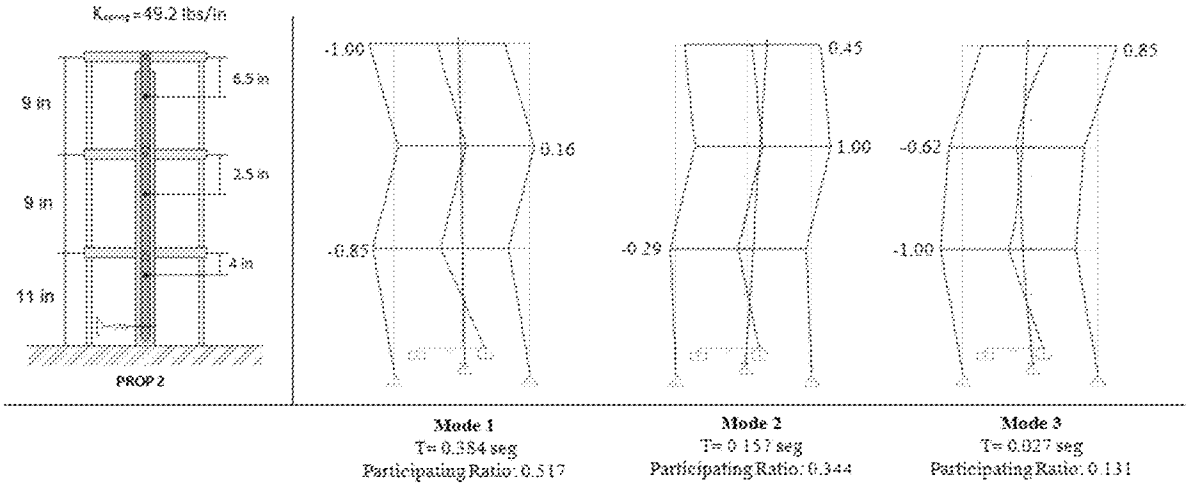
FIG. 61 shows modal information for PROP 2, according to the present invention.
Figure 62:
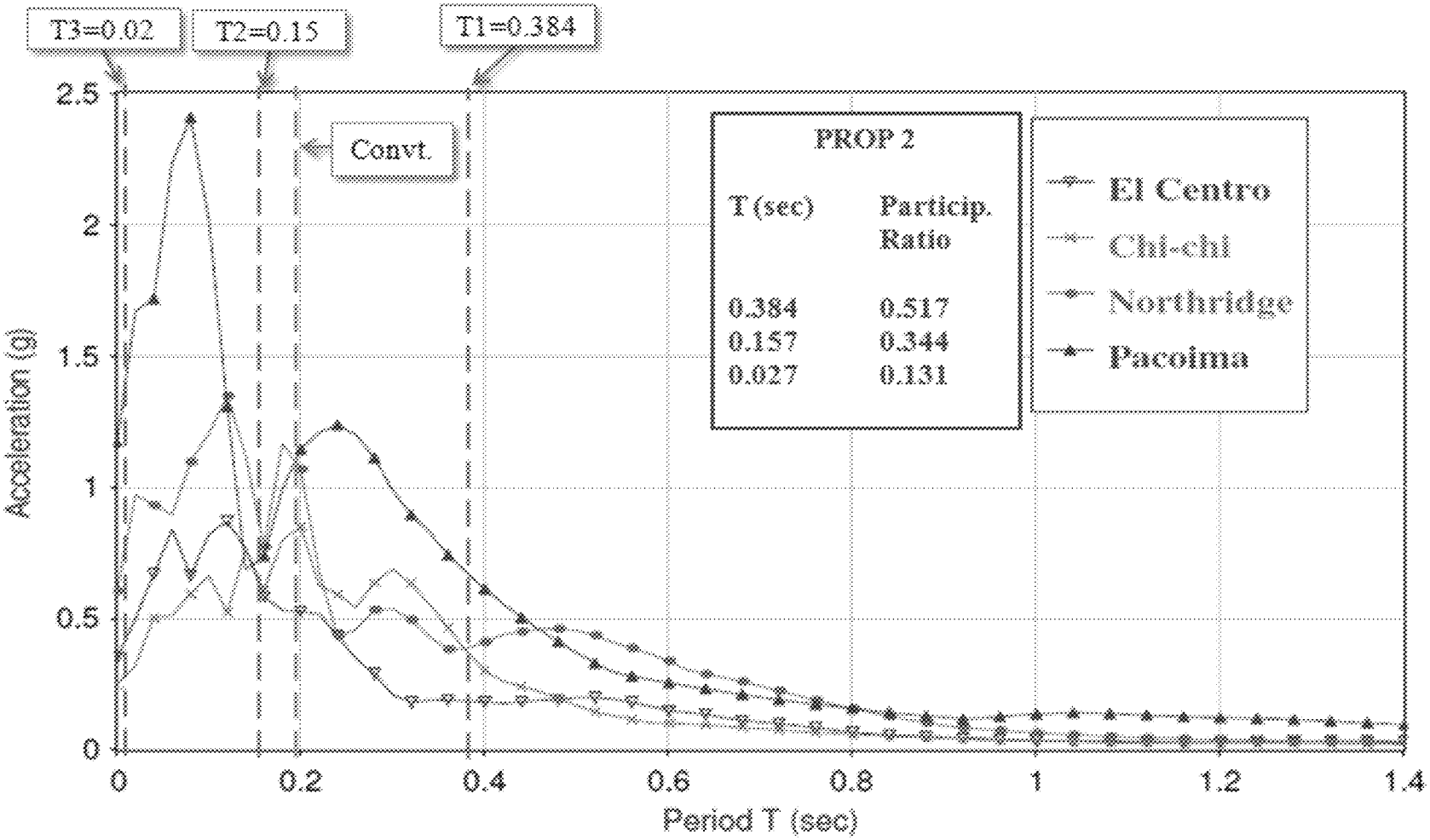
FIG. 62 shows response spectra with natural periods for PROP 2, according to the present invention.

FIG. 61 presents the modal information for the second configuration, PROP 2. The earthquakes response spectra presented in FIG. 62 shows the modal periods for this configuration. It can be observed that the first mode period for this alternative was also increased, but not to the same extent as the PROP 1 alternative. However, the participating mass ratio for the first mode in this alternative is higher than the ratio for the PROP 1 first mode. This implies that in this alternative, the dominant mode in terms of modal participating mass ratio is the first mode.

Simulated Earthquake Tests Results

All the alternatives were tested with the scaled earthquake records via time history analysis with the SAP2000 software. The results are summarized through tables that present results for Peak Accelerations, Peak Interstory Drift Ratios and Peak Shear and Moment at the base of the vertical tube. Direct comparisons are made between the alternatives and the conventional model.

Peak Acceleration Results

The accelerations were retrieved at every floor level of the model for all tested alternatives. The peak acceleration per level is presented for all the alternatives in Table 12. It can be observed that for all tested earthquakes, the peak accelerations of the conventional model have a clear tendency of being higher in the upper levels. On the contrary, this tendency is not constant for any of the two alternatives of the model with the control arrangement. In fact, the level with the peak acceleration of the overall structure is not always the upper level, since in most cases the second level has the highest peak of the overall structure. However, it can be observed that the peak acceleration of the overall structure for the two proposed alternatives is lower when compared to the peak acceleration of the conventional structure. For the earthquake El Centro, the peak acceleration was reduced from 0.749 g in the conventional model to 0.527 g in PROP 1 alternative, and to 0.707 g in the PROP 2 alternative. For the Chi-Chi earthquake, the peak acceleration was reduced from 1.109 g in the conventional model to 0.790 in the PROP 1 alternative and to 0.612 g in the PROP 2 alternative. It can be observed that even though both alternatives reduced the peak acceleration, the alternative PROP 1 was more effective doing so in the El Centro earthquake while the PROP 2 alternative was more effective doing it in the Chi-Chi earthquake. Nevertheless, the significant finding is that the peak acceleration of the scale model was reduced by both alternatives for every tested earthquake.

TABLE 12

| | | Peak Acceleration per Level (g) | | |
|---|---|---|---|---|
| Earthquake | Level | Conventl. | PROP 1 | PROP 2 |
| El Centro | 3rd | 0.749 | 0.527 | 0.392 |
| PGA = 0.348 | 2nd | 0.498 | 0.531 | 0.707 |
| | 1st | 0.304 | 0.291 | 0.411 |
| Chi-Chi | 3rd | 1.109 | 0.648 | 0.523 |
| PGA = 0.252 | 2nd | 0.758 | 0.790 | 0.612 |
| | 1st | 0.443 | 0.256 | 0.418 |
| Northridge | 3rd | 1.525 | 0.921 | 0.600 |
| PGA = 0.604 | 2nd | 1.002 | 1.075 | 0.739 |
| | 1st | 0.635 | 0.578 | 0.467 |
| Pacoima | 3rd | 1.432 | 0.986 | 1.220 |
| PGA = 1.171 | 2nd | 1.041 | 1.063 | 0.809 |
| | 1st | 0.848 | 0.770 | 1.211 |

Peak Interstory Drift Ratios

The peak interstory drift ratios were recorded for all earthquakes between all the levels of the tested models. The highest interstory drift ratio measured between all the levels are presented in Table 13. For the conventional model, the highest interstory drift ratio is observed for the Northridge earthquake with 2.1%, while the lowest occurred for the El Centro earthquake with 1.0%. For the PROP 1 alternative, the highest drift ratio was also measured in the Northridge earthquake with 16.4%. This represents 7.8 times the interstory drift ratio measured for the conventional model. For the PROP 2 alternative, the peak drift ratio was reported in the Pacoima earthquake with 12.4%. This value represents 5.9 times the highest drift ratio reported in the conventional building. This implies that even though the control arrangement reduces the peak acceleration in the structure, it can significantly increase the interstory peak drift ratio.

TABLE 13

| Alternative | Peak Interstory Drift Ratio (%) | | | |
|---|---|---|---|---|
| | El Centro | Chi-Chi | Northridge | Pacoima |
| Conventional | 1.0% | 1.5% | 2.1% | 2.0% |
| PROP. 1 | 8.6% | 7.5% | 16.4% | 13.3% |
| PROP. 2 | 3.7% | 7.0% | 6.7% | 12.4% |

Peak Base Shear and Moment

The base shear and moment reactions were measured for all alternatives. The peak values are presented in Table 14 and Table 15. The highest peak reactions for the conventional model are observed for the Northridge and Pacoima earthquakes. This is also the case for the PROP 1 and PROP 2 alternatives. However, a significant reduction in base reactions can be observed when the proposed alternatives are compared with the conventional model. The base shear for the PROP 1 alternative was reduced to 46 percent of the conventional model base shear in the Pacoima earthquake. For the base moment, it was reduced to 50 percent in the same earthquake. In the case of the PROP 2 alternative, the base shear was reduced to 38 percent of the conventional model in the Chi-Chi earthquake. In the Northridge earthquake, the base moment reaction was reduced to 41 percent of the conventional model.

A characteristic of the arrangement is that no reactions are generated in the columns when lateral loads are applied. This implies that the base moment of the model is the same moment experienced in the base of the vertical tube. However, the base shear of the model is not the same shear transferred to the base by the vertical tube. The base shear is a combination of the shear transferred by the vertical tube and the reaction created by the spring system. Table 16 presents the peak values for both of these reactions. It can be noted that the peak values for the shear in the vertical tube base is considerably higher the shear transferred to the spring system.

TABLE 14

| Alternative | Peak Base Shear (lbs) | | | |
|---|---|---|---|---|
| | El Centro | Chi-Chi | Northridge | Pacoima |
| Conventional | 56.4 | 86.9 | 114.5 | 116.4 |
| PROP. 1 | 35.1 | 46.5 | 68.2 | 53.2 |
| PROP. 2 | 37.5 | 33.0 | 47.7 | 69.3 |

TABLE 15

| Alternative | Peak Base Moment (lbs-in) | | | |
|---|---|---|---|---|
| | El Centro | Chi-Chi | Northridge | Pacoima |
| Conventional | 1231.9 | 1864.0 | 2506.0 | 2410.9 |
| PROP. 1 | 812.5 | 1142.3 | 1555.5 | 1196.0 |
| PROP. 2 | 650.7 | 813.9 | 1028.7 | 1582.3 |

TABLE 16

| Alternative | Section | Peak Shear (lbs) | | | |
|---|---|---|---|---|---|
| | | El Centro | Chi-Chi | Northridge | Pacoima |
| PROP. 1 | Spring | 7.35 | 6.04 | 14.2 | 11.3 |
| PROP. 1 | Tube Base | 35.2 | 45.4 | 76.0 | 54.9 |

TABLE 16-continued

| Alternative | Section | Peak Shear (lbs) | | | |
|---|---|---|---|---|---|
| | | El Centro | Chi-Chi | Northridge | Pacoima |
| PROP. 2 | Spring | 13.5 | 26.2 | 23.5 | 45.1 |
| PROP. 2 | Tube Base | 37.4 | 49.7 | 66.6 | 100.1 |

Proposed Alternatives with Added Viscous Damper

The results previously presented indicate that the spring stiffness has a significant effect on the dynamic behavior of the structure. Changing simply one parameter will result in different dynamic properties for the model. This led to the proposition of adding a viscous damper in addition with the restoring spring system. Adding a damper in this position will result in a structure with more overall damping, and this is expected to further improve its seismic response.

Figure 63:
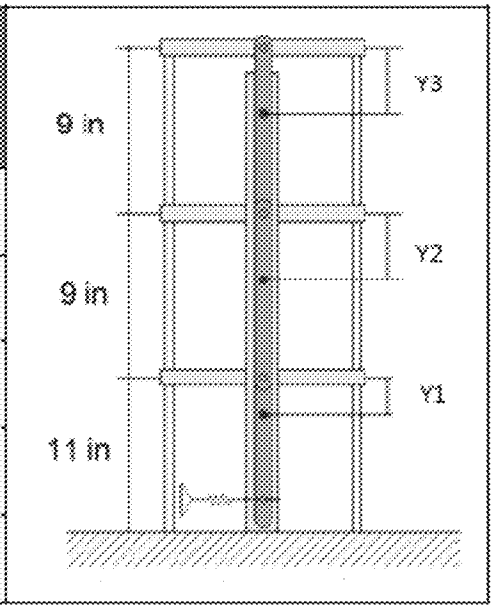
FIG. 63 illustrates the description of alternatives with an added viscous damper, according to the present invention.

Two other alternatives, denominated DAMP 1 and DAMP 2, were developed with the addition of viscous dampers. The geometric configuration of these two alternatives is similar to those of the previously tested alternatives, PROP 1 and PROP 2. A summary of the alternatives with the added viscous dampers is presented in FIG. 63.

Figure 64:
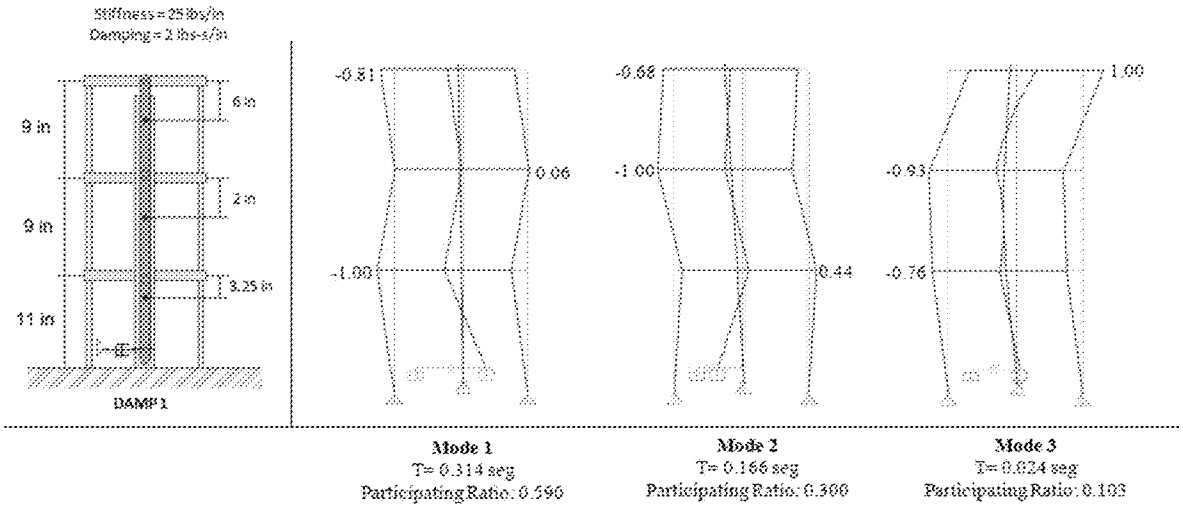
FIG. 64 shows modal information for DAMP 1, according to the present invention.
Figure 65:
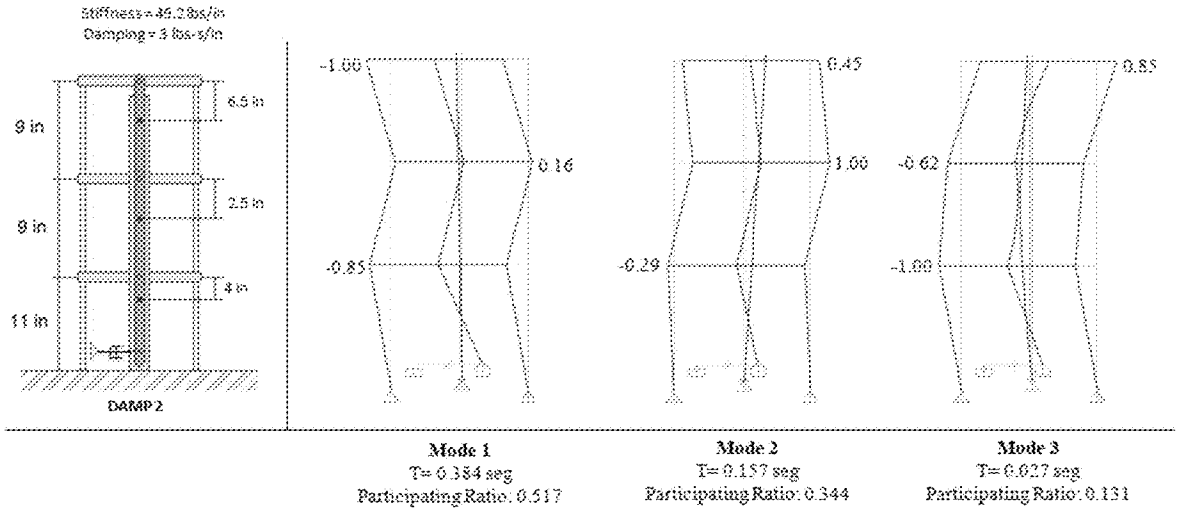
FIG. 65 shows modal information for DAMP 2, according to the present invention.

Modal information for the alternatives DAMP 1 and DAMP 2 is presented in FIG. 64 and FIG. 65. Although, alternative DAMP 1 has the same geometric configuration than PROP 1, it has different spring stiffness. This leads to different mode periods with different participating ratios. On the contrary, alternatives DAMP 2 and PROP 2 have the same geometric configuration and spring stiffness. This leads to similar dynamic properties, which can be seen by comparing FIG. 61 and FIG. 65. Therefore, the added viscous damper is expected to add damping to the structure without affecting its dynamic properties.

Peak Accelerations of Alternatives with Added Damper

The peak accelerations for all the tested alternatives are presented in Table 17. The results for the two alternatives with the addition of a viscous damper are favorable. It can be observed that the peak acceleration was reduced for all the earthquakes tested. The reduction is more prominent for the alternatives with the added damper when compared to the two originally proposed alternatives without the additional damper. This suggests that the added damper enhances the effect of improving the seismic response for the proposed control arrangement.

TABLE 17

| Earthquake | Level | Peak Acceleration per Level (g) | | | | |
|---|---|---|---|---|---|---|
| | | Convtl. | PROP 1 | PROP 2 | DAMP 1 | DAMP 2 |
| El Centro | 3rd | 0.749 | 0.527 | 0.392 | 0.473 | 0.422 |
| PGA = 0.348 | 2nd | 0.498 | 0.531 | 0.707 | 0.371 | 0.414 |
| | 1st | 0.304 | 0.291 | 0.411 | 0.188 | 0.267 |
| Chi-Chi | 3rd | 1.109 | 0.648 | 0.523 | 0.368 | 0.333 |
| PGA = 0.252 | 2nd | 0.758 | 0.790 | 0.612 | 0.368 | 0.476 |
| | 1st | 0.443 | 0.256 | 0.418 | 0.238 | 0.203 |
| Northridge | 3rd | 1.525 | 0.921 | 0.600 | 0.602 | 0.527 |
| PGA = 0.604 | 2nd | 1.002 | 1.075 | 0.739 | 0.565 | 0.602 |
| | 1st | 0.635 | 0.578 | 0.467 | 0.413 | 0.411 |
| Pacoima | 3rd | 1.432 | 0.986 | 1.220 | 0.734 | 0.698 |
| PGA = 1.171 | 2nd | 1.041 | 1.063 | 0.809 | 0.650 | 0.745 |
| | 1st | 0.848 | 0.770 | 1.211 | 0.629 | 0.862 |

Peak Interstory Drift Ratio

The peak interstory drift ratio was also measured in the alternatives with the added viscous damper. The results of drift ratio for the tested earthquakes are presented in Table 18. Some of the measured peak interstory drift ratios for the alternatives with the added viscous damper are higher than the drift ratio measured for the conventional model. However, when compared to the alternatives without the added viscous damper, the peak drift ratio is significantly reduced. The highest peak ratio for the PROP 1 alternative was reduced from 16.4% to 2.7% in the DAMP 1 alternative, representing a reduction of 83.5 percent. For the PROP 2 alternative, the drift ratio was reduced 61 percent in the DAMP 2 alternative. Therefore, the additional viscous damper in the structure is an effective manner of reducing the additional drift ratio that can be expected from the control arrangement.

TABLE 18

| Alternative | El Centro | Chi-Chi | Northridge | Pacoima |
|---|---|---|---|---|
| Cony. | 1.0% | 1.5% | 2.1% | 2.0% |
| PROP 1 | 8.6% | 7.5% | 16.4% | 13.3% |
| PROP 2 | 3.7% | 7.0% | 6.7% | 12.4% |
| DAMP 1 | 0.8% | 1.5% | 1.9% | 2.7% |
| DAMP 2 | 1.5% | 2.7% | 3.5% | 4.8% |

Peak Base Shear and Moment

The base reactions for the model with the added damper are also lower than the reactions for the model without the added damper. This can be observed in Table 19 and Table 21. For the alternatives without the added damper, the most the base shear was reduced was to 38 percent of the conventional model. In the alternatives with the added dampers, the base shear was reduced to 26 percent of the conventional model. This means that the base shear can be reduced to almost one fourth the base shear experienced by the conventional model. The uttermost the base moment was reduced for the alternatives without the added damper was to 41 percent of the conventional model. For the alternatives with the added damper, the base moment was reduced to 25 percent. This represents a potential of reducing by one fourth both base reactions of the conventional model when using the control arrangement with a viscous damper.

Table 20 presents the shear reactions at the base of the tube and the spring section. It can be observed that the reaction at the base of the vertical tube is reduced when comparing alternatives with the added dampers to alternatives without the added damper. However, the reaction at the spring sections is similar in both types of alternatives.

TABLE 19

| | Peak Base Shear (lbs) | | | |
|---|---|---|---|---|
| Alternative | El Centro | Chi-chi | Northridge | Pacoima |
| Cony. | 56.4 | 86.9 | 114.5 | 116.4 |
| PROP. 1 | 35.2 | 45.4 | 76.0 | 54.9 |
| PROP. 2 | 37.4 | 49.7 | 66.6 | 100.1 |
| DAMP 1 | 15.6 | 22.9 | 32.9 | 40.6 |
| DAMP 2 | 20.6 | 24.4 | 37.4 | 46.8 |

TABLE 20

| | | Peak Shear (lbs) | | | |
|---|---|---|---|---|---|
| Alternative | Section | El Centro | Chi-Chi | Northridge | Pacoima |
| PROP. 1 | Spring | 7.35 | 6.04 | 14.2 | 11.3 |
| PROP. 1 | Tube Base | 35.2 | 45.4 | 76.0 | 54.9 |
| PROP. 2 | Spring | 13.5 | 26.2 | 23.5 | 45.1 |

TABLE 20-continued

| | | Peak Shear (lbs) | | | |
|---|---|---|---|---|---|
| Alternative | Section | El Centro | Chi-Chi | Northridge | Pacoima |
| PROP. 2 | Tube Base | 37.4 | 49.7 | 66.6 | 100.1 |
| DAMP 1 | Spring/Damper | 4.9 | 9.8 | 12.2 | 17.4 |
| DAMP 1 | Tube Base | 16.6 | 24.3 | 32.9 | 43.7 |
| DAMP 2 | Spring/Damper | 8.9 | 17.2 | 23.4 | 31.3 |
| DAMP 2 | Tube Base | 18.9 | 27.1 | 37.0 | 54.1 |

TABLE 21

| | Peak Base Moment (lbs) | | | |
|---|---|---|---|---|
| Alternative | El Centro | Chi-chi | Northridge | Pacoima |
| Conv. | 1231.9 | 1864.0 | 2506.0 | 2410.9 |
| PROP. 1 | 812.5 | 1142.3 | 1555.5 | 1196.0 |
| PROP. 2 | 650.7 | 813.9 | 1028.7 | 1582.3 |
| DAMP 1 | 317.3 | 467.3 | 644.6 | 805.8 |
| DAMP 2 | 410.5 | 476.7 | 712.8 | 768.5 |

Conclusions from the Simulated Earthquake Tests

Results from simulated earthquake tests were presented for four alternatives of the model with the control arrangement. Two of these alternatives consist of models without an added damper and the remaining two alternatives have an added damper. The results of the four alternatives were compared with the comparative model resembling a conventional building. The peak acceleration for the alternatives with the control arrangement will not always occur at the top level. Depending on the alternative and the earthquake considered, the peak acceleration of the model can occur at the second or third floor level. Both alternatives of the control arrangement without an added damper were effective in reducing the peak acceleration for all earthquakes when compared to the conventional building. The control arrangement without the added damper increases dramatically the interstory drift ratio in the model. Increments of over five times were observed for both alternatives when compared to the conventional model. The control arrangement without the added damper was effective in reducing the base moment and base shear when compared to the conventional model. Reductions as high as 50% were observed for both the base shear and base moment. Both alternatives for the control arrangement with the added damper were more effective than the alternatives without the additional damper in reducing the peak acceleration when compared to the conventional building. Adding the damper to the control arrangement is effective in controlling the higher additional interstory peak drift ratios that result when using the control arrangement. However, the peak drift ratios for the arrangement with the added damper can still be higher than the ratios observed in the conventional model. The control arrangement with the added damper is substantially effective in reducing the peak base shear and peak base moment. Reductions to one fourth of the peak base reactions for the conventional model can be expected.

CONCLUSIONS

A new passive control building arrangement is proposed with the objective of improving the seismic response of structures. The proposed control arrangement was incorporated to a 1/20 scale model of a steel structure that was constructed in the Structures Laboratory of the University of Puerto Rico at Mayaguez. The SAP2000 software program was used to develop an analytical model of the constructed scale model. After using a series of experimental data to calibrate the analytical model, valuable information of the dynamic properties of the arrangement was obtained. Different configurations with distinct parameters of the control arrangement were analyzed in the program to evaluate the variables that affect the dynamic properties of the model. An additional model that resembles the behavior of a conventional building was also developed for comparative purposes. Simulated earthquake tests were performed in two proposed alternatives of the control arrangement to evaluate their effectiveness in improving the seismic response of the scale model. The results of these two alternatives were compared with the model resembling a conventional building as a comparative guideline. A viscous damper was added to these two alternatives to prove that the added viscous damper can further enhance the seismic response of the model.

The integration of the control arrangement to a structure significantly modifies its lateral load paths. The incorporation of hinges to articulate the vertical walls or columns of the structure completely changes the behavior of the structure, since the horizontal loads will be handled completely by the control arrangement. It was analytically determined that a minimum spring stiffness value is required to maintain stability in the scale mode with the control arrangement. An expression to determine the minimum spring stiffness value was derived for a three level, one bay structure similar to the one constructed in this invention. An analytical model developed with the SAP2000 program was successfully generated and calibrated to simulate the constructed scale model. The dynamic characteristics of the scale model with different alternatives of the control arrangement were successfully determined with the analytical model. Modal shapes, natural periods and Modal Participating Mass Ratios were obtained from the analytical model. The position of the pivoting arm fasteners affects the dynamic properties of the model with the control arrangement. The modal shapes, natural periods and participating mass are all affected, preeminently for the first and second vibration modes of the model. The variation of the spring stiffness value modifies the dynamic properties of the first and second vibration modes of the model. A reduction in the spring stiffness results in an increment for the first mode period but a reduction in the modal participating mass ratio for the mode.

It was demonstrated that the control arrangement has the capability of reducing the peak accelerations induced by an earthquake when compared to the conventional building. The control arrangement increases dramatically the interstory drift ratio experimented during an earthquake when compared to a conventional building. The control arrangement is highly effective in reducing peak base shear and peak base moment when compared to the conventional model. The addition of a viscous damper to the control arrangement enhances its effectiveness in reducing the peak accelerations when compared to the alternatives without this device. Adding a viscous damper to the control arrangement helps to mitigate the higher peak interstory drift ratios that can be expected when using the control arrangement. Adding a viscous damper to the control arrangement improves the reduction in peak base shear and peak base moment that can be expected when the control arrangement is used.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

The invention claimed is:

1. A system for controlling structural vibrations of a multi-story vertical structure, the system comprising:

a vertical member configured to pass through a plurality of floors of a vertical structure, said vertical member being secured to ground;

a plurality of pivoting arms, each pivoting arm comprising an upper pivoting end, a lower pivoting end and a tube pivoting coupling positioned between said upper coupling end and said lower coupling end;

a first pivoting arm of the plurality of pivoting arms is coupled to an external elastic member at the lower pivoting end, the upper pivoting end is coupled to a first floor of said vertical structure and the tube pivoting coupling is coupled to said vertical member at a point between ground and said first floor;

a second pivoting arm of the plurality of pivoting arms has the lower pivoting end coupled to the upper pivoting end of said first pivoting arm, the upper pivoting end is coupled to a second floor of said vertical structure and the tube pivoting coupling is coupled to said vertical member at a point between said first floor and said second floor.

2. The system of claim 1, further comprising a third pivoting arm of the plurality of pivoting arms having the lower pivoting end coupled to the upper pivoting end of said second pivoting arm, the upper pivoting end is coupled to a third floor of said vertical structure and the tube pivoting coupling is coupled to said vertical member at a point between said second floor and said third floor.

3. The system of claim 1, wherein the upper pivoting end and the lower pivoting end of said pivoting arms allow vertical translation of the pivoting arms incapacitating the pivoting arms from transmitting vertical loads.

4. The system of claim 1, wherein horizontal loads are transferred only through the pivoting arms.

5. The system of claim 1, further comprising a viscous damper system coupled to said first pivoting arm.

6. The system of claim 1, wherein the tube pivoting coupling of each pivoting arm comprises a plurality of coupling points that allow to adjust the coupling position of said pivoting arm in relation to the vertical member.

7. The system of claim 1, wherein the upper pivoting end and the lower pivoting end of the pivoting arm have an opening that allow said pivoting arm to pivot at a coupling point with the floors while sliding within a limited range in relation to said floors.

8. The system of claim 1, wherein said first pivoting arm has an opening at the upper pivoting end that allows said first pivoting arm to pivot at a coupling point with the first floor and the lower pivoting end has a support element configured to be coupled with said elastic member.

* * * * *